US010772800B2

(12) United States Patent
Zollinger et al.

(10) Patent No.: US 10,772,800 B2
(45) Date of Patent: Sep. 15, 2020

(54) DISPOSABLE CARTRIDGE FOR AUTOMATIC DRUG COMPOUNDER

(71) Applicant: CareFusion 303, Inc., San Diego, CA (US)

(72) Inventors: Christopher J. Zollinger, Chino Hills, CA (US); George Michel Mansour, Pomona, CA (US); Robert Edwin Schneider, Erie, CO (US)

(73) Assignee: CareFusion 303, Inc., San Diego, CA (US)

( * ) Notice: Subject to any disclaimer, the term of this patent is extended or adjusted under 35 U.S.C. 154(b) by 0 days.

(21) Appl. No.: 15/781,070

(22) PCT Filed: Dec. 2, 2016

(86) PCT No.: PCT/US2016/064823
§ 371 (c)(1),
(2) Date: Jun. 1, 2018

(87) PCT Pub. No.: WO2017/096302
PCT Pub. Date: Jun. 8, 2017

(65) Prior Publication Data

US 2018/0353382 A1 Dec. 13, 2018

Related U.S. Application Data

(60) Provisional application No. 62/263,568, filed on Dec. 4, 2015.

(51) Int. Cl.
*A61J 3/00* (2006.01)
*B65B 3/00* (2006.01)
*B65B 1/30* (2006.01)

(52) U.S. Cl.
CPC ..... *A61J 3/002* (2013.01); *B65B 3/003* (2013.01); *B65B 1/30* (2013.01)

(58) Field of Classification Search
None
See application file for complete search history.

(56) References Cited

U.S. PATENT DOCUMENTS 4,639,245 A * 1/1987 Pastrone ..... A61M 5/14224 128/DIG. 1
4,818,186 A * 4/1989 Pastrone ..... A61M 5/14224 251/9

(Continued)

FOREIGN PATENT DOCUMENTS

CN 2166818 Y 6/1994
CN 1691282 A 11/2005

(Continued)

OTHER PUBLICATIONS

International Search Report and Written Opinion for Application No. PCT/US2016/064823, dated Mar. 13, 2017, 8 pages.

(Continued)

*Primary Examiner* — Jessica Cahill
*Assistant Examiner* — Christopher M Afful
(74) *Attorney, Agent, or Firm* — Morgan, Lewis & Bockius LLP

(57) ABSTRACT

A disposable pump cartridge for a compounder system is provided. The cartridge may include a plurality of controllable fluid pathways and a piston for pumping fluid and/or vapors through selected ones of the fluid pathways. The cartridge may include a plurality of valves operable to select particular pathways from the plurality of pathways. The fluid pathways may be formed from a portion of a cartridge frame and a sealing membrane disposed on the cartridge frame. A cartridge bezel disposed over the sealing membrane may include openings that provide access to the valves. The valves and the piston may be operated by a pump drive of the compounder system. The bezel may include additional openings that provide access to ports within the cartridge for (Continued)

receiving diluents or for providing waste. Portions of the sealing membrane within the additional openings in the bezel may be configured to receive a needle therethrough.

18 Claims, 83 Drawing Sheets

(56) References Cited

U.S. PATENT DOCUMENTS 4,842,584 A * 6/1989 Pastrone ..... A61M 5/14224 604/153
4,856,340 A * 8/1989 Garrison ..... G01L 19/0046 73/715
5,062,774 A * 11/1991 Kramer ..... A61J 3/002 128/DIG. 12
2015/0257974 A1 9/2015 Demers et al.
2015/0374585 A1 12/2015 Mansour et al.

FOREIGN PATENT DOCUMENTS

| | | | |
|---|---|---|---|
| CN | 202537955 | U | 11/2012 |
| CN | 103025364 | A | 4/2013 |
| EP | 0370549 | A2 | 5/1990 |
| GB | 1014706 | A | 12/1965 |
| JP | 3175131 | B2 | 6/2001 |
| WO | WO-8600797 | A1 | 2/1986 |
| WO | WO-9936112 | A1 | 7/1999 |

OTHER PUBLICATIONS

Chinese Office Action for Application No. 201680079216.9, dated May 6, 2020, 36 pages.

* cited by examiner

| Operation | Valve 1 Pump | | Valve 2 Diluent | | Valve 3 RC | | Valve 4 Vent | |
|---|---|---|---|---|---|---|---|---|
| | 1A | 1B | 2A | 2B | 3A | 3B | 4A | 4B |
| Prime Draw Diluent | Closed | Open | Open | Closed | Closed | Closed | Closed | Closed |
| Prime - Push to Waste | Closed | Open | Closed | Open | Open | Closed | Closed | Open |
| QS (Hi Flow Peristaltic) | Closed | Closed | Closed | Open | Closed | Closed | Closed | Closed |
| Push Diluent to Vial | Open | Closed | Open | Closed | Closed | Open | Open | Closed |
| Draw Drug from Vial | Open | Closed | Closed | Open | Open | Closed | Closed | Open |
| Push to RC | Closed | Open | Closed | Open | Closed | Open | Open | Closed |
| Fill Empty Bag with Diluent (Hi Flow) | Open | Closed | Open | Open | Closed | Open | Open | Closed |

FIG. 50

| Operation | Valve 1 Diluent | | | Valve 2 RC | | |
|---|---|---|---|---|---|---|
| | P1 | P2 | P3 | P1 | P2 | P3 |
| Diluent to Receiving Container | Closed | Open | Closed | Closed | Closed | Open |
| Diluent to Vial | Closed | Open | Closed | Open | Closed | Closed |
| Vial to Receiving Container | Closed | Closed | Open | Closed | Closed | Open |
| Pull Air Back from Receiving Container | Open | Closed | Closed | Closed | Open | Closed |

FIG. 77

DISPOSABLE CARTRIDGE FOR AUTOMATIC DRUG COMPOUNDER

TECHNICAL FIELD

The present disclosure generally relates to an apparatus that reconstitutes, mixes, and delivers a drug from a vial to a receiving container. Specifically, the present disclosure relates to a disposable cartridge with multiple flow paths to allow reconstitution of a drug, filling of a receiving container, delivery of diluents from hung diluent bags and diluent vials to medication vials, and removal of waste to a waste container.

BACKGROUND

Pharmaceutical compounding is the practice of creating a specific pharmaceutical product to fit the unique need of a patient. In practice, compounding is typically performed by a pharmacist, tech or a nurse who combines the appropriate ingredients using various tools. One common form of compounding comprises the combination of a powdered drug formulation with a specific diluent to create a suspended pharmaceutical composition. These types of compositions are commonly used in intravenous/parenteral medications. It is vital that the pharmaceuticals and diluents are maintained in a sterile state during the compounding process, and there exists a need for automating the process while maintaining the proper mixing characteristics (i.e., certain pharmaceuticals must be agitated in specific ways so that the pharmaceutical is properly mixed into solution but the solution is not frothed and air bubbles are not created). There exists a need for a compounding system that is easy to use, may be used frequently, efficiently, is reliable, and reduces user error.

SUMMARY

A disposable pump cartridge for a compounder system is provided. The cartridge may include a plurality of controllable fluid pathways and a piston for pumping fluid and/or vapors through selected ones of the fluid pathways.

In accordance with an embodiment, a pump cartridge for a compounder system is provided, the pump cartridge including at least one diluent port configured to receive a diluent in a diluent chamber; at least one waste port configured to provide vapor waste from a vapor waste chamber; a receiving container port configured to provide a fluid to a receiving container; a plurality of controllable fluid pathways fluidly coupled to the at least one diluent port, the at least one waste port, and the receiving container port; and a piston pump configured to pump the fluid and the vapor waste within the plurality of controllable fluid pathways.

In accordance with another embodiment, a compounder system is provided that includes a pump head assembly having a plurality of operational mechanisms; and a pump cartridge that includes a diluent port; an output port; a waste port; a plurality of valves; a needle assembly; and a piston, where the piston and the plurality of valves of the pump cartridge are configured to be operated by the plurality of operational mechanisms of the pump head assembly to (a) pump a fluid from a container through the diluent port and the needle assembly to a vial, (b) pump vapor waste through the needle assembly through the waste port to a waste container, and (c) pump a reconstituted drug from the vial through the needle assembly and the output port to a receiving container.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings:

FIG. 50 is a chart showing the positioning of certain valves in accordance with aspects of the present disclosure.

FIG. 77 is a chart showing the positioning of certain valves in accordance with aspects of the present disclosure.

DETAILED DESCRIPTION

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions may be provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

The present system comprises multiple features and technologies that in conjunction form a compounding system that can efficiently reconstitute pharmaceuticals in a sterile environment and deliver the compounded pharmaceutical to a delivery bag for use on a patient.

Figure 1:
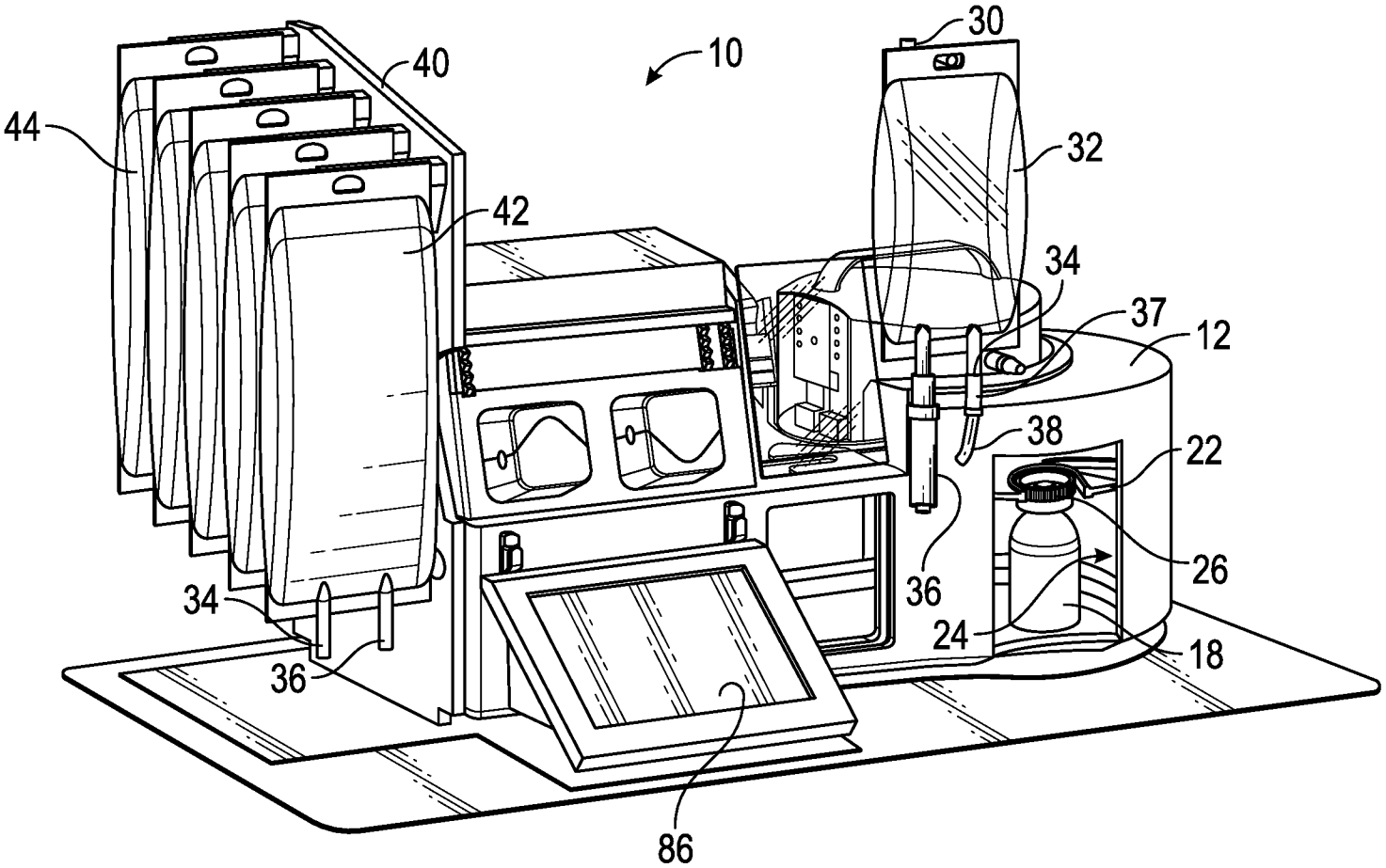
FIG. 1 illustrates a front perspective view of an example of an exemplary embodiment of a compounding system in accordance with aspects of the present disclosure.
Figure 2:
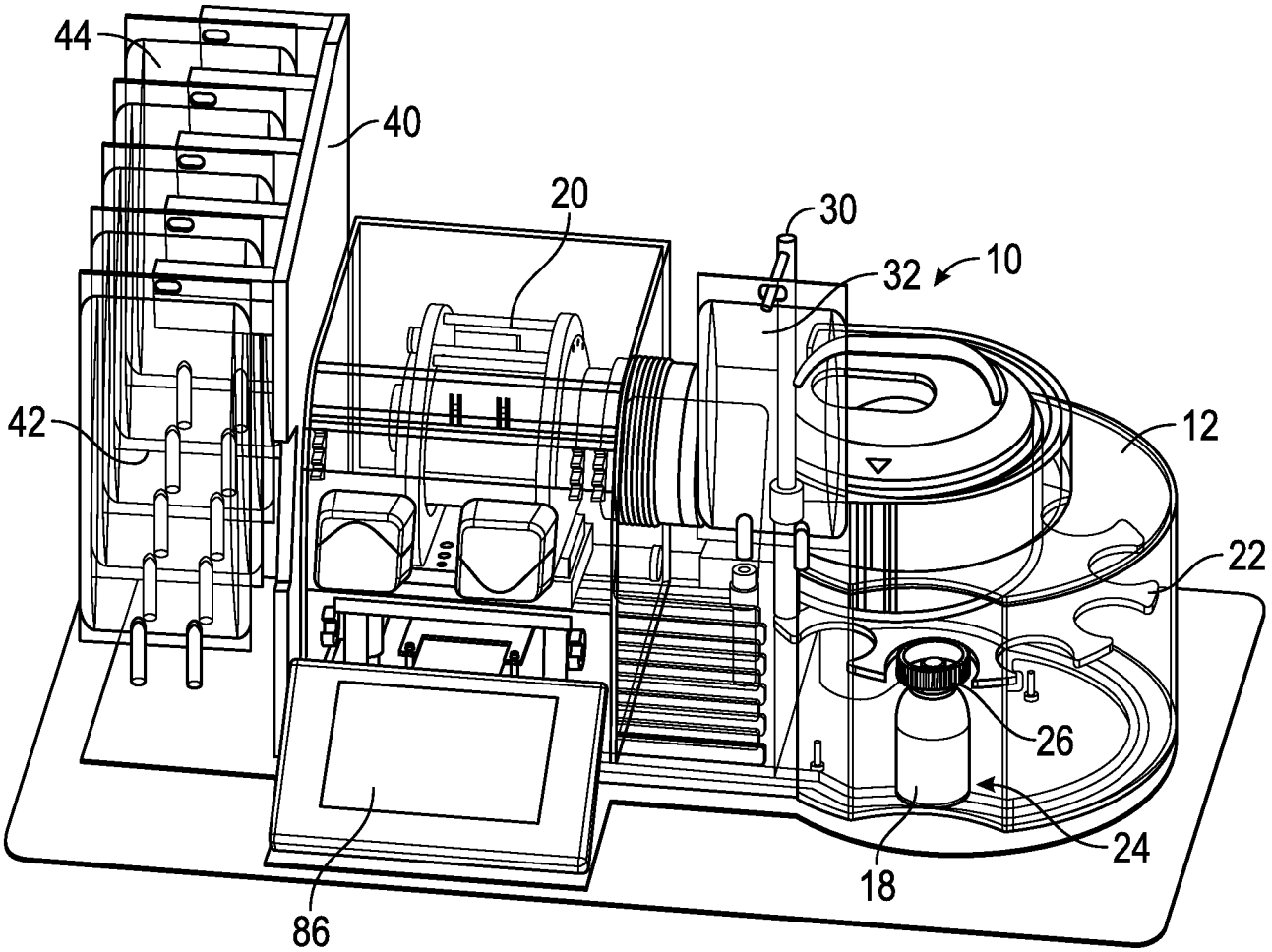
FIG. 2 illustrates a front perspective view of the compounding system of FIG. 1 with a transparent housing in accordance with aspects of the present disclosure.
Figure 3:
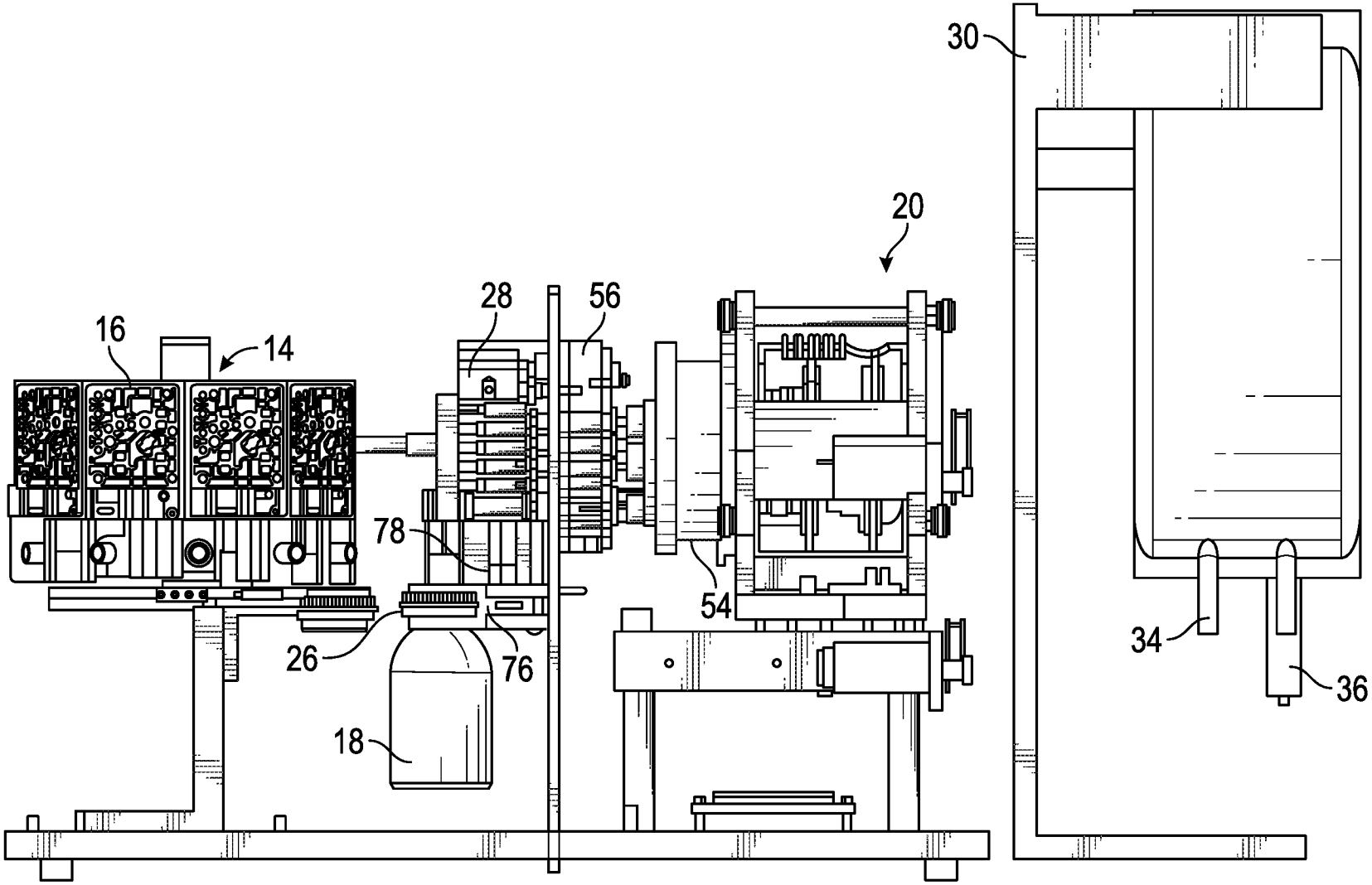
FIG. 3 illustrates a side view of the compounding system of FIG. 1 with the housing removed in accordance with aspects of the present disclosure.

FIG. 1 illustrates a compounder system 10 according to an embodiment. FIG. 2 illustrates the system 10 with a transparent outer housing 12 and FIG. 3 illustrates the system with the housing removed. The system comprises a carousel assembly 14 that contains up to 10 individual cartridges 16. The carousel 14 can hold more or less cartridges 16 if desired. The cartridges 15 are disposable and provide unique fluid paths between a vial 18 containing a powdered drug (or concentrated liquid drug), multiple diluents, and a receiving container. The cartridges 16 may, if desired, also provide a fluid path to a vapor waste container. However, in other embodiments, filtered or unfiltered non-toxic waste may be vented from the compounder to the environment reducing or eliminating the need for a waste port. Each cartridge contains a piston pump and valves that control the fluid intake, outtake, and fluid path selection during the steps of the compounding process as the fluid moves through the cartridge and into a receiving container.

The carousel assembly 14 is mounted on the apparatus such that it can rotate to bring different cartridges 16 into alignment with the pump drive mechanism 20. The carousel 14 is typically enclosed within a housing 12 that can be opened in order to replace the carousel 14 with a new carousel 14 after removing a used one. As illustrated, the carousel 14 can contain up to 10 cartridges 16, allowing a particular carousel to be used up to 10 times. In this configuration, each carousel assembly can support, for example, 10 to 100 receiving containers, depending on the type of compounding to be performed. For example, for hazardous drug compounding, a carousel assembly can support compounding to ten receiving containers. In another example, for non-hazardous drug compounding such as antibiotic or pain medication compounding, a carousel assembly can support compounding to 100 receiving containers. The housing 12 also includes a star wheel 22 positioned underneath the carousel 14. The star wheel rotates vials 18 of pharmaceuticals into position either in concert with, or separate from, the specific cartridges 16 on the carousel 14. The housing 12 may also include an opening 24 for loading the vials 18 into position on the star wheel 22.

Each one of the cartridges 16 in the carousel 14 is a disposable unit that includes multiple pathways for the diluent and vapor waste. These pathways will be described in detail with reference to, for example, FIGS. 39-63 and 68A-77 later in the application. Each cartridge 16 is a small, single disposable unit that may also include a "backpack" in which a tube for connection to the receiving container (e.g., an IV bag, a syringe, or an elastomeric bag) may be maintained. Each cartridge 16 also may include a pumping mechanism such as a piston pump for moving fluid and vapor through the cartridge 16 as well as a dual lumen needle in a housing that can pierce a vial puck 26 on top of a vial 18 once the vial 18 has been moved into position by the pump drive mechanism 20. For example, the needle may pierce the vial puck 26 via the compressive action of the vial puck 26, which is moved towards the needle. Each cartridge 16 also includes a plurality of ports designed to match up with the needles of a plurality of diluent manifolds. Each cartridge 16 also includes openings to receive mounting posts and a locking bayonet from the pump head assembly 28. Although a locking bayonet is described herein as an example, other locking mechanisms may be used to retrieve and lock a cartridge to the pump head (e.g., grippers, clamps, or the like may extend from the pump head). Each cartridge 16 also includes openings allowing valve actuators from the pump motor mechanism to interact with the valves on each cartridge 16.

Adjacent the housing 12 that holds the vials 18 and the carousel 14 is an apparatus 30 for holding at least one container 32, such as an IV bag 32 as shown in the figures. The IV bag 32 typically has two ports such as ports 34 and 36. For example, in one implementation, port 34 is an intake port 34 and port 36 is an outlet port 36. Although this implementation is sometimes discussed herein as an example, either of ports 34 and 36 may be implemented as an input and/or outlet port for container 32. For example, in another implementation, an inlet 34 for receiving a connector at the end of tubing 38 may be provided on the outlet port 36. In the embodiment shown, the IV bag 32 hangs from the holding apparatus 30, which, in one embodiment is a post with a hook as illustrated in FIGS. 1-3. As discussed in further detail hereinafter, one or more of the hooks for hanging containers such as diluent containers, receiving containers, or waste containers may be provided with a weight sensor such as a load cell that detects and monitors the weight of a hung container. The holding apparatus 30 can take any other form necessary to position the IV bag 32 or other pharmaceutical container. Once the IV bag 32 is positioned on the holding apparatus 30, a first tube 38 (a portion of which is shown in FIG. 1) is connected from a cartridge 16 on the carousel 14 to the inlet 34 of the IV bag 32. For example, the first tube may be housed in a backpack attached to the cartridge and extended from within the backpack (e.g., by an operator or automatically) to reach the IV bag 32. A connector 37 such as a Texium® connector may be provided on the end of tube 38 for connecting to inlet 34 of receiving container 32.

On the opposite side of the compounder 10 is an array of holding apparatuses 40 for holding multiple IV bags 32 or other containers. In the illustrated version of the compounder 10, five IV bags 42, 44 are pictured. Three of these bags 42 may contain diluents, such as saline, D5W or sterile water, although any diluent known in the art may be utilized. An additional bag in the array may be an empty vapor waste bag 44 for collecting waste such as potentially hazardous or toxic vapor waste from the mixing process. An additional bag 44 may be a liquid waste bag. The liquid waste hag may be configured to receive non-toxic liquid waste such as saline from a receiving container. As discussed in further detail hereinafter, liquid waste may be pumped to the waste hag via dedicated tubing using a mechanical pump. In operation, diluent lines and a vapor waste line from the corresponding containers 42 and 44 may each be connected to a cartridge 16 through a disposable manifold.

The compounding system 10 also includes a specialized vial puck 26 designed to attach to multiple types of vials 18. In operation, the vial puck 26 is placed on top of the vial 18 containing the drug in need of reconstitution. Once the vial puck 26 is in place, the vial 18 is loaded into the star wheel 22 of the compounder 10. Mating features on the vial puck 26 provide proper alignment both while the vial puck 26 is in the star wheel 22 and when the vial puck 26 is later rotated into position so that the compounder 10 can remove it from the star wheel 22 for further processing.

Figure 4:
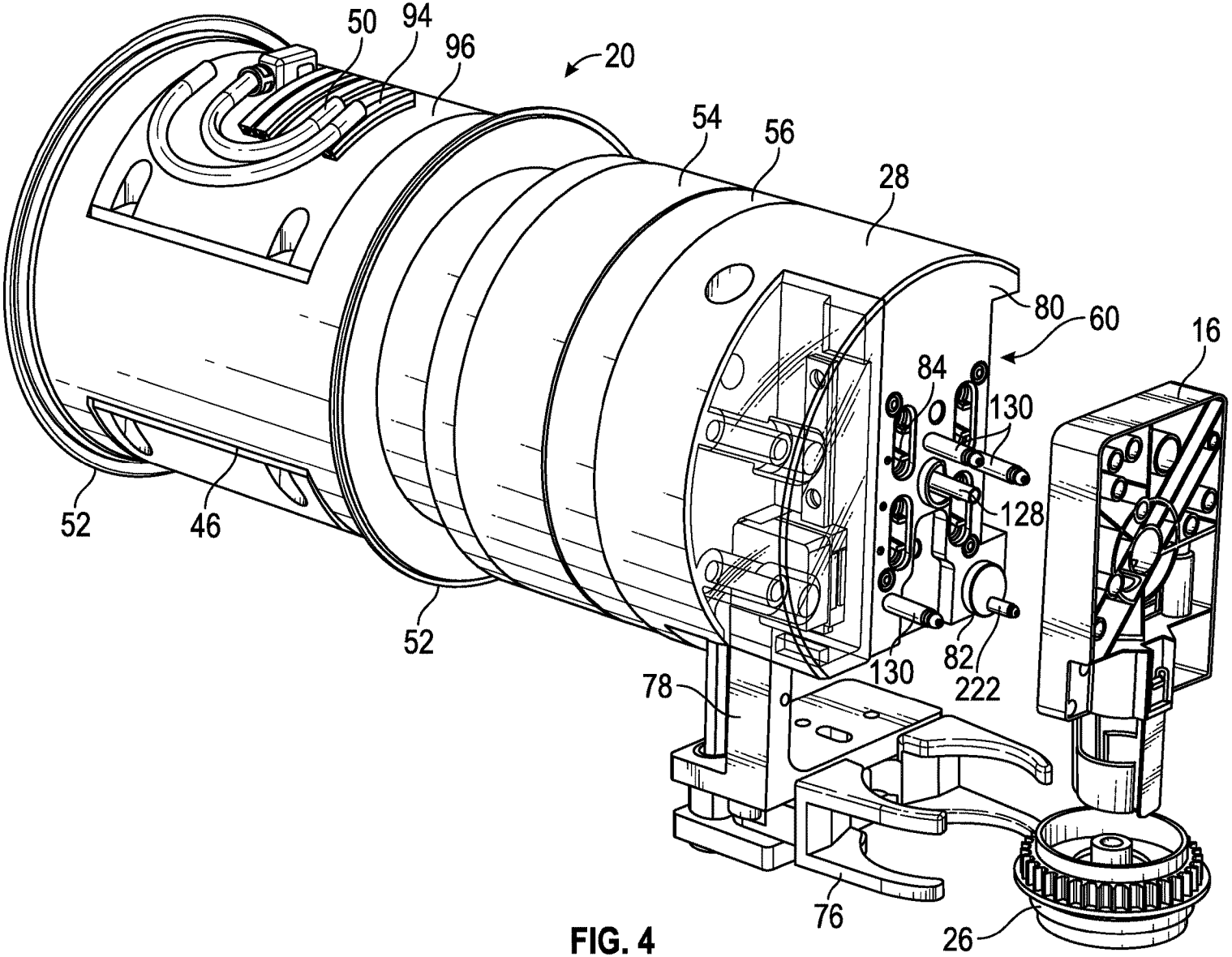
FIG. 4 illustrates a perspective view of an exemplary embodiment of a pump drive mechanism in accordance with aspects of the present disclosure.
Figure 5:
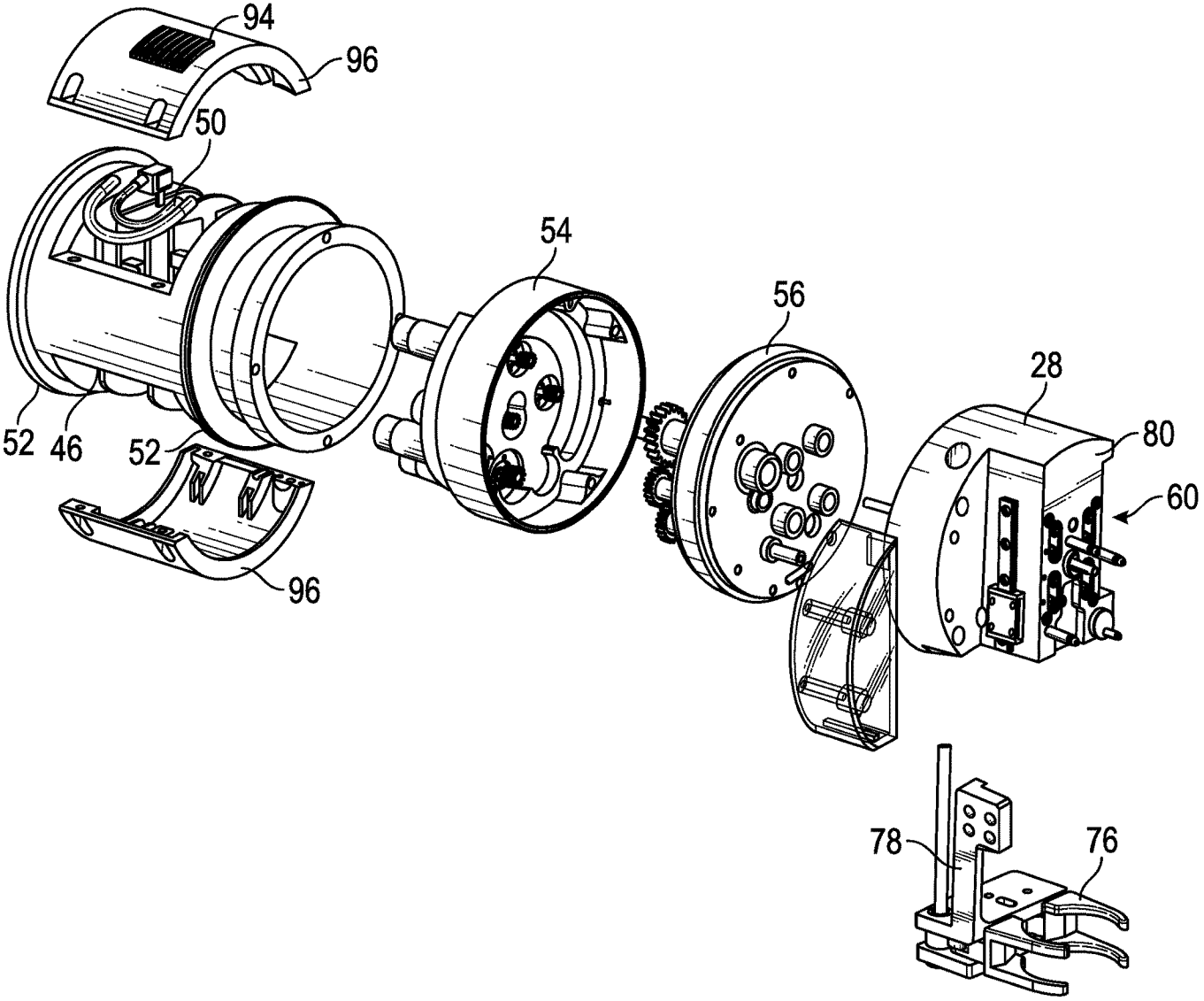
FIG. 5 illustrates an exploded view of the pump drive mechanism of FIG. 4 in accordance with aspects of the present disclosure.

The pump drive mechanism 20 is illustrated in FIG. 4, and in an exploded view in FIG. 5, according to an embodiment. In the embodiment shown in FIGS. 4 and 5, the pump drive mechanism 20 comprises a multitude of sections. At one end of the pump drive mechanism 20 is the rotation housing 46, which holds the drive electronics and includes locking flanges 94 on its housing 96 for flexible tubing 50 which may run from one or more diluent containers and/or waste containers to one or more corresponding manifolds. The rotation housing 46 is capable of rotating around its axis to rotate the rest of the pump drive mechanism 20. The rotation housing 46 includes bearing ribs 52 on its ends which allow it to rotate. For example, the pump drive mechanism may be configured to rotate through any suitable angle such as up to and including 180°, or more than 180°.

Figure 6:
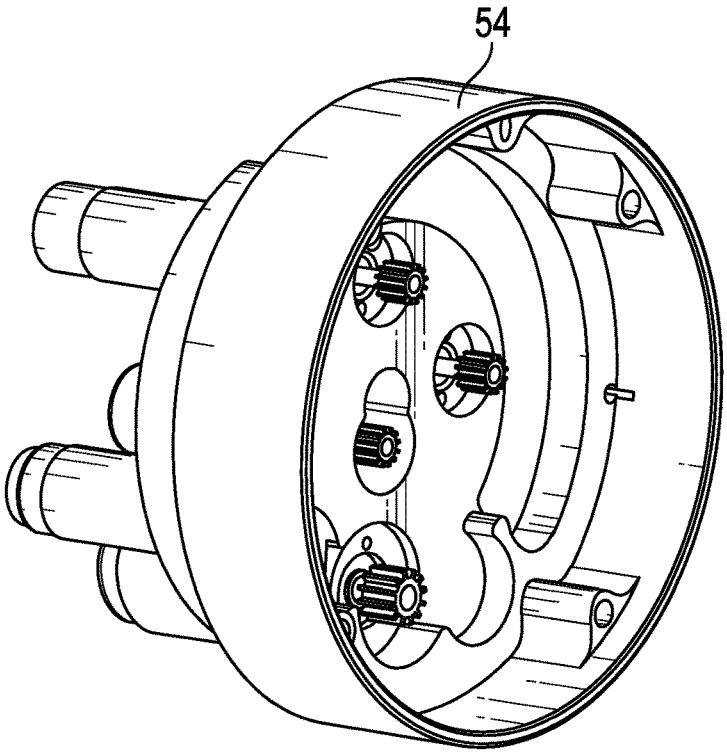
FIG. 6 illustrates a perspective view of an example of an exemplary embodiment of a motor mount in accordance with aspects of the present disclosure.
Figure 7:
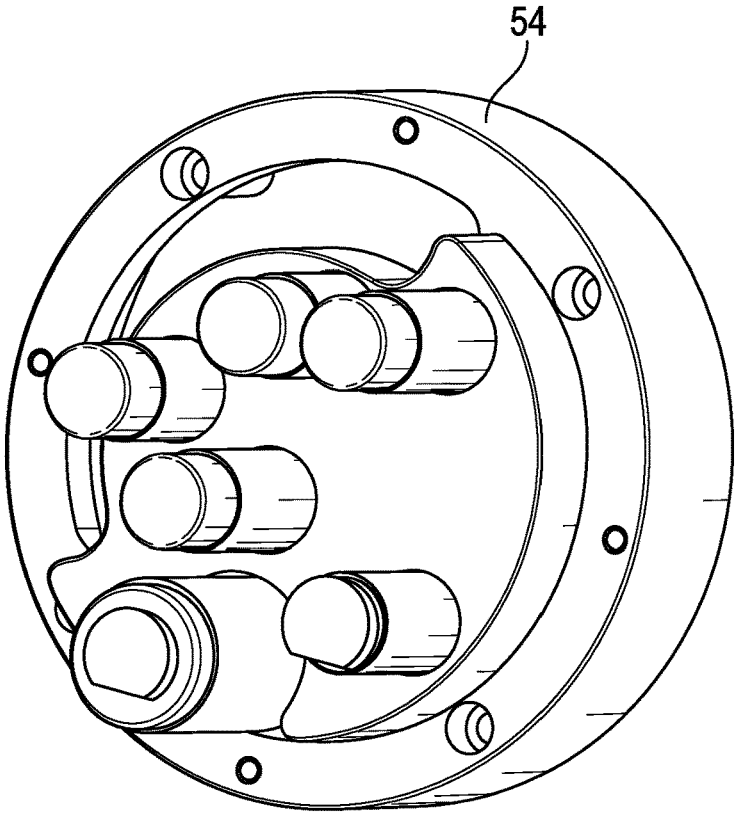
FIG. 7 illustrates a rear perspective view of the motor mount of FIG. 6 in accordance with aspects of the present disclosure.
Figure 8:
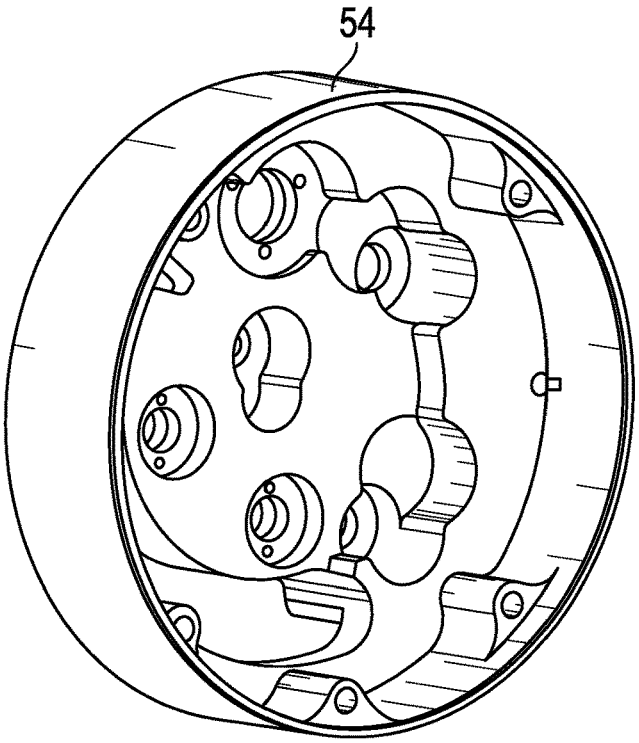
FIG. 8 illustrates a perspective view of the motor mount of FIG. 6 in accordance with aspects of the present disclosure.
Figure 9:
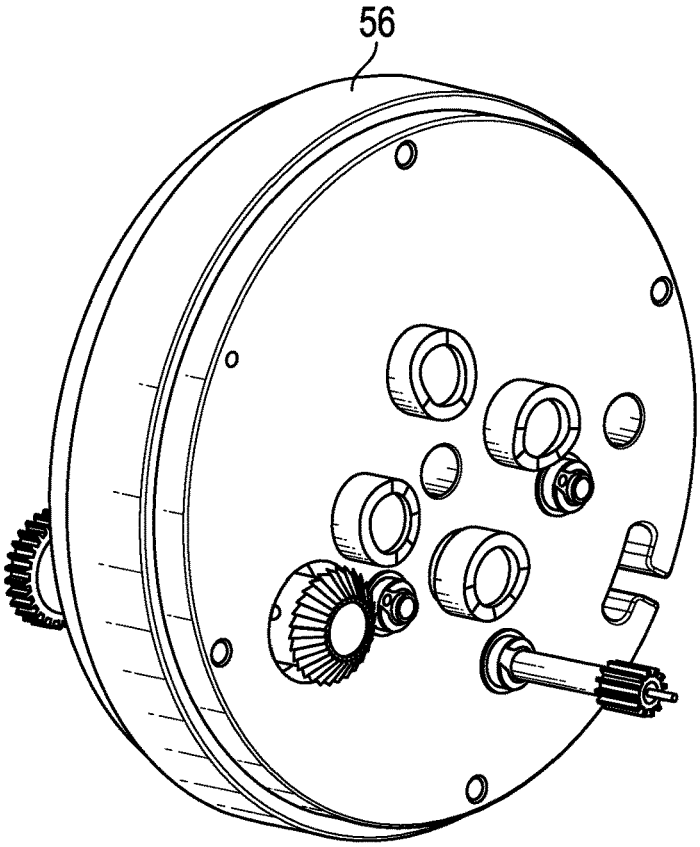
FIG. 9 illustrates a perspective view of an exemplary embodiment of a cam housing in accordance with aspects of the present disclosure.
Figure 10:
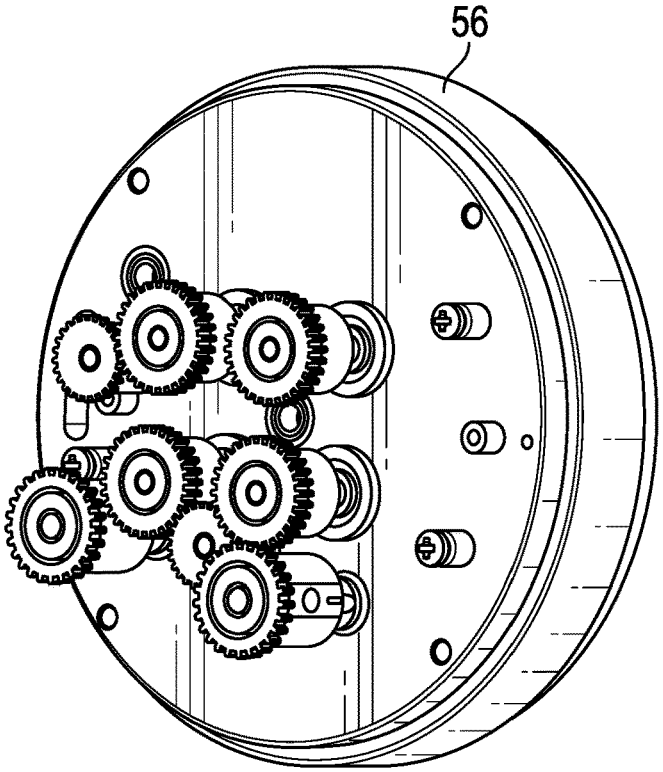
FIG. 10 illustrates a rear perspective view of the cam housing of FIG. 9 in accordance with aspects of the present disclosure.
Figure 11:
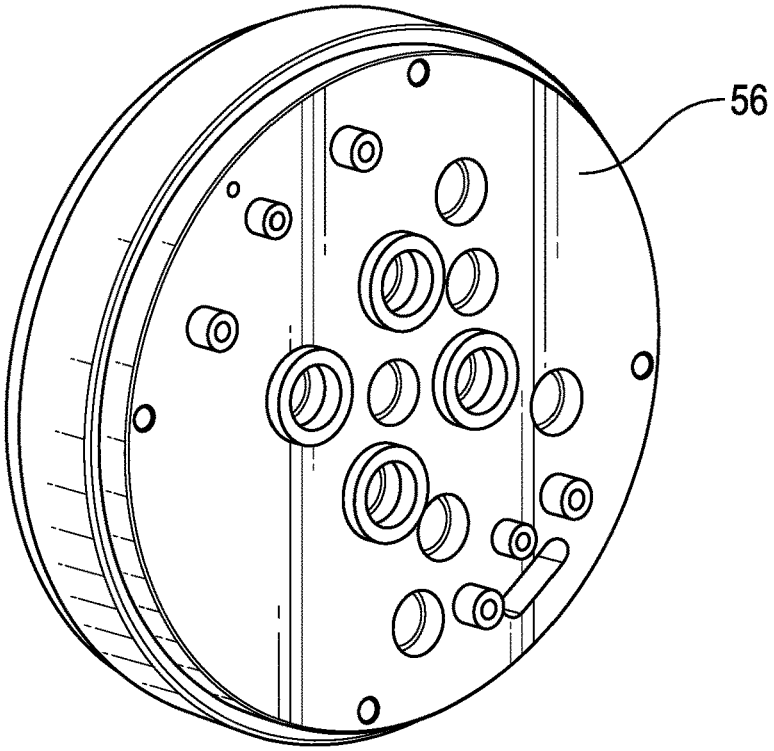
FIG. 11 illustrates a rear perspective view of the cam housing of FIG. 9 with the gears removed in accordance with aspects of the present disclosure.
Figure 12:
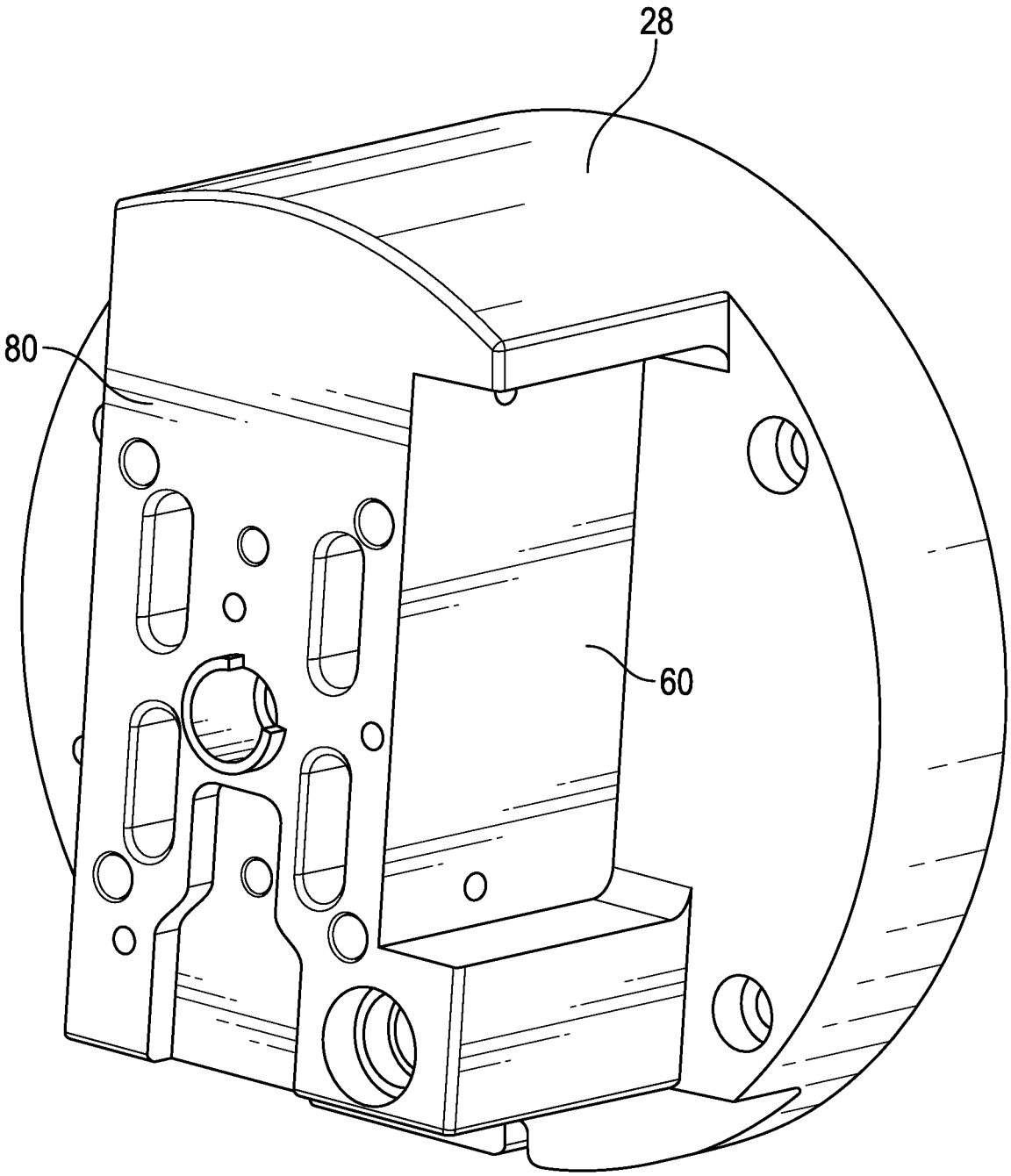
FIG. 12 illustrates a perspective view of an exemplary embodiment of a pump head assembly in accordance with aspects of the present disclosure.

Next to the rotation housing 46 is the motor mount 54, which is shown alone from various angles in FIGS. 6-8, according to an embodiment. In the embodiment shown in FIGS. 4-8, the cam housing 56, shown in further details from various angles FIGS. 9-11, is connected to the motor mount 54, which includes cams and gears that control the rotary motion of the motors and the axial motion of the pump drive mechanism 20 as it moves into position to pick up a cartridge 16 and a vial 18.

The compounder system also includes a diluent magazine (not shown) that mounts in a slot 60 located on the side of the pump drive mechanism. The diluent magazine may be a disposable piece configured to receive any number of individual diluent manifolds operable as diluent ports. The diluent manifolds (not shown) may be modular so they can easily and removably connect to each other, the magazine, and/or connect to the pump drive mechanism 20.

The final portion of the pump drive mechanism 20 is the pump head assembly 28. The pump head assembly 28 includes the vial grasping arms 76, the vial lift 78, the pump cartridge grasp 80, the pump piston eccentric drive shaft 82 with drive pin 222, the valve actuation mechanisms 84, as well as the motors that allow the pump drive mechanism 20 to move forward and back and to rotate in order to mix the pharmaceutical in the vial 18 once the diluent has been added to it. The compounder 10 may also include an input screen 86 such as a touch screen 86 as shown in the figures to provide data entry by the user and notifications, instructions, and feedback to the user.

Figure 21:
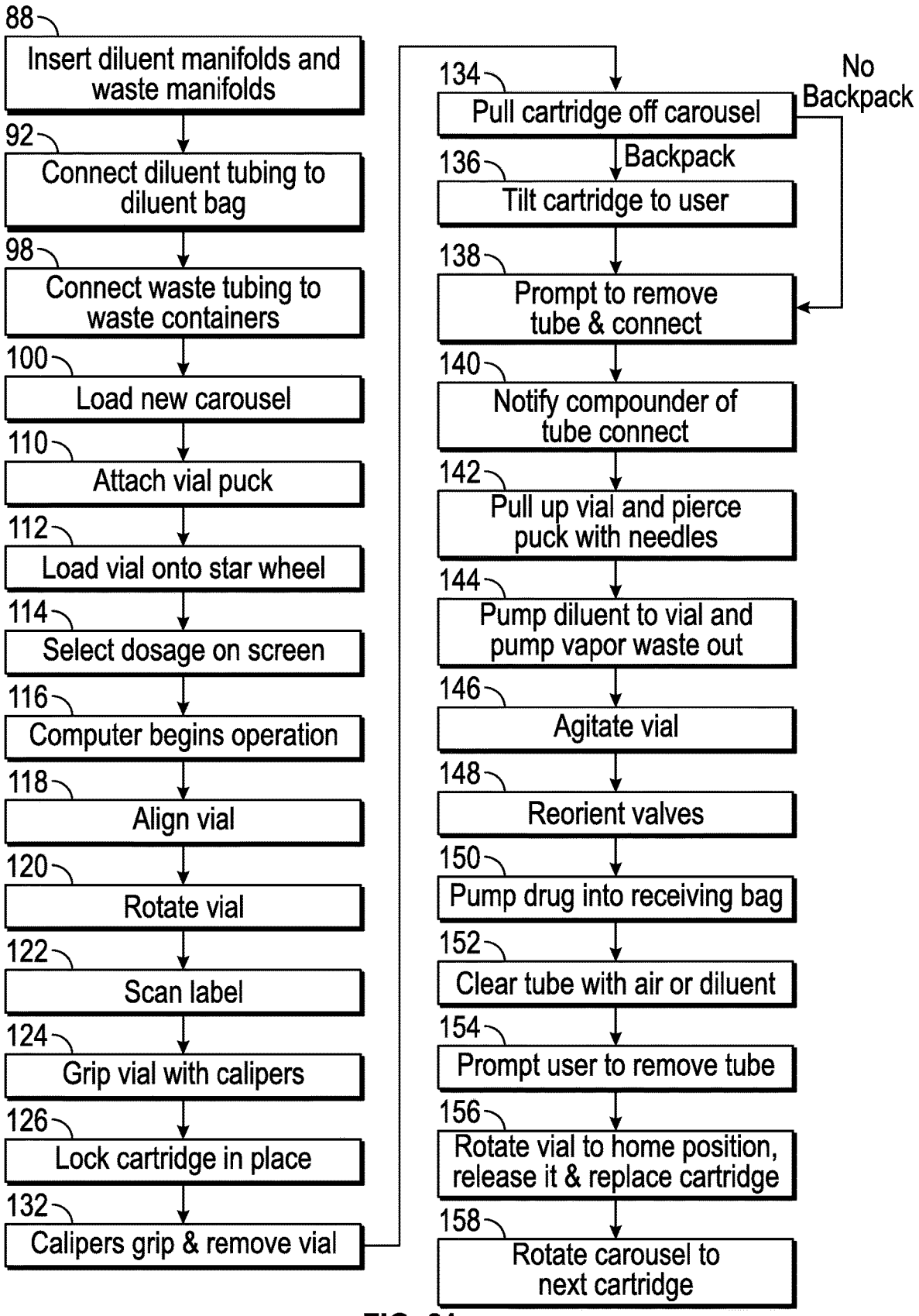
FIG. 21 is a flow chart illustrating an exemplary embodiment of the steps of a process in accordance with aspects of the present disclosure.

The operation of the compounder system 10 will now be generally described in the flowchart illustrated at FIG. 21, according to an embodiment. In the first step 88, a user inserts a new diluent manifold magazine having a plurality of manifolds (e.g., diluent manifolds and waste manifolds) into the slot 60 on the side of the pump head assembly 28. Manifolds may be loaded into the magazine before or after installing the magazine in the slot 60. The manifolds maintain needles inside the housing of the manifold until the cartridge 16 is later locked in place. The magazine may contain any number of diluent manifolds and vapor waste manifolds. In one illustrative system, there may be three diluent manifolds and one vapor waste manifold. In the next step 92, diluent tubing is connected to corresponding diluent bags. The tubes may be routed through locking flanges on a surface (e.g., the front surface) of the compounder frame to hold them in place. For example, in the illustrated embodiment of FIG. 24, the tubes are held in place with locking flanges 2402 on the frame of the compounder. Alternatively, other types of clips or locking mechanisms known in the art may be used to hold the tubes securely in place. In the illustrated embodiment of FIG. 4, the additional flanges 94 positioned on the outside housing 96 of the pump drive mechanism 20 are provided for securing internal wiring of the compounder. In the next step 98, waste tubing may be connected to the vapor waste bag 44. In other embodiments, tubing may be pre-coupled between the manifolds and associated containers such as diluent containers and/or waste containers and the operations of steps 92 and 98 may be omitted.

If desired, in the next step 100, a new carousel 14 may be loaded into a carousel mounting station such as a carousel hub of the compounder system. The carousel 14 may contain any number of disposable cartridges 16 arranged in a generally circular array. In the next step 110, a vial puck 26 is attached to the top of a vial 18 of a powdered or liquid pharmaceutical for reconstitution and the vial 18 is loaded into the star wheel 22 under the carousel 14 in the next step 112. Step 110 may include loading multiple vials 18 into multiple vial puck recesses in star wheel 22. After one or more vials are loaded into the star wheel, the vials are rotated into position to enable and initiate scanning of the vial label of each vial. In one embodiment, the user will be allowed to load vials into the star wheel until all vial slots are occupied with vials before the scanning is initiated. A sensor may be provided that detects the loading of each vial after which a next vial puck recess is rotated into the loading position for the user. Allowing the user to load all vials into the star wheel prior to scanning of the vial labels helps increase the efficiency of compounding. However, in other implementations, scanning of vial labels may be performed after each vial is loaded or after a subset of vials is loaded. Following these setup steps, the next step 114 is for a user to select the appropriate dosage on the input screen.

After the selection on the input screen 86, the compounder 10 begins operation 116. The star wheel 22 rotates the vial into alignment 118 with the vial grasping calipers 76 of the pump head assembly 28. The vial puck 26 includes, for example, gears that interface with gears coupled to a rotational motor that allow the vial 18 to rotate 120 so that a scanner (e.g., a bar code scanner or one or more cameras) can scan 122 a label on the vial 18. The scanner or camera (and associated processing circuitry) may determine a lot number and an expiration date for the vial. The lot number and expiration date may be compared with other information such as the current date and/or recall or other instructions associated with the lot number. Once the vial 18 is scanned and aligned, in the next step 124 the pump drive mechanism 20 moves forward into position to grip the vial 18 with the calipers 76. The forward movement also brings the mounting posts 130 and locking bayonet 128 on the front of the pump head assembly 28 into matching alignment with corresponding openings on a cartridge 16. In the next step 126 the cartridge 16 is locked in place on the pump head assembly 28 with the locking bayonet 128 and the calipers 76 grip 132 the vial puck 25 on the top of the vial 18. The calipers 76 then remove 132 the vial 18 from the star wheel 22 by moving backward, while at the same time pulling 134 the cartridge 15 off of the carousel 14.

In some embodiments, the cartridge 16 includes a backpack that includes a coiled tube. In this embodiment, in step 136 the pump drive mechanism 20 tilts the cartridge 16 toward the user to expose the end of the tube and prompts 138 the user to pull the tube out of the backpack and connect it to the receiving bag 32. In an alternative embodiment, the tube 38 is exposed on the side of the carousel 14 once the cartridge 15 is pulled away from the carousel 14. In another alternative embodiment, the tube 38 is automatically pushed out (e.g., out of the backpack) thus allowing the user to grab onto the connector located at the end of the tube and connect to the receiving container. The system prompts 138 the user to pull the tube out from the carousel 14 and connect it to the input 34 of the IV bag 32. Once the tube 38 is connected, in step 140 the user may notify the compounder 10 to continue the compounding process by interacting with the input screen 86.

At step 142, the vial 18 is pulled up towards the cartridge 16 so that one or more needles such as a coaxial dual lumen needle of the cartridge 16 pierce the top of the vial puck 26 and enter the interior of the vial 18. Although the example of FIG. 21 shows engagement of the needle with the vial puck after the user attaches the tube from the cartridge to the receiving container, this is merely illustrative. In another embodiment, steps 138 and 140 may be performed after step 142 such that engagement of the needle with the vial puck occurs before the user attaches the tube from the cartridge to the receiving container.

Diluent is pumped at step 144 into the vial 18 through the cartridge 16 and a first needle in the proper dosage. If necessary, a second or third diluent may be added to the vial 18 via a second or third diluent manifold attached to the cartridge 16. Simultaneously, vapor waste is pumped 144 out of the vial 18, through a second needle, through the cartridge 16 and the vapor waste manifold, and into the vapor waste bag 44. The valve actuators 84 on the pump head assembly 28 open and close the valves of the cartridge 16 in order to change the fluid flow paths as necessary during the process. Once the diluent is pumped into the vial 18, the pump drive mechanism 20 agitates the vial 18 in the next step 146 by rotating the vial lift 78 up to, for example 180 degrees such that the vial 18 is rotated between right-side-up and upside-down positions. The agitation process may be repeated for as long as necessary, depending on the type of pharmaceutical that is being reconstituted. Moreover, different agitation patterns may be used depending on the type of drugs being reconstituted. For example, for some drugs, rather than rotating by 180 degrees, a combination of forward-backward, and left-right motion of the pump head may be performed to generate a swirling agitation of the vial. A plurality of default agitation patterns for specific drugs or other medical fluids may be included in the drug library stored in (and/or accessible by) the compounder control circuitry. Once the agitation step is complete, the pump drive mechanism rotates the vial to an upside down position or other suitable position and holds it in place. In some embodiments, a fluid such as a diluent already in the receiving container 32 may be pumped (e.g., through the cartridge or via a separate path) into a liquid waste container to allow room in the receiving container for receiving the reconstituted medicine.

In the next step 148, the valve actuators 84 reorient the valves of the cartridge and the pumping mechanism of the cartridge 16 is activated to pump 150 the reconstituted drug into the receiving bag 32 through the attached tube. Once the drug is pumped into the receiving bag 32, in the next step 152 the pump drive mechanism 20 clears the tube 38 by either pumping filtered air or more diluent through the tube 38 into the receiving bag 32 after another valve adjustment to ensure that all of the reconstituted drug is provided to the receiving bag 32. In some scenarios, a syringe may be used as a receiving container 32. In scenarios in which a syringe is used as the receiving container 32, following delivery of the reconstituted drug to the syringe, a vacuum may be generated in tube 38 by pump drive mechanism 20 to remove any air or other vapors that may have been pushed into the syringe so that, when the syringe is removed from tube 38, the reconstituted drug is ready for delivery to a patient and no air or other unwanted gasses are present in the syringe.

The system then prompts 154 the user to remove the tube 38 from the receiving container 32. The user may then insert the connector (e.g., a Texium® or SmartSite® connector) into its slot in the backpack or carousel and an optical sensor in the pump head may sense the presence of the connector and automatically retract the tube into either the carousel or the backpack. The tube is pulled back into either the carousel 14 or the backpack, depending on which type of system is in use. In the next step 156, the compounder 10 rotates the vial 18 back into alignment with the star wheel 22 and releases it. The used cartridge 16 may also be replaced on the carousel 14. The used cartridge may be released when a sensor in the pump drive determines that the tube has been replaced in the cartridge (e.g., by sensing the presence of a connector such as a Texium® connector at the end of the tube in the backpack of the cartridge through a window of the cartridge). The carousel 14 and/or star wheel 22 then may rotate 158 to a new unused cartridge 16 and/or a new unused vial 18 and the process may be replicated for a new drug. In some circumstances (e.g., multiple reconstitutions of the same drug), a single cartridge may be used more than once with more than one vial.

The cartridges 16 are designed to be disposable, allowing a user to utilize all the cartridges 16 in a given carousel 14 before replacing the carousel 14. After a cartridge 16 is used, the carousel 14 rotates to the next cartridge 16 and the system software updates to note that the cartridge 16 has been used, thus preventing cross-contamination from other reconstituted drugs. Each cartridge 16 is designed to contain all the necessary flow paths, valves, filters and pumps to reconstitute a drug with multiple diluents if necessary, pump the reconstituted drug into the receiving container, pump vapor waste out of the system into a waste container, and perform a final QS step in order to make sure that the proper amount of drug and diluent is present in the receiving container. This complete package is made possible by the specific and unique construction of the cartridge 16, its flow paths, and its valve construction.

Figure 22:
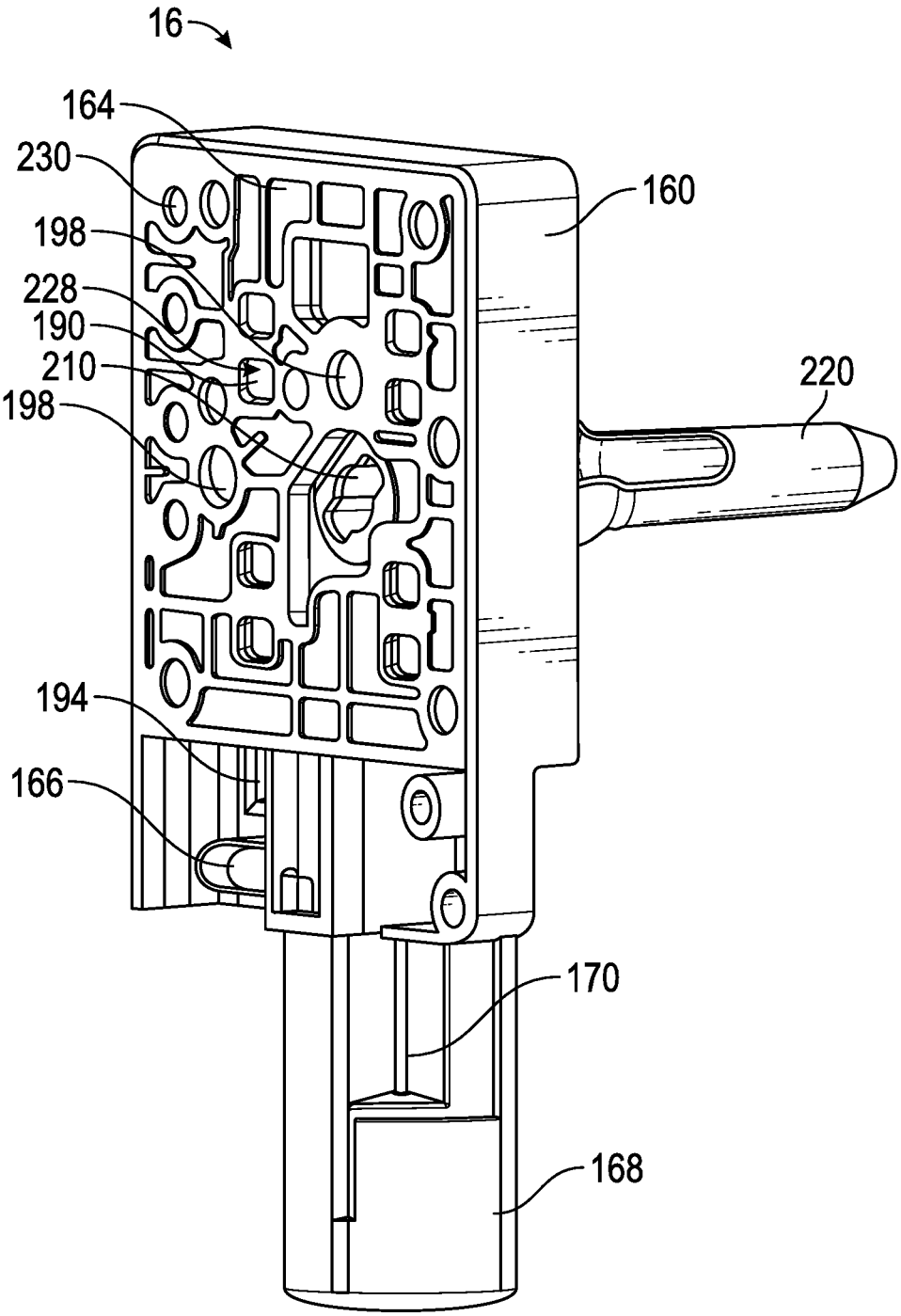
FIG. 22 illustrates a perspective view of an exemplary embodiment of a cartridge in accordance with aspects of the present disclosure.

An embodiment of a cartridge 16 is illustrated in FIG. 22. As shown in FIG. 22, cartridge 16 may include a cartridge frame 160, a cartridge bezel 164, as well as a piston pump 166, a needle housing 168 and a needle assembly 170. The cartridge frame 160 provides the main support for each cartridge 16 and includes diluent chambers, a vapor waste chamber, a pumping chamber, a hydrophobic vent, an exit port, and/or other features as described hereinafter that can be connected to a tube that connects to the receiving container 32.

The frame 160 of the cartridge 16 also includes locating features that allow each cartridge 16 to be removably mounted to the pump head assembly 28. These features include, for example, three openings 198 to receive mounting posts 130 from the pump head assembly 28, and a keyhole 210 that allows a locking bayonet 128 to be inserted therein and turned to lock the cartridge 16 to the pump head assembly 28 for removal from the carousel 14. An outlet port extension 220 may be present in some embodiments. The piston pump 166 is mounted within a chamber with a rod 194 positioned within a silicone piston boot. Furthermore, the bezel 164 includes openings 228 in which the valves 190 of the sealing membrane are located and be accessed by the valve actuators 84. Moreover, the bezel 164 includes openings 230 that allow a fluid manifold to be connected to the diluent and vapor waste chambers in the cartridge 16. As discussed in further detail hereinafter, bezel 164 may also include an opening that facilitates the detection of a connector (e.g., a. Texium® or SmartSite® connector) when the user inserts the connector into the provided slot when compounding is complete. In operation, the needles of the fluid manifold enter through the openings 230 in the bezel 164 and pierce the sealing membrane to gain fluidic access to the diluent and vapor waste chambers defined in the cartridge 16 between the sealing membrane and the cartridge frame 160. Further details of various embodiments of the cartridge 16 will be discussed hereinafter.

Figure 23:
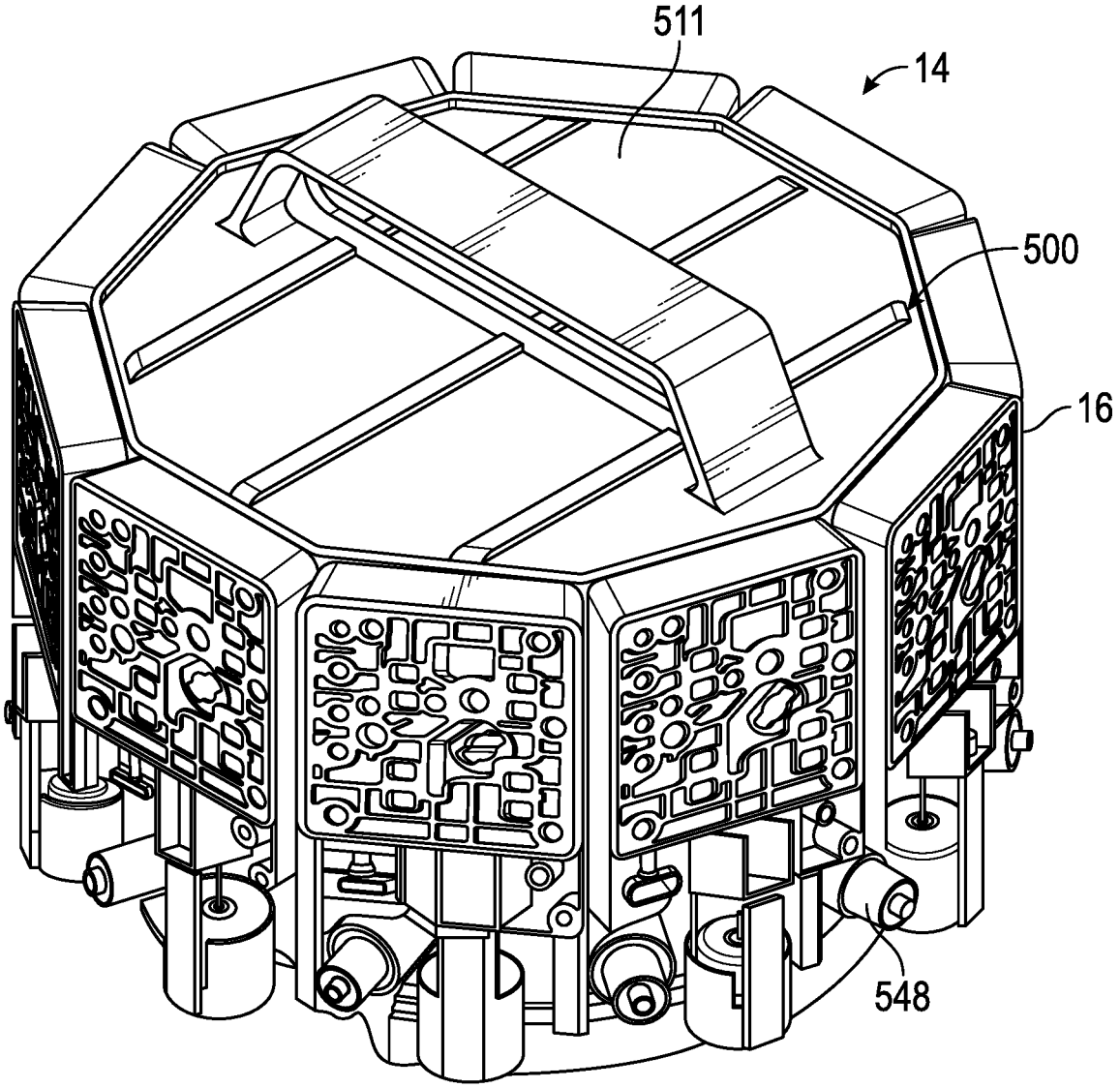
FIG. 23 illustrates a perspective view of an exemplary embodiment of a carousel with a cover in accordance with aspects of the present disclosure.

Referring to FIG. 23, an exemplary embodiment of a carousel 14 removed from the compounder 10 is illustrated, according to an embodiment. The carousel 14 of FIG. 23 includes an array of ten cartridges 16 in this embodiment, but it should be understood that more or fewer cartridges 16 can be present on the carousel 14, leaving some of the carousel 14 pockets 500 empty, or the frame 510 of the carousel can be designed to have more or fewer cartridge pockets 500. In some implementations, the carousel 14 may also, optionally, include a cover 511 that prevents a user from accessing the tubes coupled to each of the cartridges 16 directly. In these implementations, the cover 511 may be removed if necessary to access the backs of the cartridges 16. In the example implementation of FIG. 23, a connector such as a Texium® attachment 548 is disposed adjacent each cartridge 16, the attachment 548 being attached to the tube 38 that runs from the extension 220 on each cartridge 16.

Figure 24:
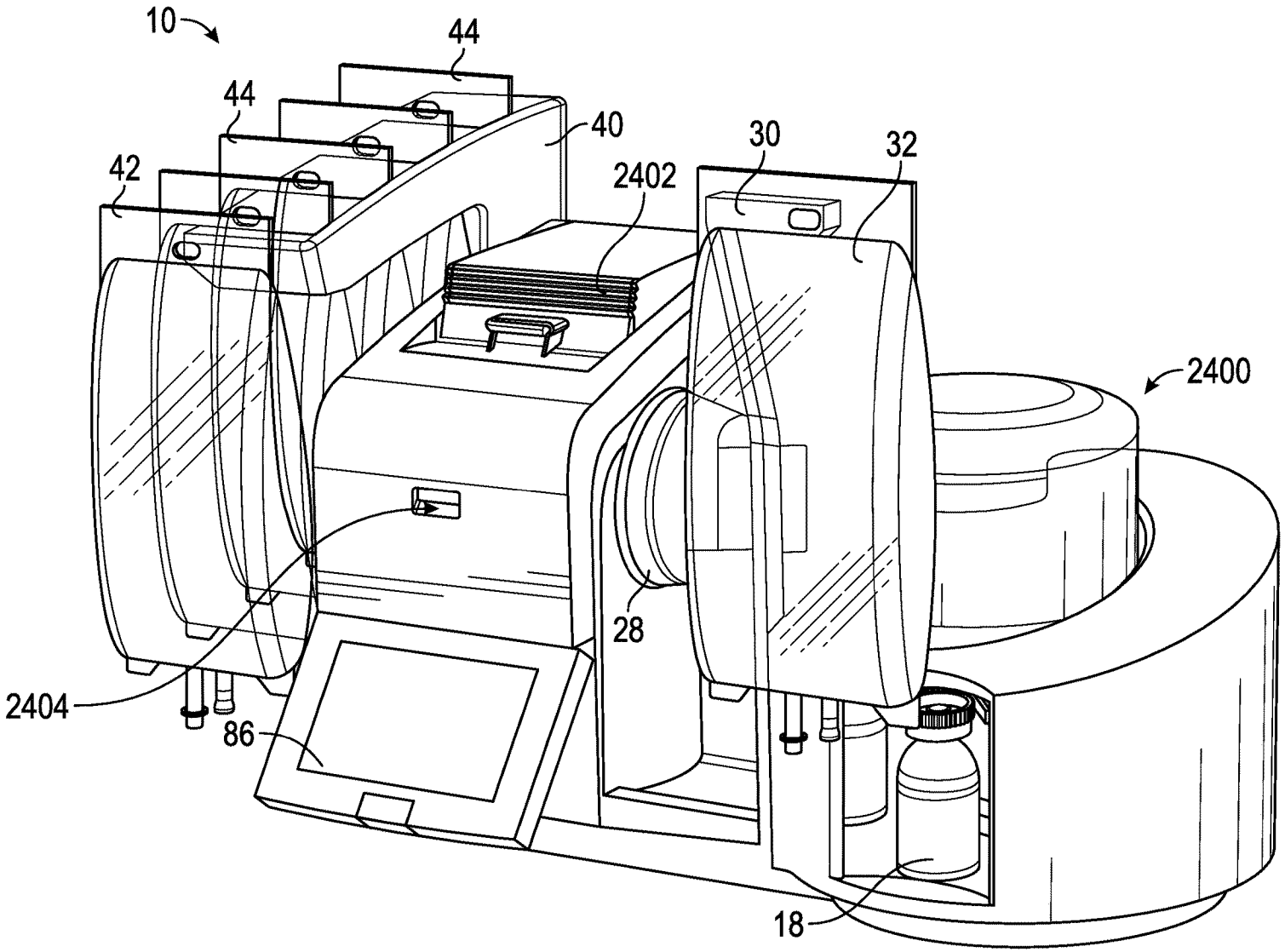
FIG. 24 illustrates a front perspective view of another exemplary embodiment of a compounding system in accordance with aspects of the present disclosure.

FIGS. 24-29 show the compounder 10 according to another embodiment. As shown in FIG. 24, holding apparatus 40 may be implemented as an extended arm providing support for mounting devices for each of containers 42 and 44. Holding apparatus 40 and holding apparatus 30 may each include one or more sensors such as weight sensors configured to provide weight measurements for determining whether an appropriate amount of fluid has been added to or removed from a container or to confirm that fluid is being transferred to and/or from the appropriate container (e.g., that the appropriate diluent is being dispensed). A scanner 2404 may be provided with which each diluent container and/or the receiving container can be scanned before and/or after attachment to compounder 10. As shown in FIG. 24, a carousel cover 2400 and tube management structures 2402 may also be provided on compounder 10 in various embodiments. For example, tubes connected between containers 42 and/or 44 and corresponding manifolds can each be mounted in a groove of tube management structure 2402 to prevent tangling or catching of the tubes during operation of compounder 10.

Figure 25:
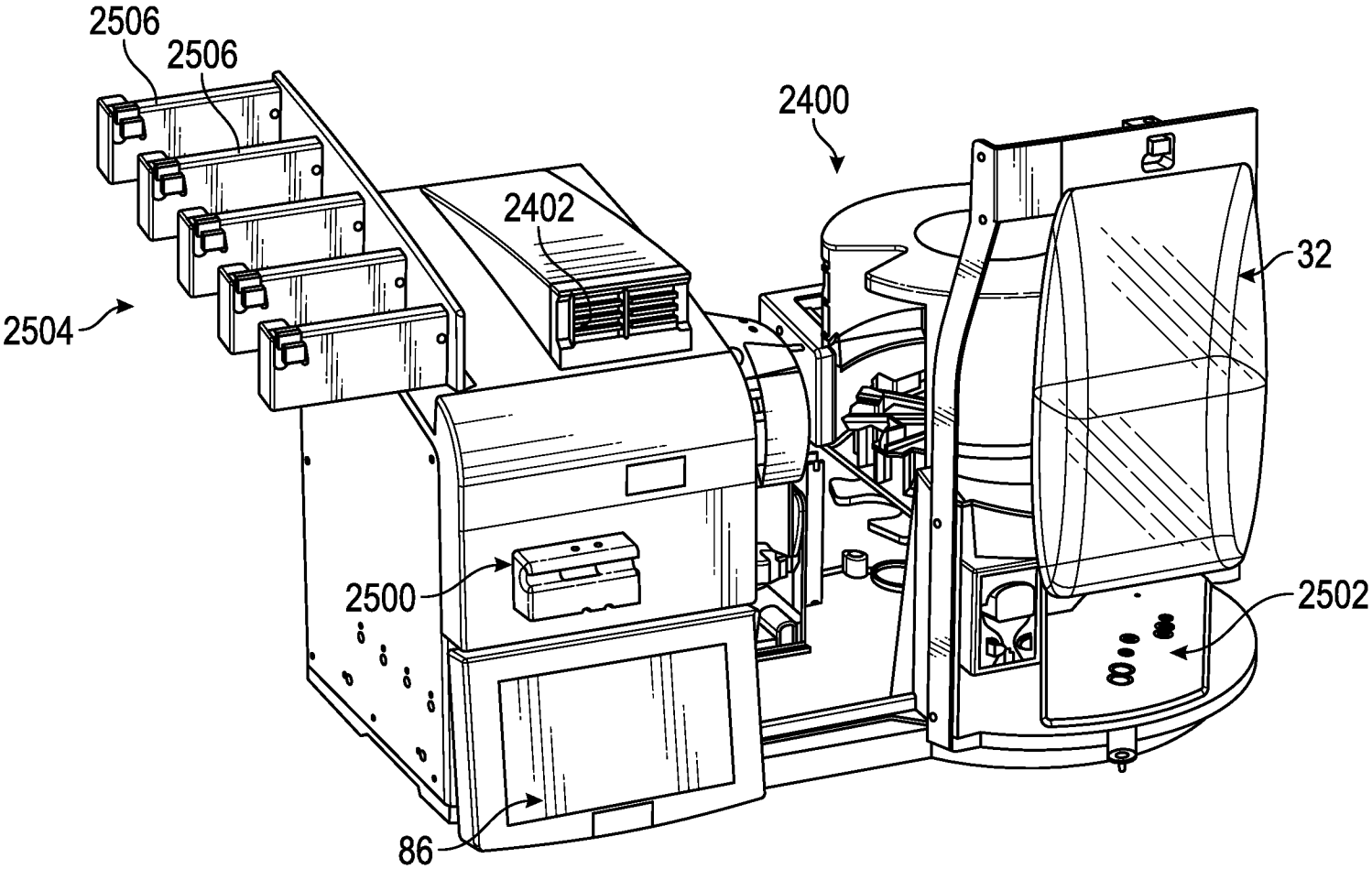
FIG. 25 illustrates another front perspective view of the compounding system of FIG. 24 in accordance with aspects of the present disclosure.

As shown in FIG. 25, an opening 2502 may be provided by which vials 18 can be installed in the star wheel. Additionally, an exterior pump 2500 may be provided for pumping non-toxic liquid waste from, for example, receiving container 32 to a waste container 44 (e.g., for pumping a desired amount of saline out of receiving container 32 quickly and without passing the liquid waste through a cartridge and/or other portions of the compounder).

A fluidics module 2504 may be provided that includes several container mounts 2506. Container mounts 2506 may be used for hanging diluent and waste containers and may include sensor circuitry for sensing when a container has been hung and/or sensing the weight of the container. In this way, the operation of compounder 10 can be monitored to ensure that the correct diluent contain has been scanned and hung in the correct location and that the waste is being provided in an expected amount to the appropriate waste container.

Figure 26:
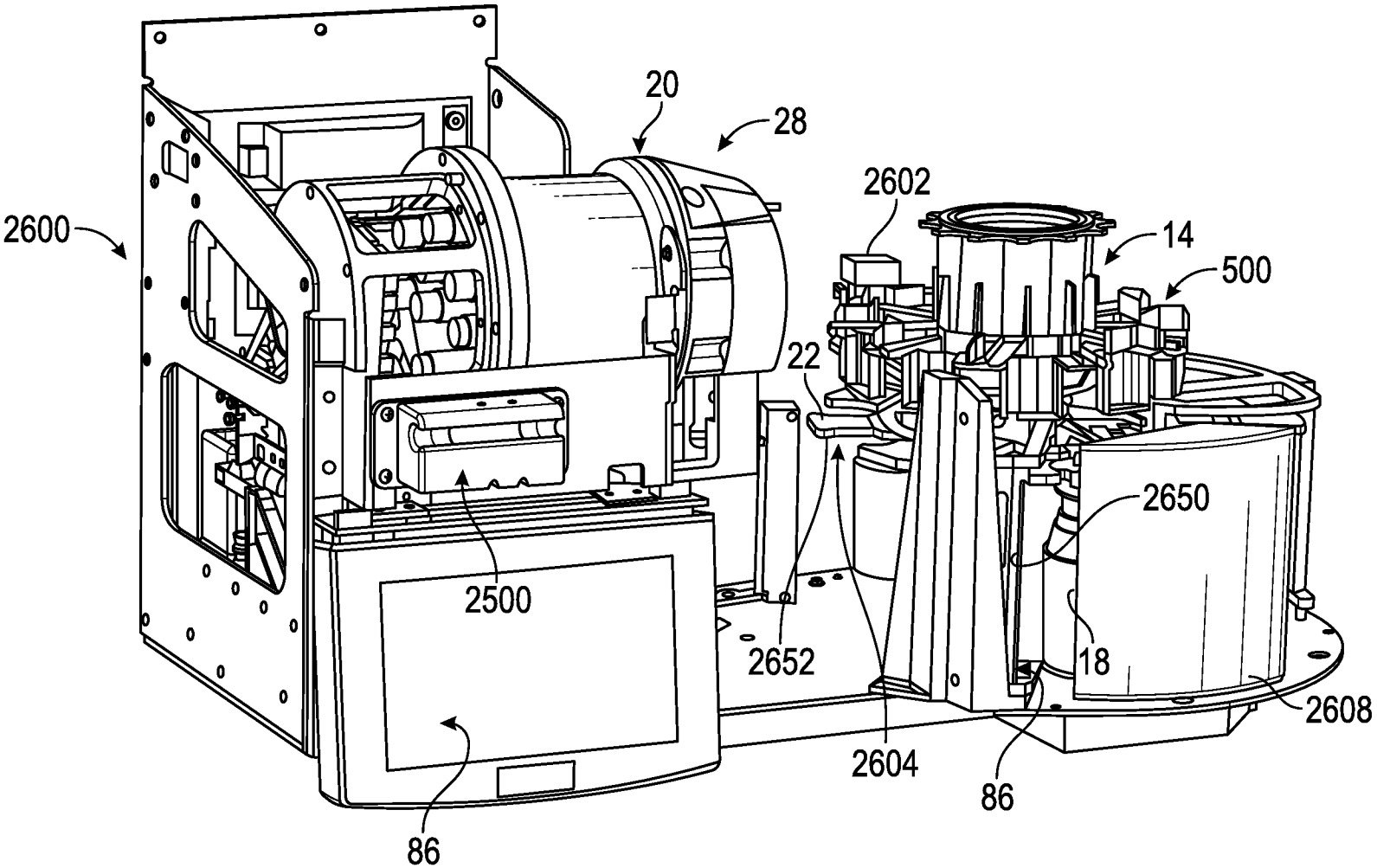
FIG. 26 illustrates a front perspective view of the compounding system of FIG. 24 with portions of the housing removed in accordance with aspects of the present disclosure.

As shown in FIG. 26, pump 2500 and display 86 may be mounted to a chassis 2600. Pump drive 20 may be mounted partially within the chassis 2600 with pump head assembly 28 extending from the chassis to a position which allows the pump head assembly to rotate (e.g., to turn over or agitate a vial). Carousel 14 is also shown in FIG. 26 without any cartridges mounted therein so that cartridge mounting recesses 500 can be seen.

Star wheel 22 (sometimes referred to herein as a vial tray) is shown in FIG. 26 with several empty vial puck recesses 2604. Vial tray 22 may be rotated and an actuating door 2608 may be opened to facilitate loading of vials 18 into the vial puck recesses 2604 in vial tray 22. In some embodiments, door 2608 may be closed before rotation of vial tray 22 to ensure that the operator's fingers are not in danger of injury from the rotating tray. However, this is merely illustrative. In other embodiments a sensor such as sensor 2650 (e.g., a light curtain) may be provided instead of (or in addition to) door 2608 to sense the presence of an operator in the vicinity of tray 22 and prevent rotation of the tray if the operator or any other obstruction is detected.

Similarly, a lid may be provided for carousel 14 to prevent contamination of cartridges 16 loaded therein, and to prevent injury to an operator due to rotation of the carousel. A lid sensor (not shown) may also be provided to detect the position (e.g., an open position or a closed position) of the lid. Rotation of carousel 14 may be prevented if the lid is not detected in a closed position by the lid sensor.

Each vial 18 that is inserted may be detected using a sensor such as sensor 2652 (e.g., a load sensor or an optical sensor) when placed in a vial puck recess 2604. When detected, the inserted vial may be moved to a scanning position by rotating vial tray 22 and then the inserted vial 18 may be rotated within its position in vial tray 22 using a vial rotation motor 2602 to allow the vial label to be scanned.

Figure 27:
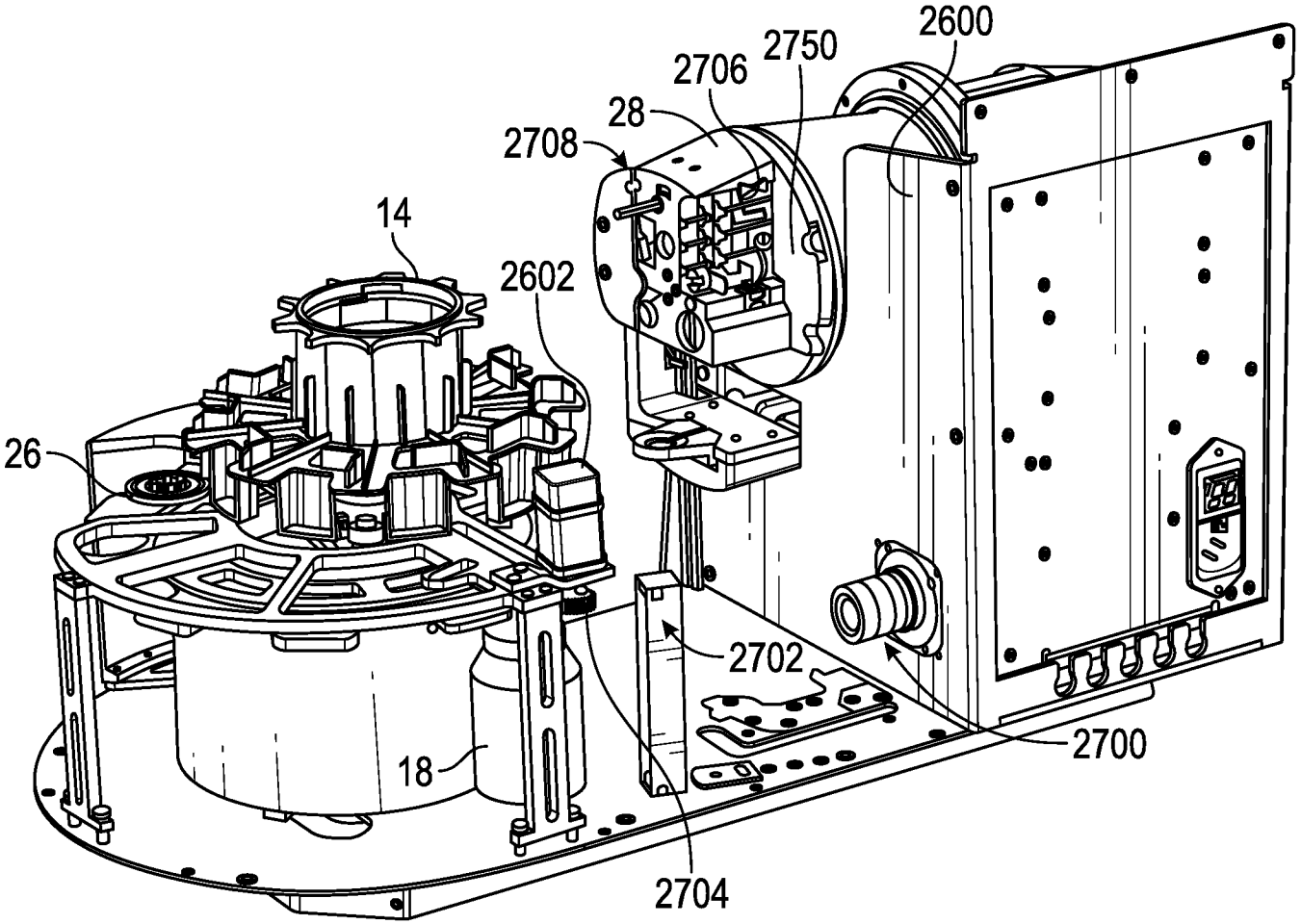
FIG. 27 illustrates a rear perspective view of the compounding system of FIG. 24 with portions of the housing removed in accordance with aspects of the present disclosure.

A reverse perspective view of compounder 10 is shown in FIG. 27 in which scanning components can be seen. In particular, a camera 2700 is mounted in an opening in chassis 2600 and configured to view a vial 18 in a scanning position. Motor 2602 may rotate vial 18 through one or more full rotations so that camera 2700 can capture images of the vial label. In some embodiments, an illumination device 2702 (e.g., a light-emitting diode or other light source) may be provided that illuminates vial 18 for imaging with camera 2700.

As shown in FIG. 27 one or more gears 2704 coupled to motor 2602 may be provided that engage corresponding gears on a vial puck 26 to which a vial 18 is attached at the scanning position. The vial tray 22 may be rotated so that the vial puck gears engage the rotation motor gears so that when the motor 2602 is operated the vial 18 is rotated.

FIG. 27 also shows how a magazine 2706 containing one or more manifolds may be mounted in a recess in pump head assembly 28. A magazine slot in magazine 2706 for the vapor waste manifold may be keyed to prevent accidental connection of a diluent manifold in that slot (or a waste manifold in a diluent slot in the magazine). Other diluent slots in magazine 2706 may have a common geometry and thus any diluent manifold can fit in the magazine diluent slots. One or more manifold sensors such as manifold sensor 2750 (e.g., an optical sensor) may be provided in the manifold recess in pump head assembly 28. Manifold sensor 2750 may be configured to detect the presence (or absence)

of a manifold in a manifold recess (slot) in magazine 2706 to ensure that an appropriate manifold (e.g., a diluent manifold or waste manifold) is loaded at the expected position for compounding operations. In this way, the pump head may detect a manifold presence. The pump head and/or manifold sensors may communicate with the diluent load sensors to ensure proper positioning of the diluent manifolds. Various operational components 2708 such as valve actuators, needle actuators, mounting posts, a locking bayonet, and a drive pin can also be seen extended from pump head assembly 28 which are configured to secure and operate a pump cartridge 16.

Figure 28:
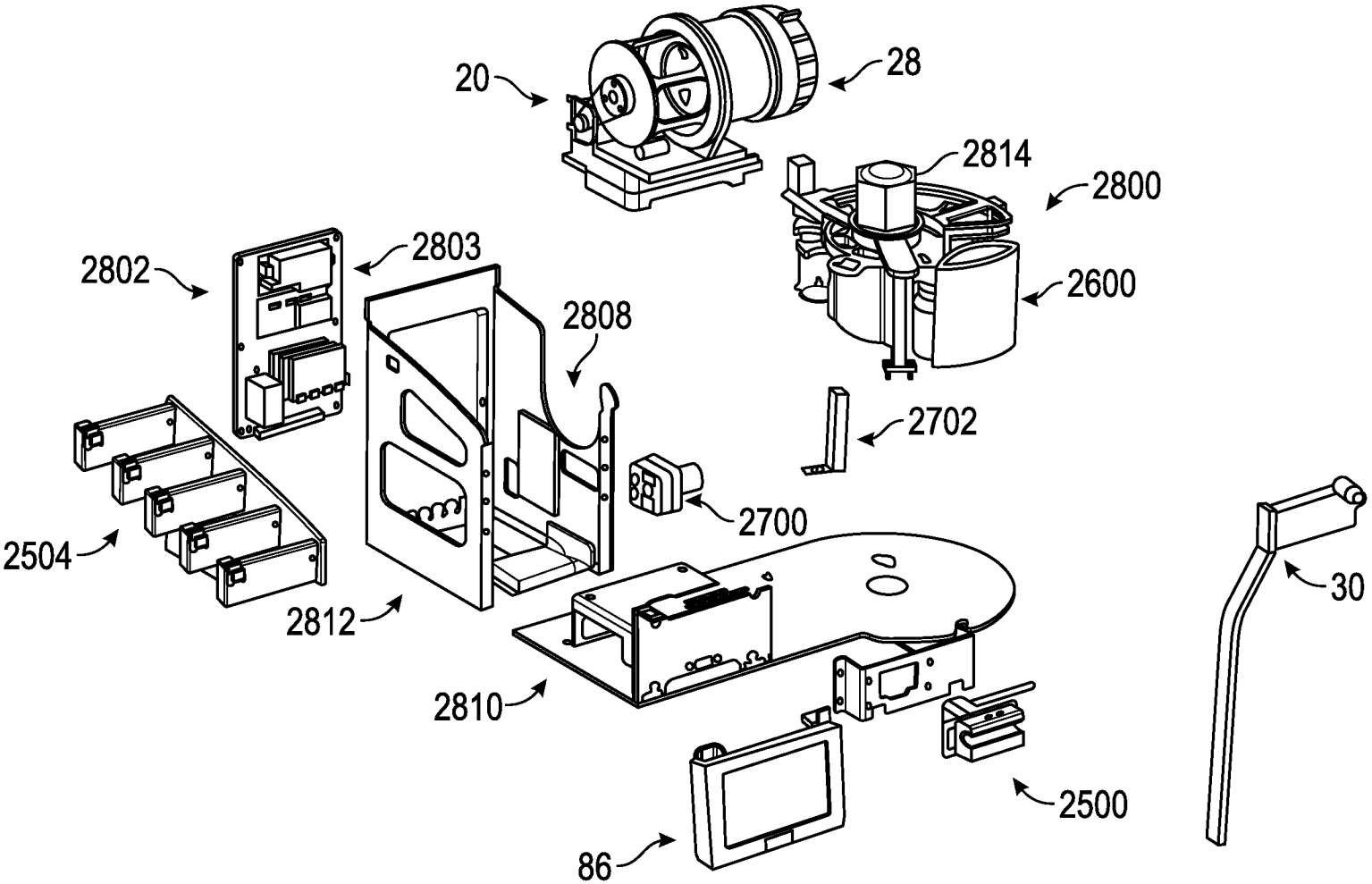
FIG. 28 illustrates an exploded perspective view of the compounding system of FIG. 24 in accordance with aspects of the present disclosure.

An exploded view of various components of compounder 10 is shown in FIG. 28. Components discussed above such as display 86, pump 2500, dose hanger 30, fluidics module 2504, pump drive 20 with pump head assembly 28, camera 2700, and lighting device 2702 are shown. Additional components such as a chassis base 2810 and chassis housing 2812 of chassis 2600 are also shown in FIG. 28. A rear panel 2802 having an electronics assembly 2803 can be mounted to chassis housing 12 and pump drive 20 may be seated in an opening 2808 in chassis housing 2812 that allows pump head assembly 28 to protrude from chassis housing 2812. Processing circuitry for managing operations of compounder system 10 may be included in electronics assembly 2803.

A vial tray and carousel drive assembly 2800 is also shown in which actuating door 2608 and a carousel hub 2814 can be seen. Carousel 14 may be placed onto carousel hub and rotated by vial tray and carousel drive assembly 2800 operating to rotate hub 2814 to move a selected cartridge in the carousel into position to be retrieved and operated by pump drive 20. Vial tray and carousel drive assembly 2800 may include separate drive assemblies for the vial tray and for the carousel such that vial tray 22 and carousel 14 may be rotated independently.

Figure 29:
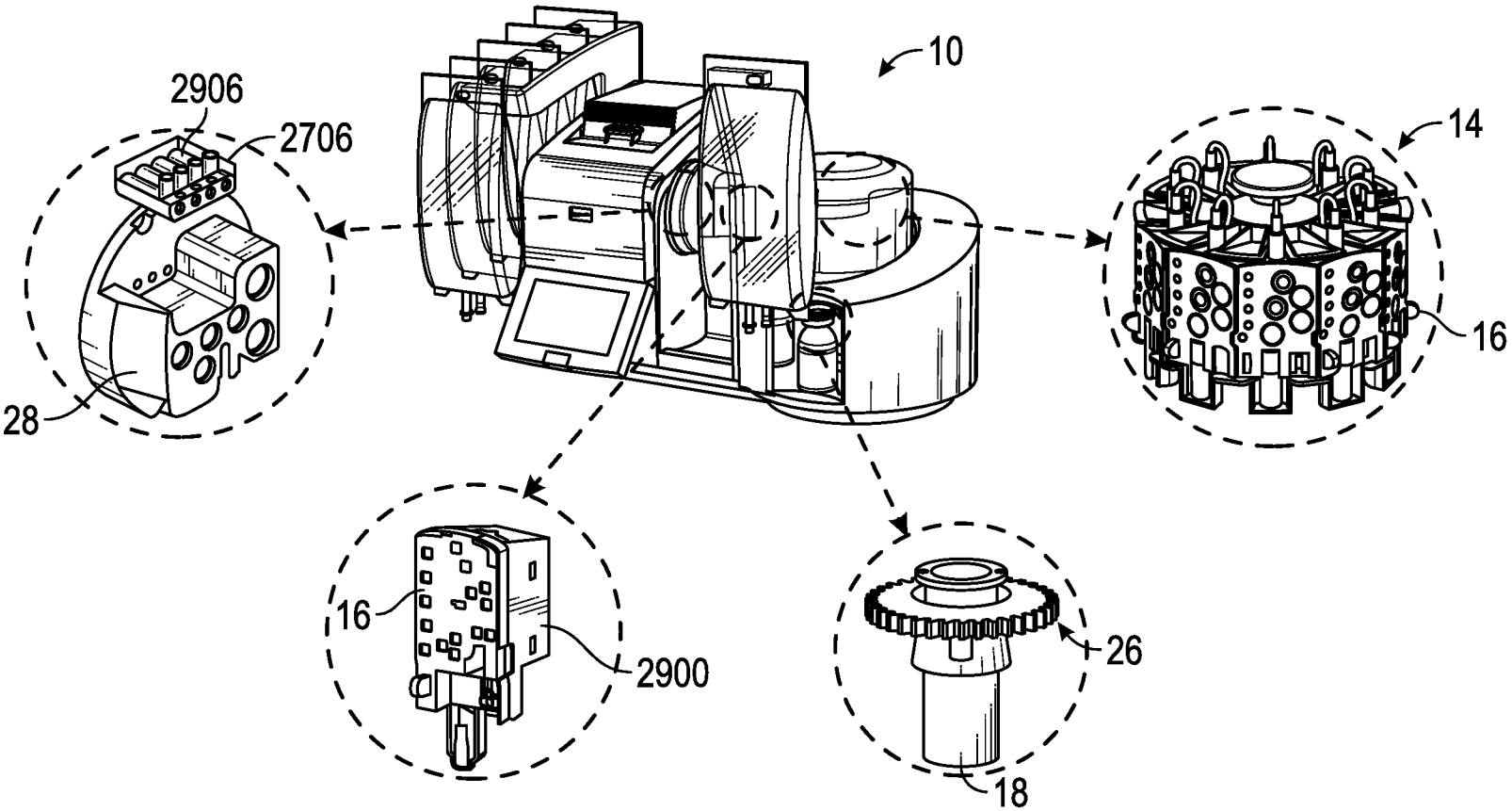
FIG. 29 illustrates a perspective view of the compounding system of FIG. 24 with various components shown in enlarged views for clarity in accordance with aspects of the present disclosure.

FIG. 29 shows another perspective view of compounder 10 highlighting the locations of various particular components such as the carousel 14 with cartridges 16 mounted therein, a cartridge 16 having a backpack 2900, a vial puck 26 for mounting vials 18, and pump head assembly 28 with a diluent magazine 2706 containing a plurality of manifolds 2906 in accordance with an embodiment. Further features of the pump cartridge 16 will be described hereinafter in connection with FIGS. 30-95 in accordance with various embodiments.

The cartridges 16 are designed to be disposable, allowing a user to utilize all the cartridges 16 in a given carousel 14 before replacing the carousel 14. After a cartridge 16 is used, the carousel 14 rotates to the next cartridge 16, and the system software updates to note that the cartridge 16 has been used, thus preventing cross-contamination from other reconstituted drugs. Each cartridge 16 is designed to contain all the necessary flow paths, valves, filters, pistons, and pumps to reconstitute a drug with multiple diluents if necessary, pump the reconstituted drug into the receiving container, pump vapor waste out of the system into a waste container, and perform a final QS step in order to make sure that the proper amount of drug and diluent is present in the receiving container. The amount of diluent pumped into vials for reconstitution and the amount of medication pumped out of vials to the receiving container are controlled by the volumetric piston pump in the cartridge which can be compared against weights obtained by the gravimetric scales (e.g., one or more diluent load cells and a receiving container load cell) of the compounder for quality control. This complete package is made possible by the specific and unique construction of the cartridge 16, its flow paths, and its valve construction.

Figure 34:
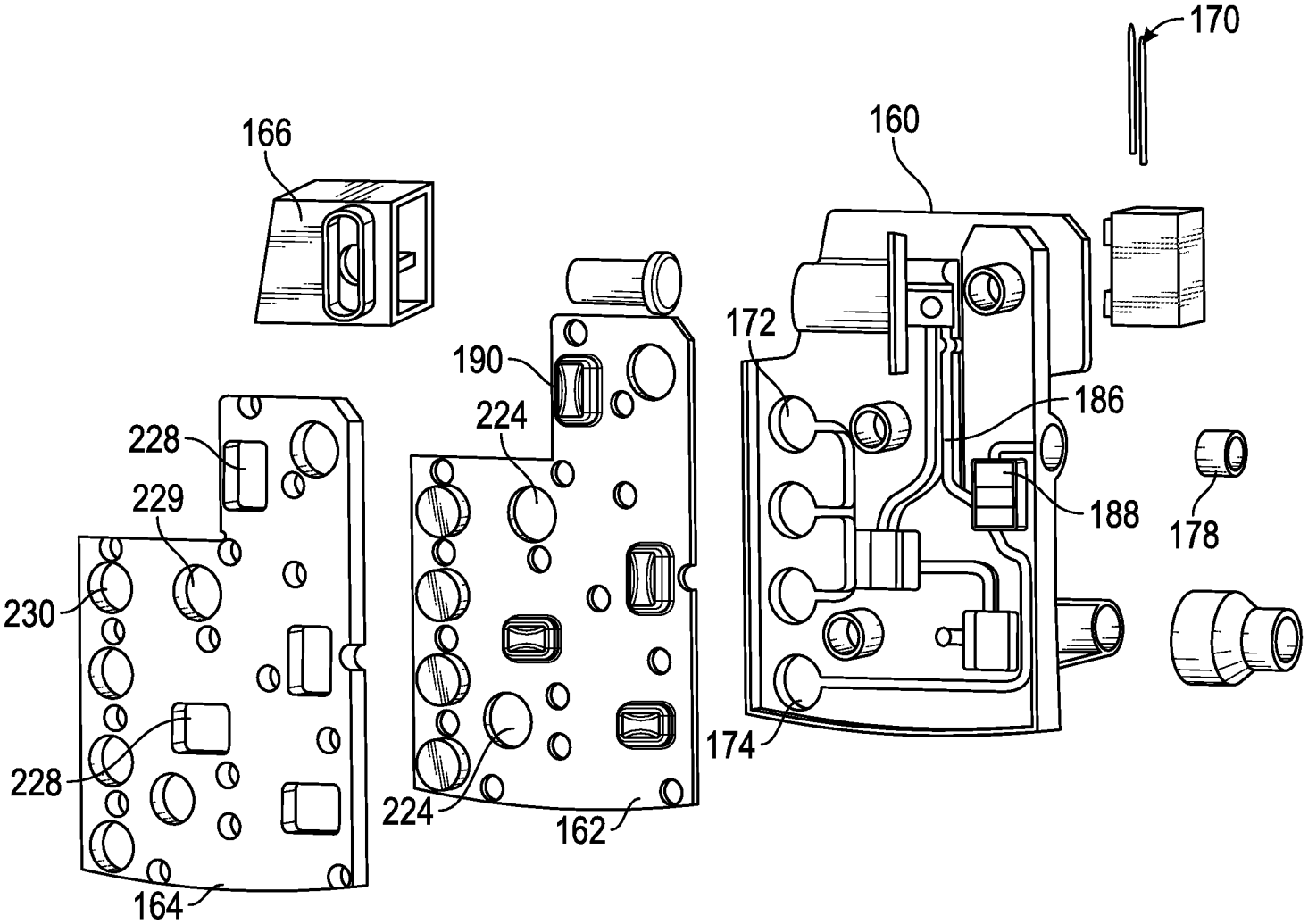
FIG. 34 illustrates an exploded view of the cartridge of FIG. 33A in accordance with aspects of the present disclosure.

The construction of an embodiment of a cartridge 16 is illustrated in FIGS. 30-34. A fully constructed cartridge 16 is shown in FIGS. 30-32, 33A and 33B. An exploded version of a cartridge 16 is illustrated in FIG. 34 and shows the three main portions of the cartridge 16: the cartridge frame 160, the cartridge sealing membrane 162, the cartridge bezel 164, as well as the piston pump 166, the needle housing 168 and the needle assembly 170 according to an embodiment.

Figure 35:
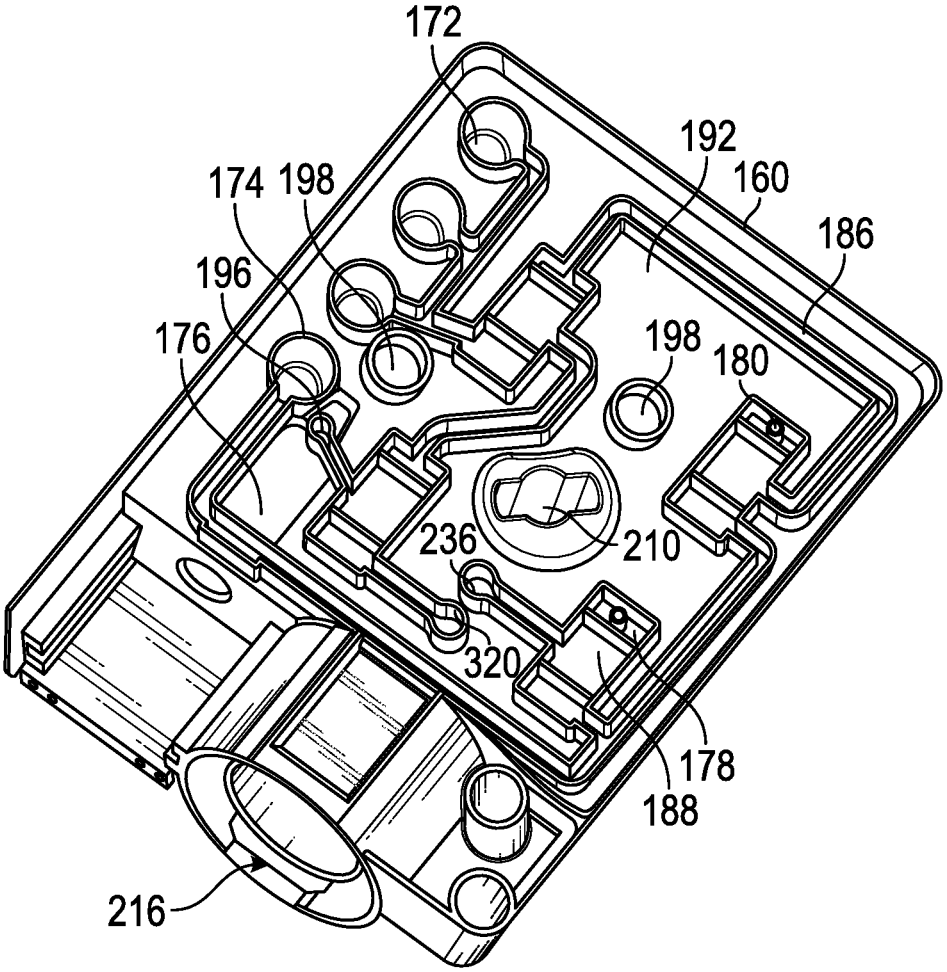
FIG. 35 illustrates a perspective view of an exemplary embodiment of a cartridge frame in accordance with aspects of the present disclosure.

Referring to FIG. 35, a front view of the cartridge frame 160 is illustrated. The cartridge frame 160 provides the main support for each cartridge 16 and includes diluent chambers 172, a vapor waste chamber 174, a pumping chamber 176, a hydrophobic vent 178, an exit port 180 that can be connected to a tube 38 that connects to the receiving container 32, a mount 182 for a piston boot 184, a piston pump 166 and a cartridge needle housing 168 to hold the needles 316, 318 that are used to move liquids and waste vapor to and from the vial 18 during reconstitution and filling of the receiving container 32, numerous flow paths 186 for diluents, vapor waste, filtered air, and reconstituted drugs, and chambers 188 in which valves 190 are positioned in order to modify the flow paths 186 when necessary.

FIG. 35 illustrates a cartridge frame 160 with the other portions of the cartridge 16 removed. In this embodiment, three chambers 172 are defined in the surface 192 of the frame 160, one for each type of diluent. Adjacent the three diluent chambers 172 is a vapor waste chamber 174 for connection to a vapor waste container 44. A chamber 176 is included for positioning a piston pump 166, as shown, for example, in FIGS. 22, 30-32 and 39. The piston pump 166 is mounted within this chamber 176 with a rod 194 positioned within an elastomeric (e.g., silicone) piston boot 184, which is shown in FIG. 34 before insertion into the pumping chamber 176. A pump chamber opening 196 allows fluidic access to the pump chamber 176.

The frame 160 of the cartridge 16 also includes locating features that allow each cartridge 16 to be removably mounted to the pump head assembly 28. These features include three openings 198 to receive mounting posts 130 from the pump head assembly 28, and a keyhole 210 that allows a locking bayonet 128 to be inserted therein and turned to lock the cartridge 16 to the pump head assembly 28 for removal from the carousel 14.

Figure 30:
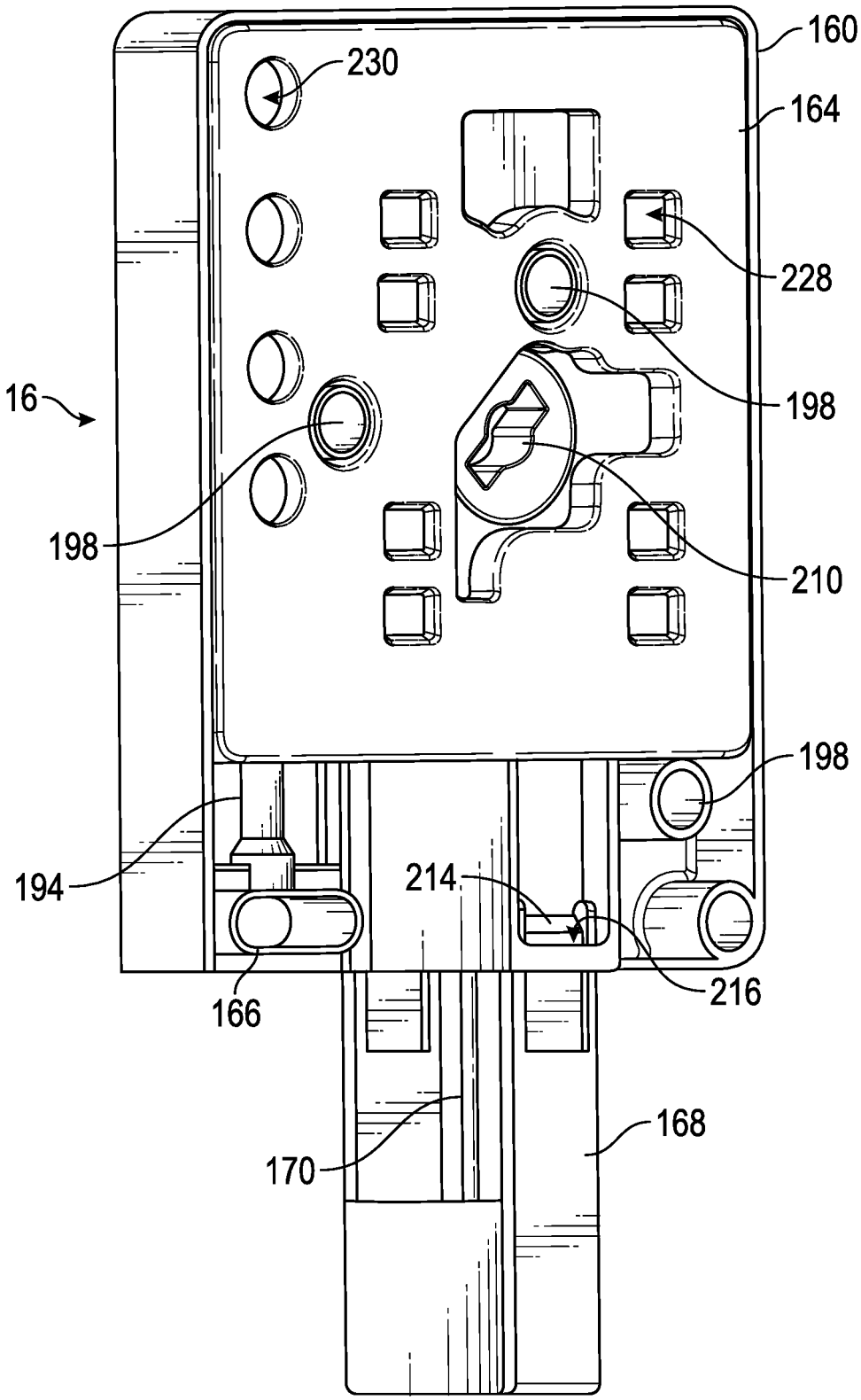
FIG. 30 illustrates a perspective view of the cartridge of FIG. 22 in accordance with aspects of the present disclosure.
Figure 31:
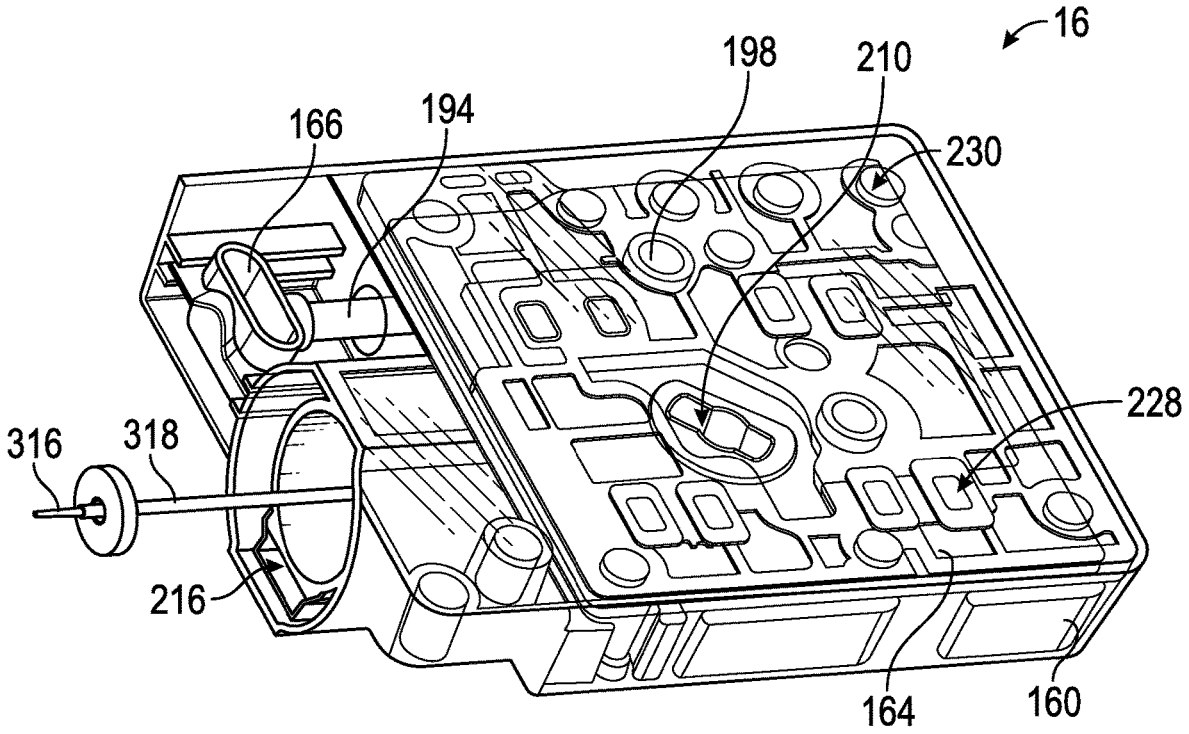
FIG. 31 illustrates a perspective view of the cartridge of FIG. 22 with a transparent bezel in accordance with aspects of the present disclosure.
Figure 32:
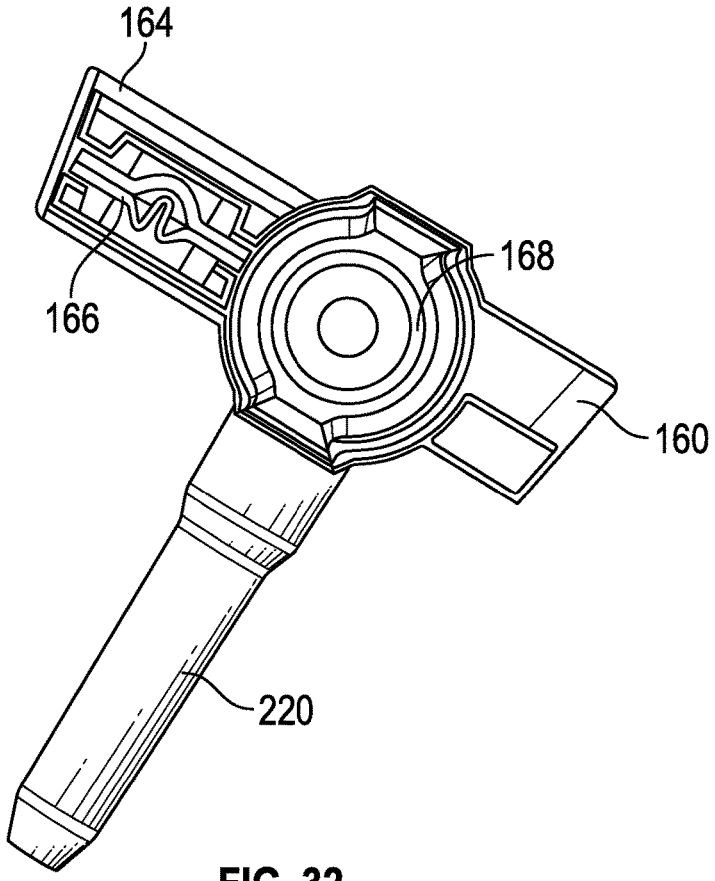
FIG. 32 illustrates a bottom plan view of the cartridge of FIG. 22 in accordance with aspects of the present disclosure.
Figure 33B:
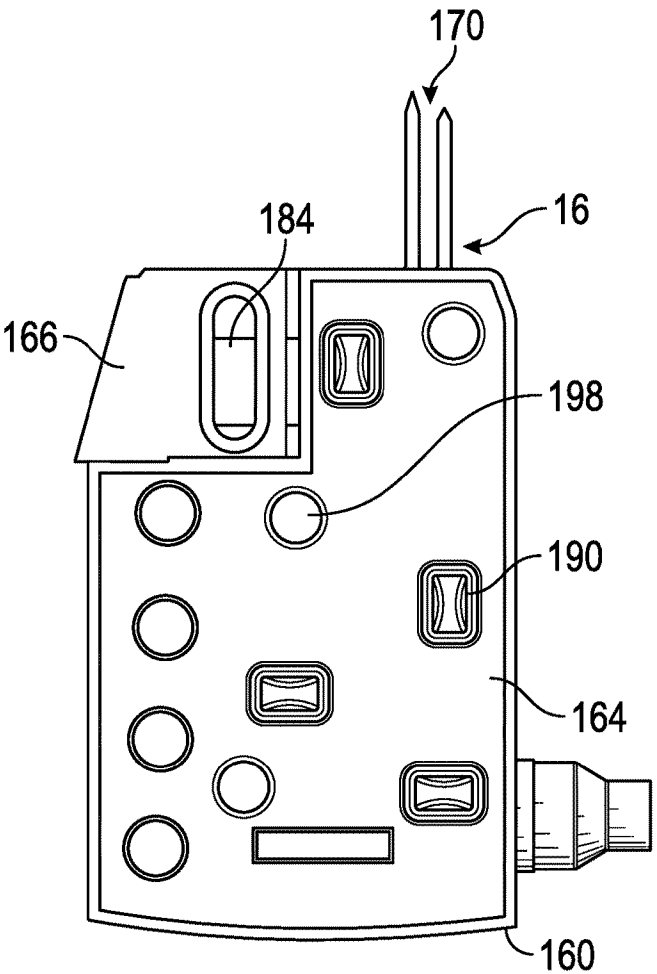
FIG. 33B illustrates a rear plan view of an exemplary embodiment of a cartridge with the bezel in place in accordance with aspects of the present disclosure.
Figure 33A:
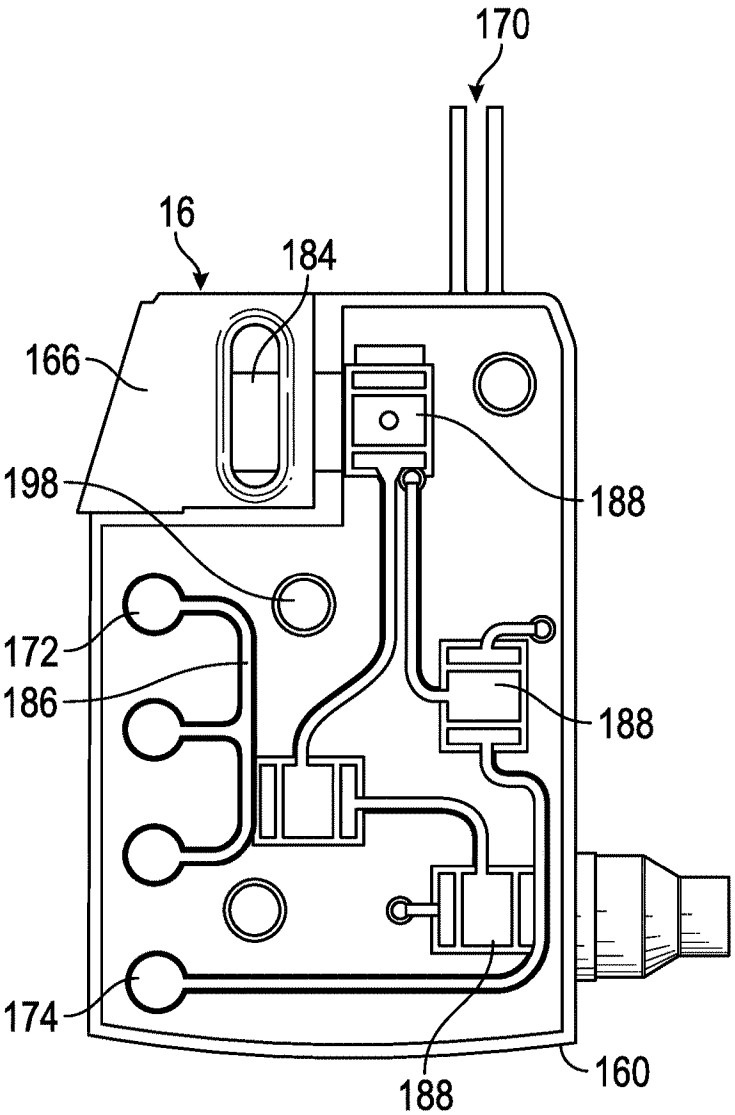
FIG. 33A illustrates a rear plan view of an exemplary embodiment of a cartridge with the bezel removed in accordance with aspects of the present disclosure.
Figure 37:
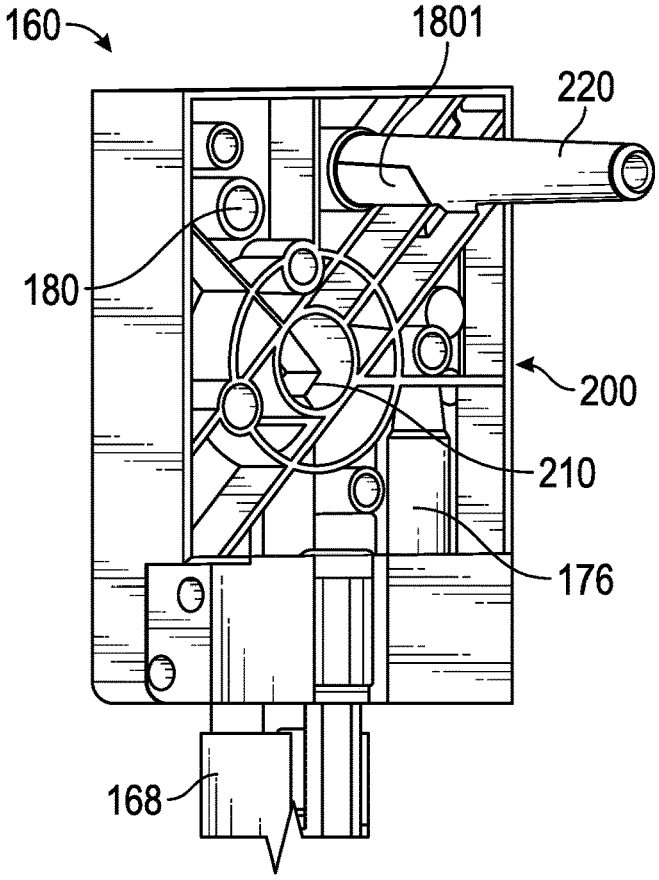
FIG. 37 illustrates a rear perspective view of the cartridge frame of FIG. 35 with an exemplary embodiment of a needle housing and an exemplary embodiment of an outlet port extension attached in accordance with aspects of the present disclosure.
Figure 38:
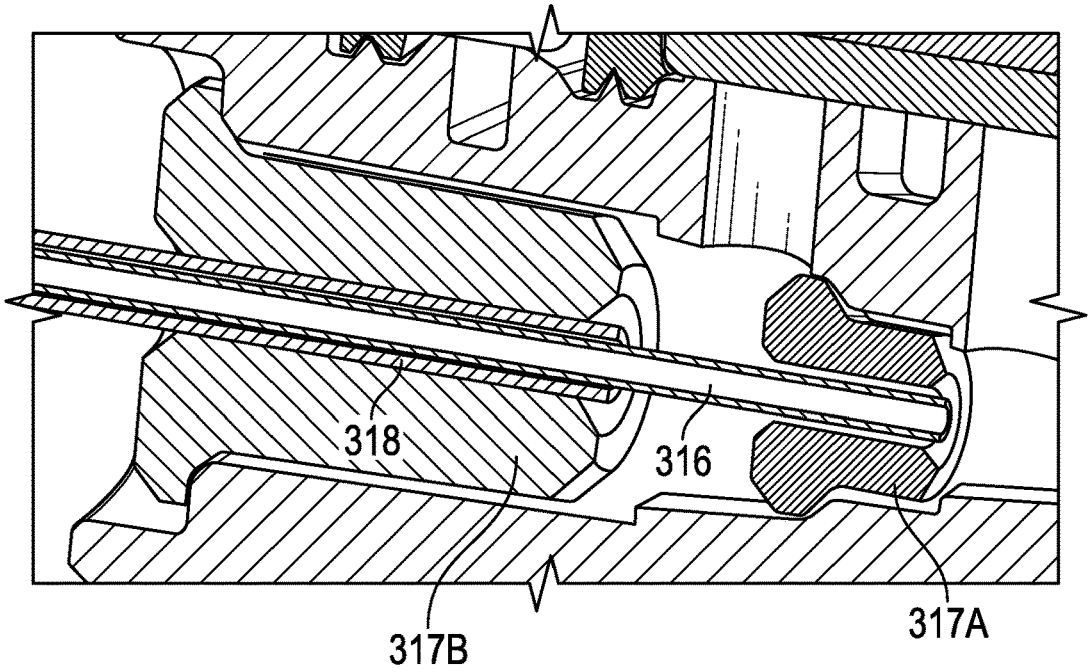
FIG. 38 illustrates a cross sectional view of an exemplary embodiment of a needle system in accordance with aspects of the present disclosure.

The cartridge needle housing 168 is shown in, for example, FIG. 37 and extends from the bottom 212 of the cartridge frame 160 and may be designed to be removable by snapping a pair of locking flanges 214 on the needle housing 168 into flange openings 216 in the cartridge frame 160 (see, e.g., FIG. 30). The cartridge needle housing 168 is designed to prevent accidental user contact with the needle assembly 170 and to maintain the sterility of the needles 316, 318. The needle housing 168 also receives the vial puck 26 in a position to allow the needles 316, 318 to pierce the vial puck 26. FIG. 38 illustrates a cross sectional view of a portion of cartridge 16 with the needles 316, 318 in place. A dual lumen needle is typically used. For example, a dual lumen needle may include a 22 gauge or 24 gauge (g) needle 316 positioned within a 18 gauge needle 318 in one embodiment. In various embodiments, the needle size can be any suitable size, as long as the vapor needle is sufficiently smaller than the liquid needle. In particular, the needle size may be determined based on the desired flow rate. In one particular implementation, the dual lumen needle may include a 18 g fluid needle and a 24 g vapor needle. However, in other implementations, a larger fluid needle (e.g., a 16 g or 17 g needle) may be used. This dual lumen design allows the needles 316, 318 of the cartridge 16 to add and remove diluent and reconstituted drug as well as remove vapor waste from the vial 18 as the vial 18 is filled with diluent during the reconstitution process. The needles 316, 318 are held in place in the needle housing with respective needle housing members 317A, 317B (e.g., overmolded needle housing members) and in operation, can be extended into the vial 18 by, for example, pressing the vial against the needle housing to compress a spring within the needle housing and allow the portion of the needle housing to be push up to expose needles 316, 318.

Figure 36:
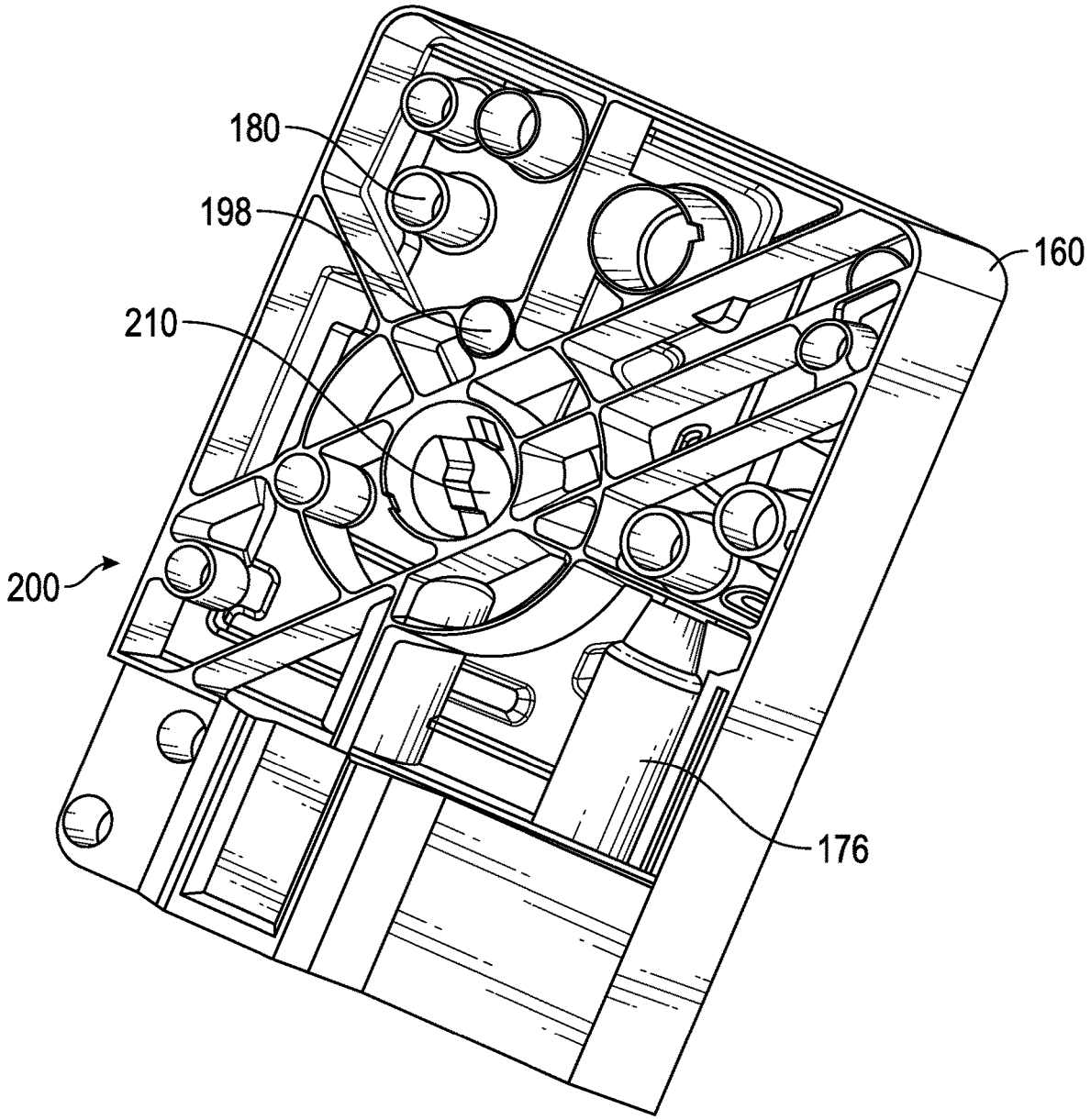
FIG. 36 illustrates a rear perspective view of the cartridge frame of FIG. 35 in accordance with aspects of the present disclosure.

The illustrated embodiment of the cartridge frame 160 in FIGS. 35-37 and 39 also includes eight valve chambers 188. These chambers 188, in combination with portions of sealing membrane 162 in spaced opposition to the chambers form valves 190, which will be discussed in detail later in the application. The valve chambers 188 in conjunction with the valves 190 allow opening and closing of various fluid flow paths 186 defined on the surface 192 of the cartridge frame 160. The frame 160 also includes a hydrophobic vent 178 for air intake. If desired, a filter can be present within this vent 178. The frame 160 includes an outlet port 180 (sometimes referred to herein as a receiving container port) for connection to a tube 38 that runs to a receiving bag 32. The outlet port 180 is also shown in FIGS. 36 and 37, which show the back 200 of the frame 160. FIG. 37 illustrates an extension 220 that may be provided in some embodiments. Extension 220 may be provided as a tube management structure and may include an opening 1801 through which a tube a tube from outlet port 180) can be fed to prevent tangling or other interference between tubes of various cartridges.

Figure 39:
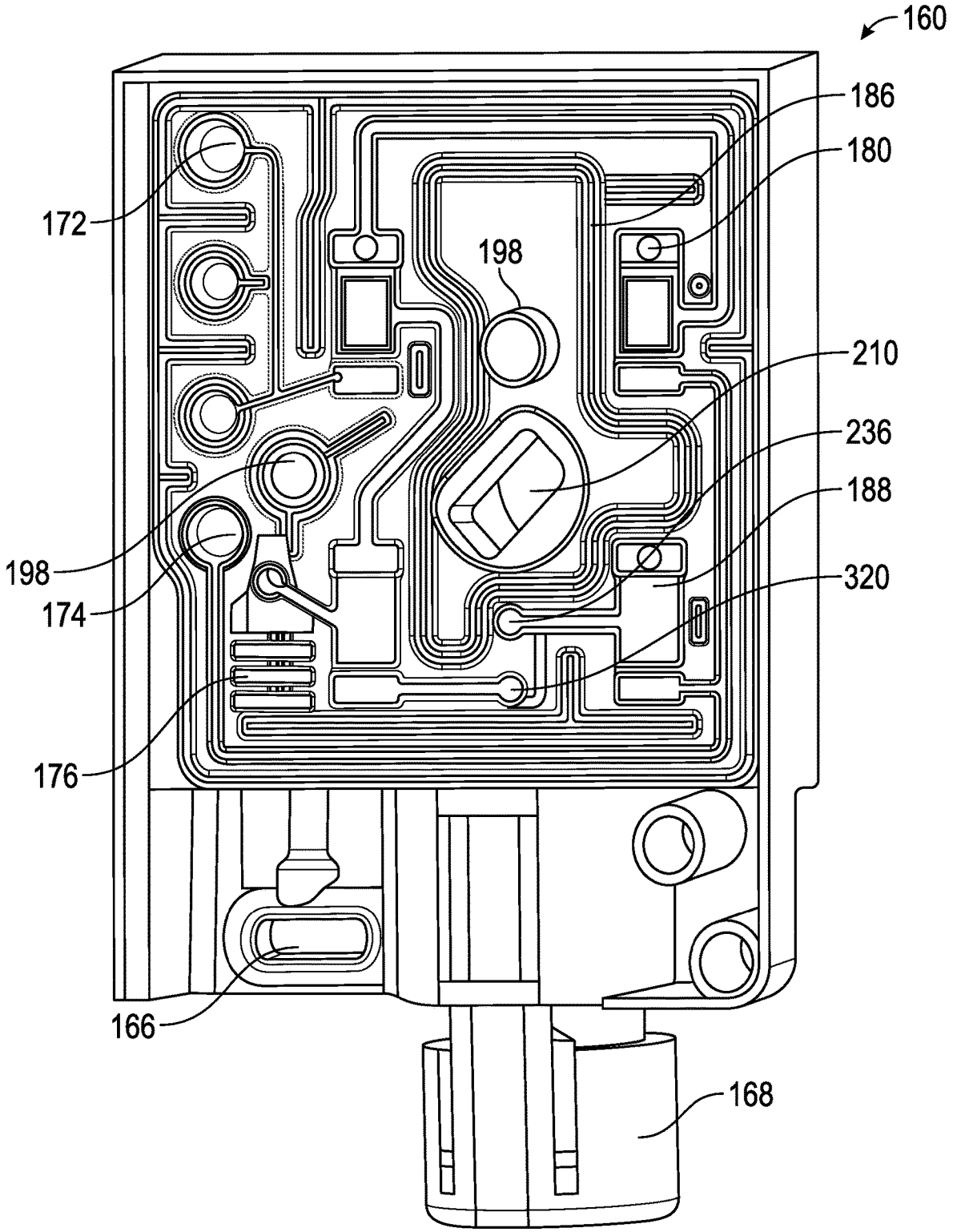
FIG. 39 illustrates a rear perspective view of the cartridge frame of FIG. 35 with an exemplary embodiment of a needle housing and an exemplary embodiment of a piston pump attached in accordance with aspects of the present disclosure.

FIG. 39 illustrates the piston pump 166 positioned in the frame 160. The piston pump 166 is utilized in conjunction with the adjustable flow paths 186 in the cartridge 16 to move diluent, vapor waste to and from the vial 18 and the receiving bag 32, and air through the fluid pathways 186 during the reconstitution process. When the cartridge 16 is removed from the carousel 14 and locked to the pump head assembly 28 through the operation of the mounting posts 130 and locking bayonet 128, the piston pump 166 may be driven by a motor that rotates an eccentric drive shaft 82 as with a drive pin 222 shown in FIGS. 13 and 14. The drive pin 222 is parallel but offset from the rotational axis of the drive shaft, which creates a sinusoidal motion and drives the piston pump 166 in an up and down motion to perform its pumping operations. The operation of the piston pump 166 and the valving system in the cartridge 16 will be explained in detail below after the description of the other elements of the cartridge 16.

Figure 40:
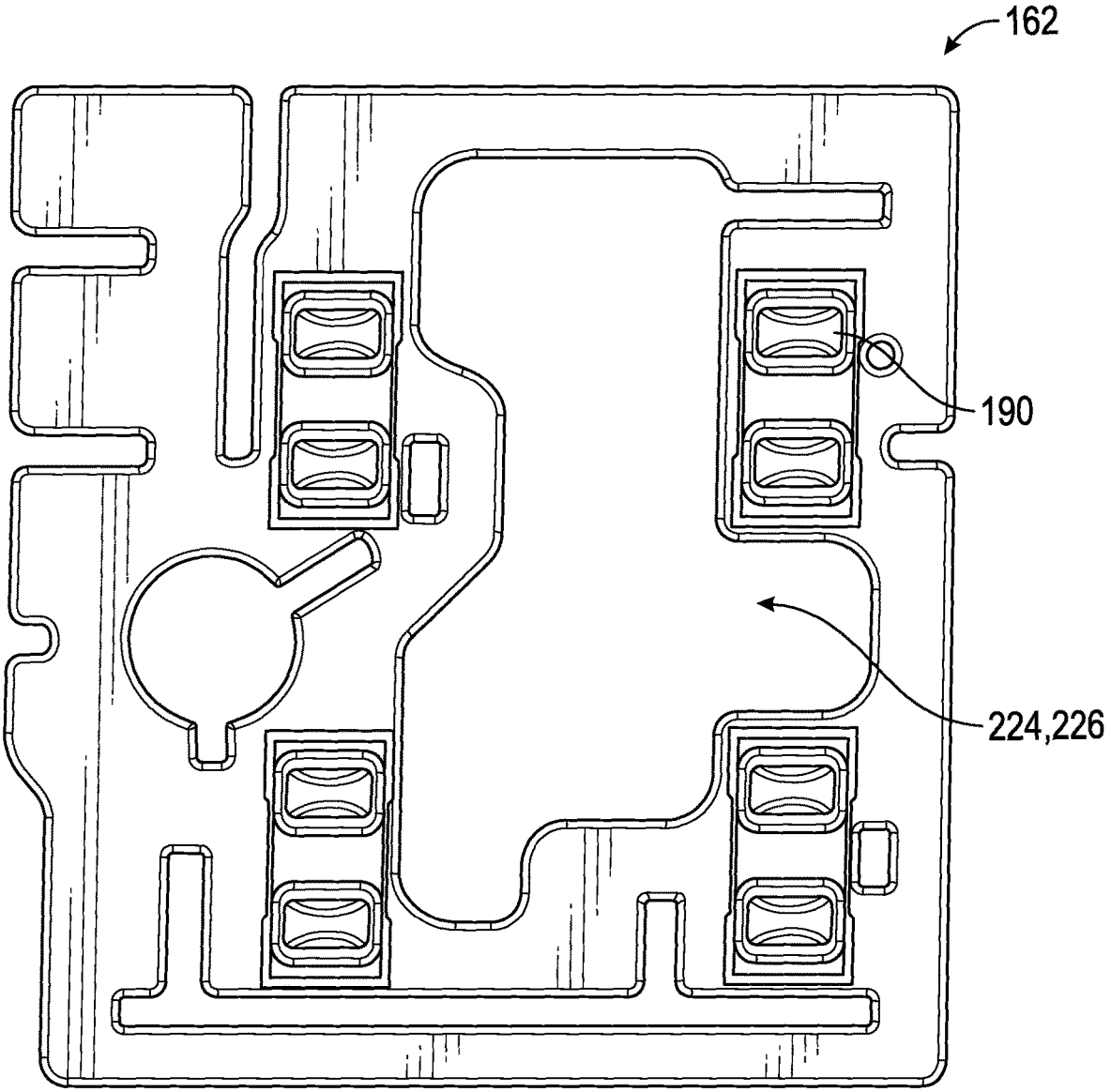
FIG. 40 illustrates a front plan view of an exemplary embodiment of a sealing membrane in accordance with aspects of the present disclosure.
Figure 42:
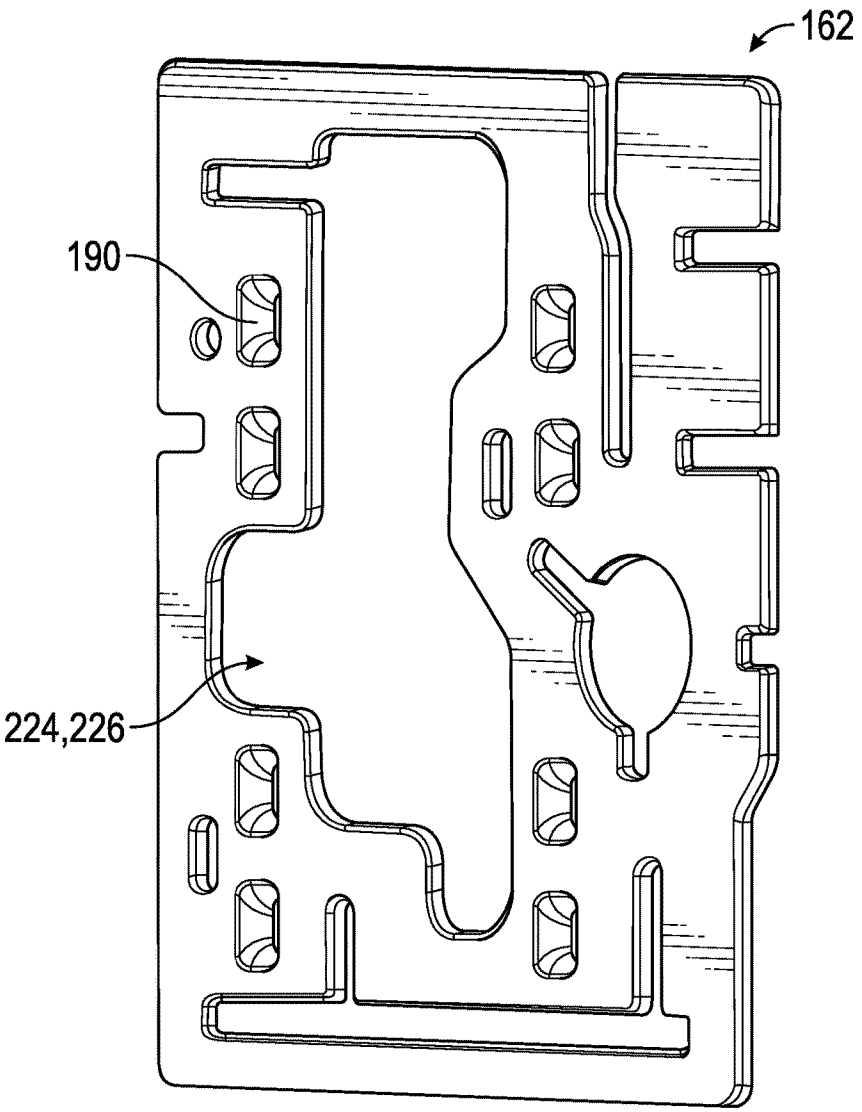
FIG. 42 illustrates a rear perspective view of the sealing membrane of FIG. 40 in accordance with aspects of the present disclosure.
Figure 41:
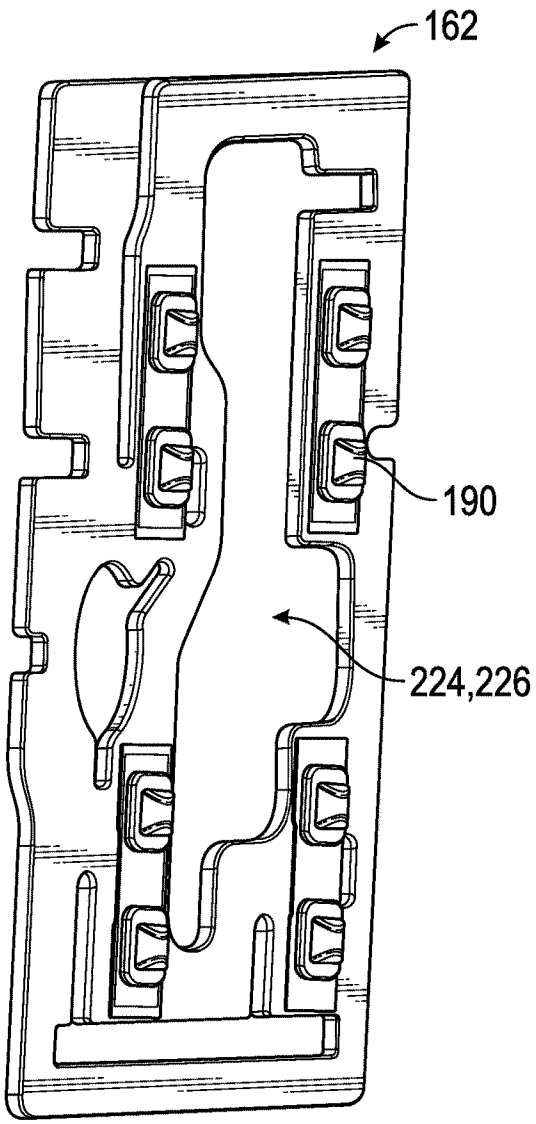
FIG. 41 illustrates a side perspective view of the sealing membrane of FIG. 40 in accordance with aspects of the present disclosure.
Figure 43:
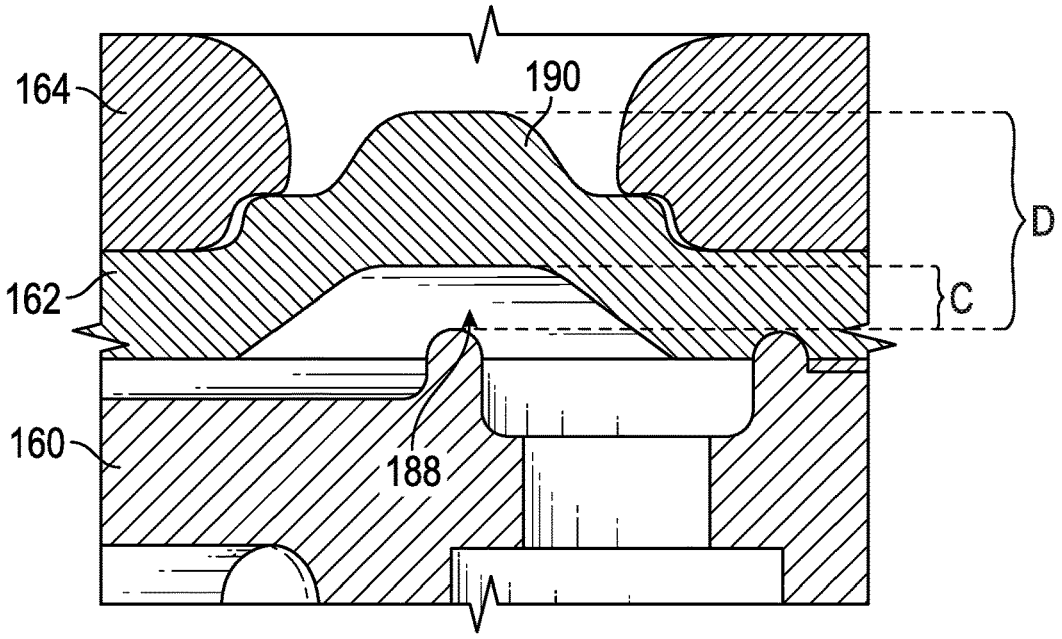
FIG. 43 illustrates a close up cross sectional view of an exemplary embodiment of a valve and a valve chamber in accordance with aspects of the present disclosure.

The next element of the cartridge 16 is the sealing membrane 162 which is illustrated apart from the other elements of the cartridge 15 in FIGS. 40-42. The sealing membrane 162 is preferably constructed from silicone or another flexible or compliant material that can provide an air and liquid tight seal between the cartridge frame 160, the sealing membrane 162, and the cartridge bezel 164. The sealing membrane 162 includes openings 224 for the mounting posts 130 of the pump head assembly 28 as well as an opening 226 for the locking bayonet 128. These openings allow the mounting posts 138 and locking bayonet 128 to pass through the sealing membrane 162 into position on the cartridge frame 160 while also providing an air and liquid tight seal to maintain the various fluid flow paths 186 of the cartridge 16.

The sealing membrane 162 also includes eight portions that from valves 190 in the illustrated embodiment. The valves 190 are defined in part by upward extending hollow portions of the sealing membrane 162. From the back of the membrane 162, the valves 190 are indentations in the surface. More or fewer valves 190 may be utilized depending on the design of the cartridge 16 and the number of diluents and fluid flow paths 186 necessary for the cartridge 16 operation. The functions of these valves 190 will be explained in conjunction with the operation of the fluid flow paths 186 of the cartridge 16. The valves 190 themselves are shown in close up in FIG. 43.

Figure 44:
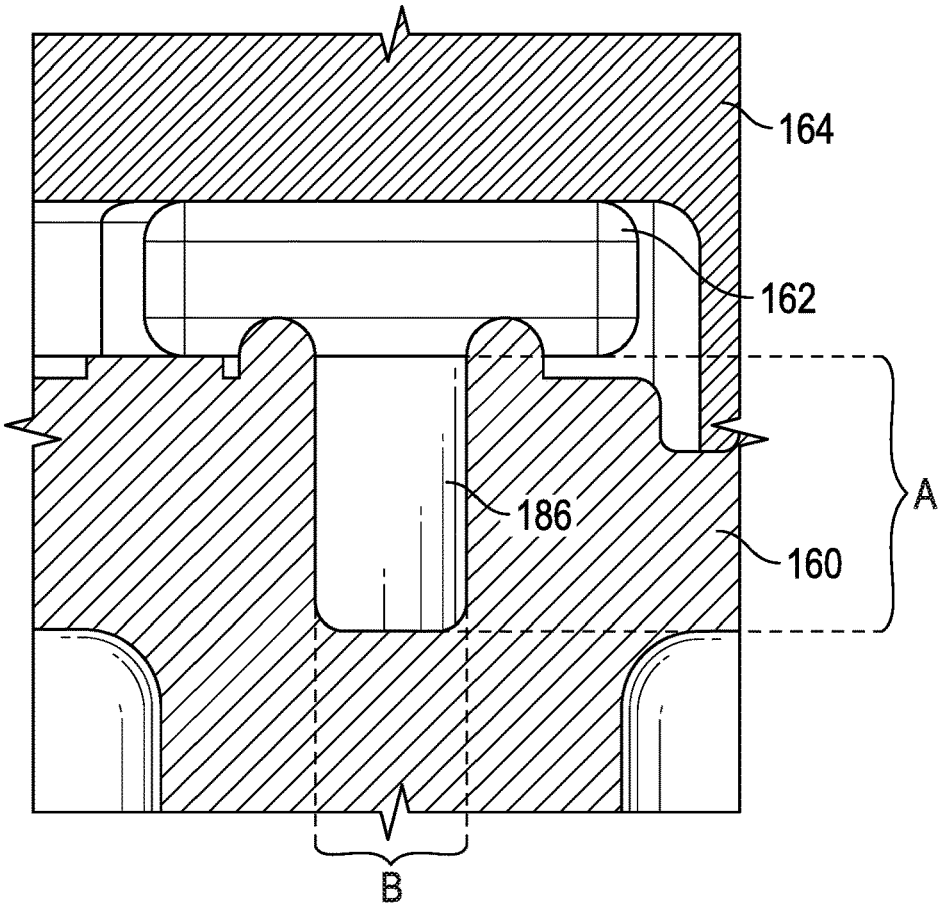
FIG. 44 illustrates a close up cross sectional view of an exemplary embodiment of a fluid flow path in accordance with aspects of the present disclosure.

When the sealing membrane 162 is mounted on the cartridge frame 160 and the bezel 164 is mounted on the sealing membrane 162, a liquid and vapor sealed area is formed between the cartridge frame 160 and the sealing membrane 162 which forms the fluid flow channels 186. A cross section of an exemplary channel is shown in FIG. 44. The fluid flow channels 186 will be described in relation to the operation of the cartridge 16 itself. When the sealing membrane 162 is positioned on the cartridge frame 160, the valves 190 are seated in the valve chambers 188 defined on the cartridge frame 160 to create chambers that may be opened m and closed by the valves 190 to adjust the fluid flow paths 186 during operation.

Figure 45:
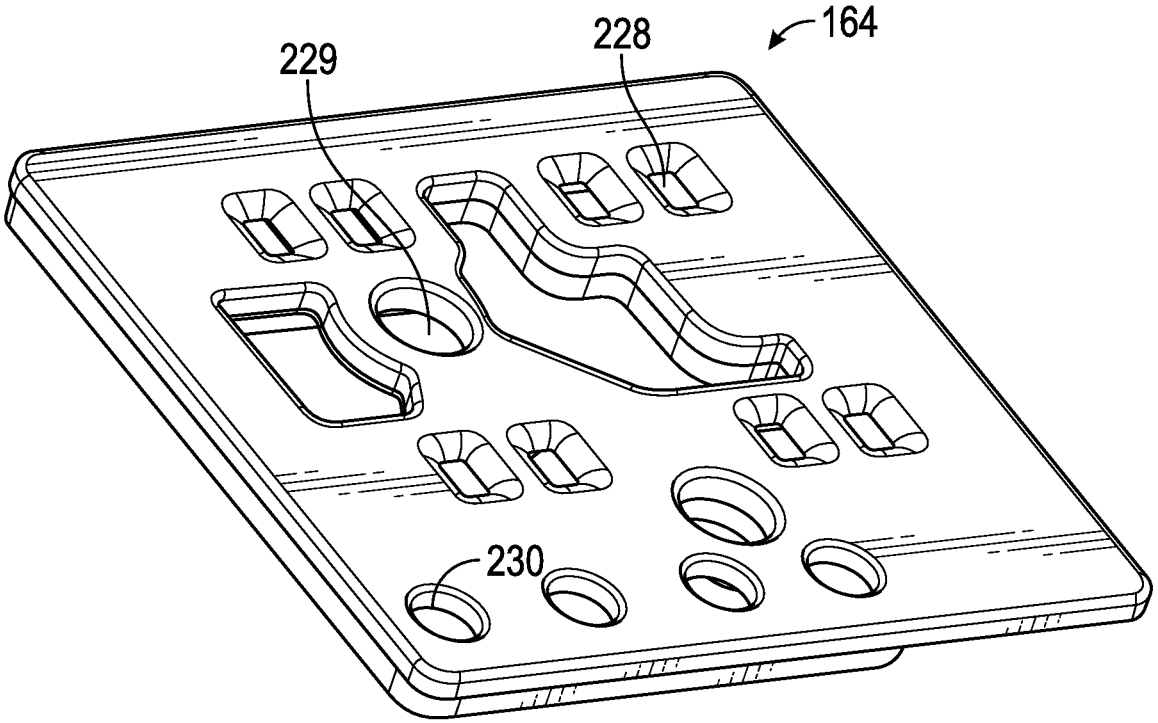
FIG. 45 illustrates a perspective view of an exemplary embodiment of a bezel in accordance with aspects of the present disclosure.
Figure 46:
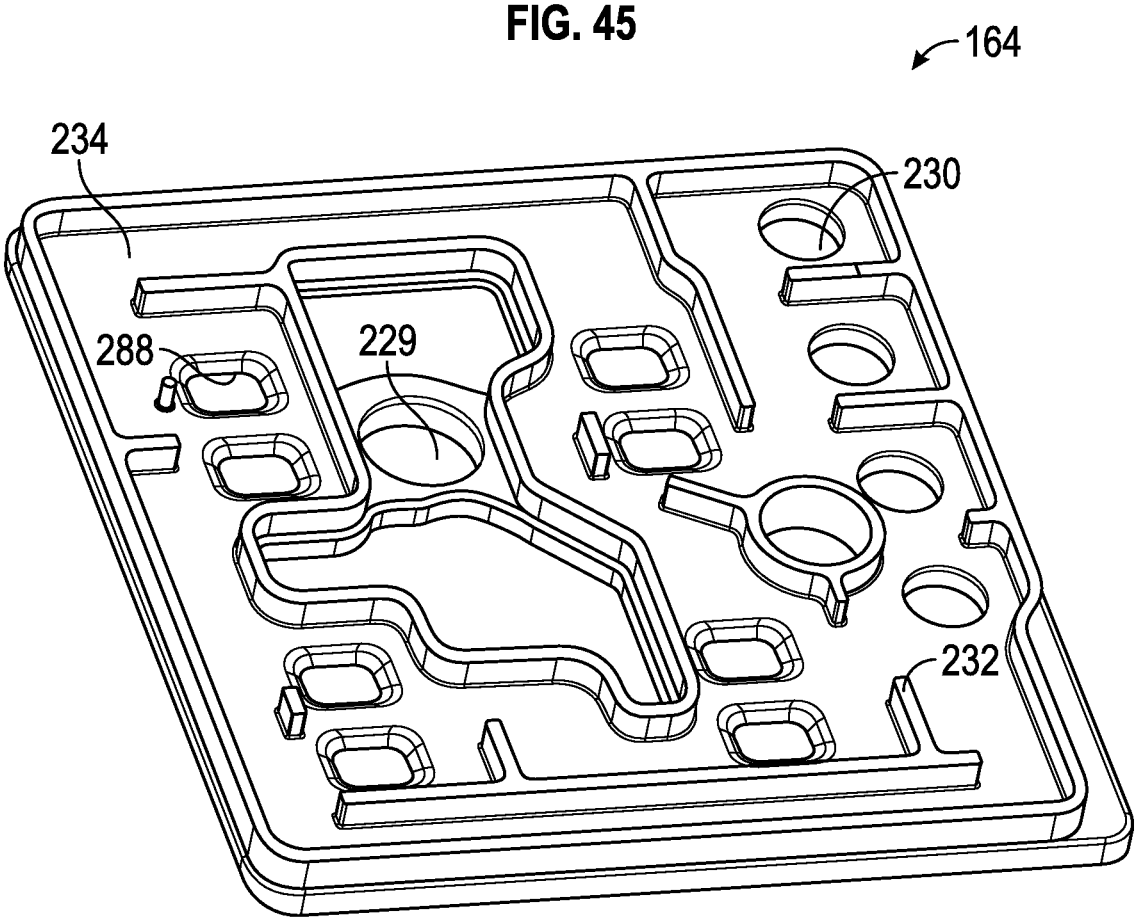
FIG. 46 illustrates a rear perspective view of the bezel of FIG. 45 in accordance with aspects of the present disclosure.
Figure 47:
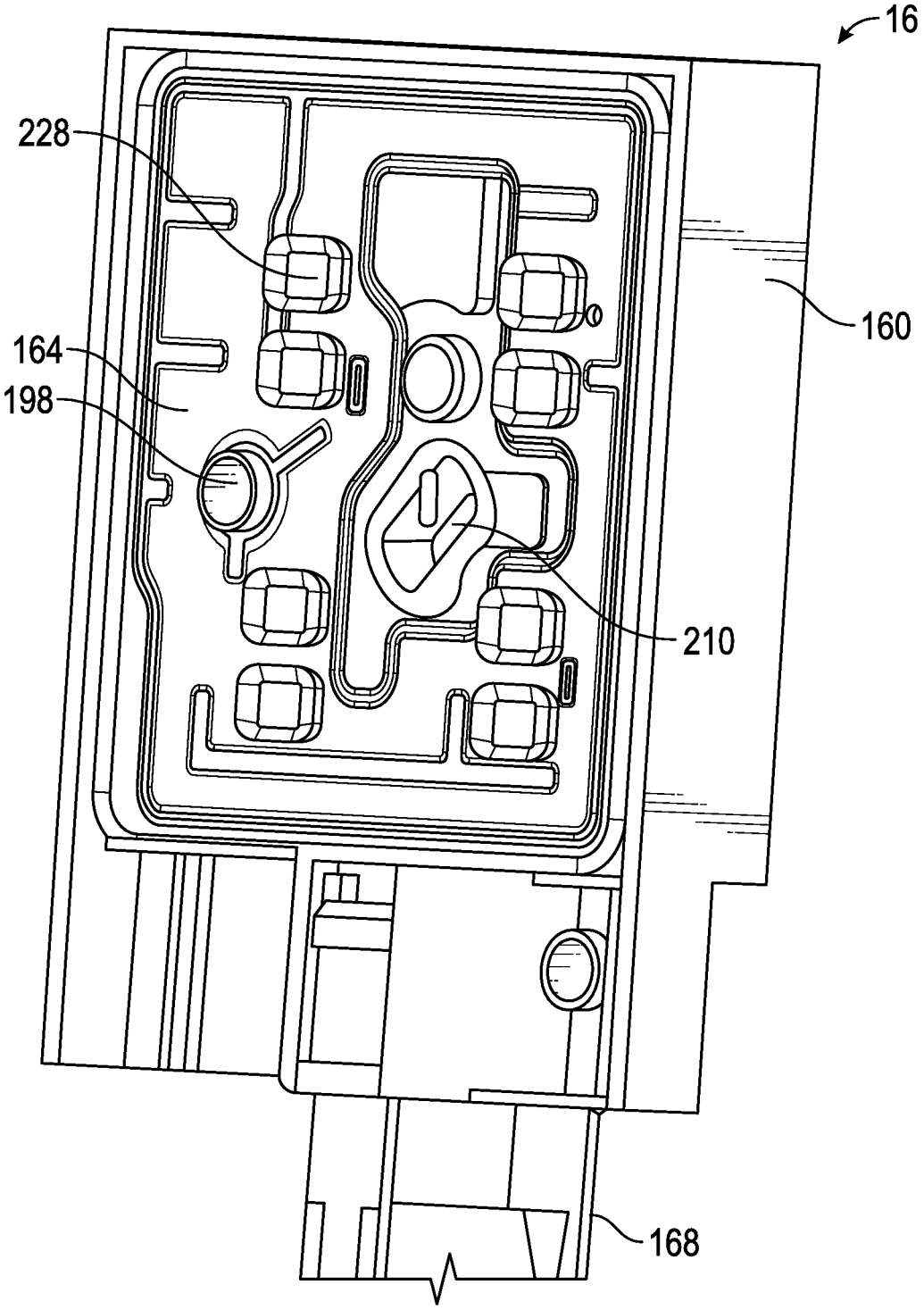
FIG. 47 illustrates a perspective view of an exemplary embodiment of an assembled cartridge with a transparent bezel in accordance with aspects of the present disclosure.
Figure 48:
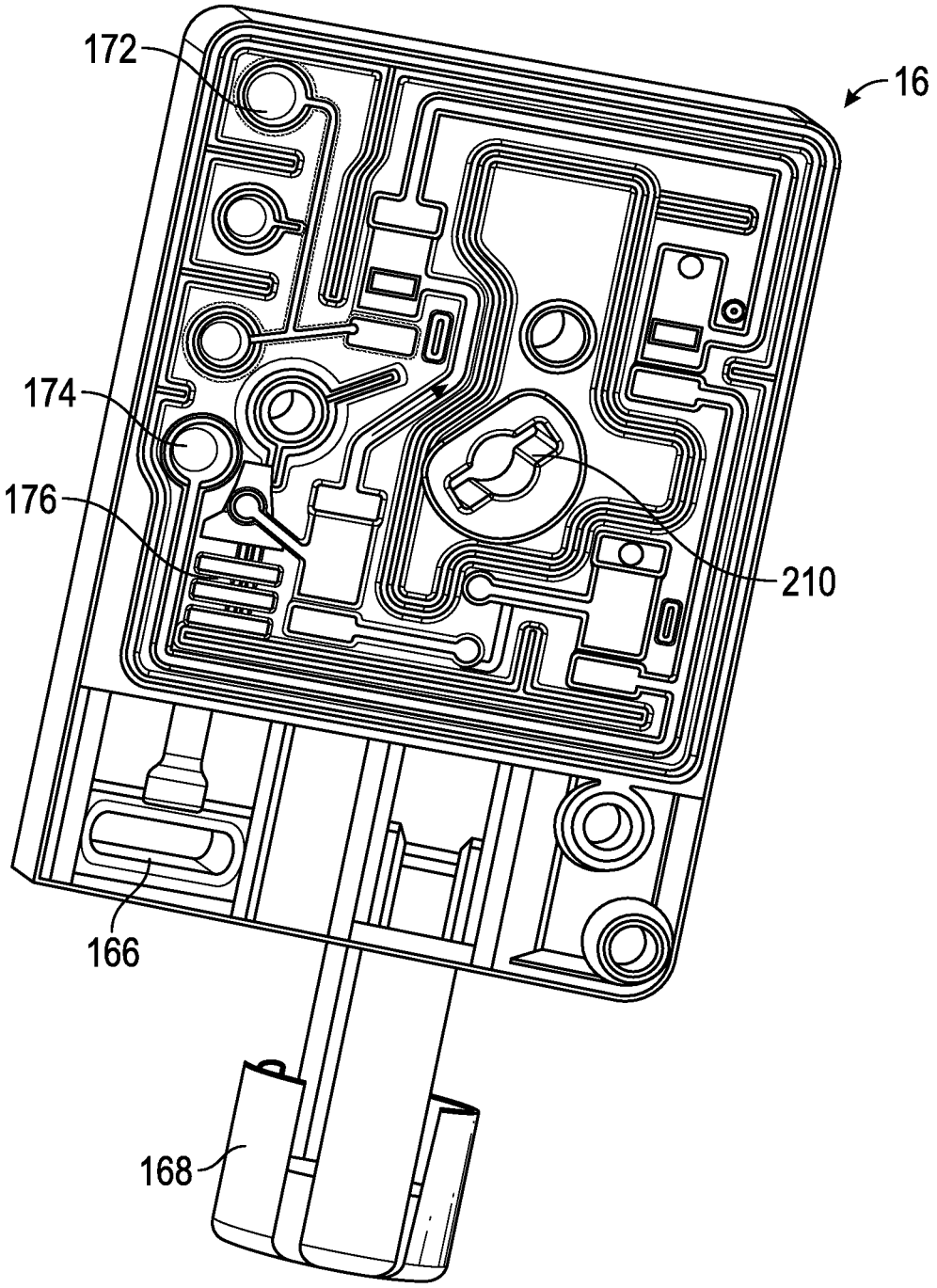
FIG. 48 illustrates a perspective view of the cartridge of FIG. 47 with an exemplary embodiment of a piston pump attached in accordance with aspects of the present disclosure.

The third portion of the cartridge 16 is a bezel 154 that may, for example, constructed of polycarbonate. Various views of an exemplary bezel 167 are shown in FIGS. 45 and 46. The bezel 164 is mounted on top of the sealing membrane 162 to sandwich the sealing membrane 162 between the bezel 164 and the cartridge frame 160. The bezel 164 includes openings 229 for the posts 130 of the pump head assembly 28, the locking bayonet 128 and the valve actuators 84. Furthermore, the bezel 164 includes openings 228 in which the valves 190 of the sealing membrane 162 can sit and be accessed by the valve actuators 84. Moreover, the bezel 164 includes openings 230 that allow a fluid manifold to be connected to the diluent 172 and vapor waste chambers 174 in the cartridge 16. In operation, the needles of the fluid manifold enter through the openings 230 in the bezel 164 and pierce the sealing membrane 162 to gain fluidic access to the diluent 172 and vapor waste chambers 174 defined in the cartridge 16 between the sealing membrane 162 and the cartridge frame 160. The bezel 164 also includes upstanding extensions 232 on its inner side 234 that press down on the sealing membrane 162 to maintain a tight seal. FIG. 47 illustrates a transparent version of the bezel 164 positioned on the sealing membrane 162. FIG. 48 illustrates the clear bezel 164 on the sealing membrane 162 with the piston pump 166 in place.

Before describing the various fluid flow paths in the cartridge 16, the operation of the pumping and valve mechanisms will be described with reference to FIGS. 3, 4, 13 and 14. The piston pump 166 acts as a positive displacement pump that has significant advantages over a traditional peristaltic pump mechanism. First, it has the best rate accuracy and flow continuity regardless of the pump's orientation or environmental conditions. Second, it is able to push an excess of 50 psi into elastomeric pumps. As previously described, the piston pump 166 is positioned within the cartridge 16 in a silicone piston pump boot 184. The pump mechanism is driven by a motor in the pump motor mechanism 20 which rotates an eccentric drive shaft 82 and drive pin 222 on the pump head assembly 28 which controls the movement of the piston 166 as well as the valve actuators 84. In operation, the cartridge 16 is placed on the cartridge grasp 80 on the locating posts 130 and locked in place by the locking bayonet 128. This aligns the valves 190 with the valve actuators 84 and the eccentric drive shaft 82 and pin 222 with the piston pump 166. The piston 166 is driven by the eccentric drive pin 222. The pin 222 is parallel to but offset from the rotational axis of the drive shaft, which produces sinusoidal motion that is converted to an axial movement of the piston 166.

Figure 13:
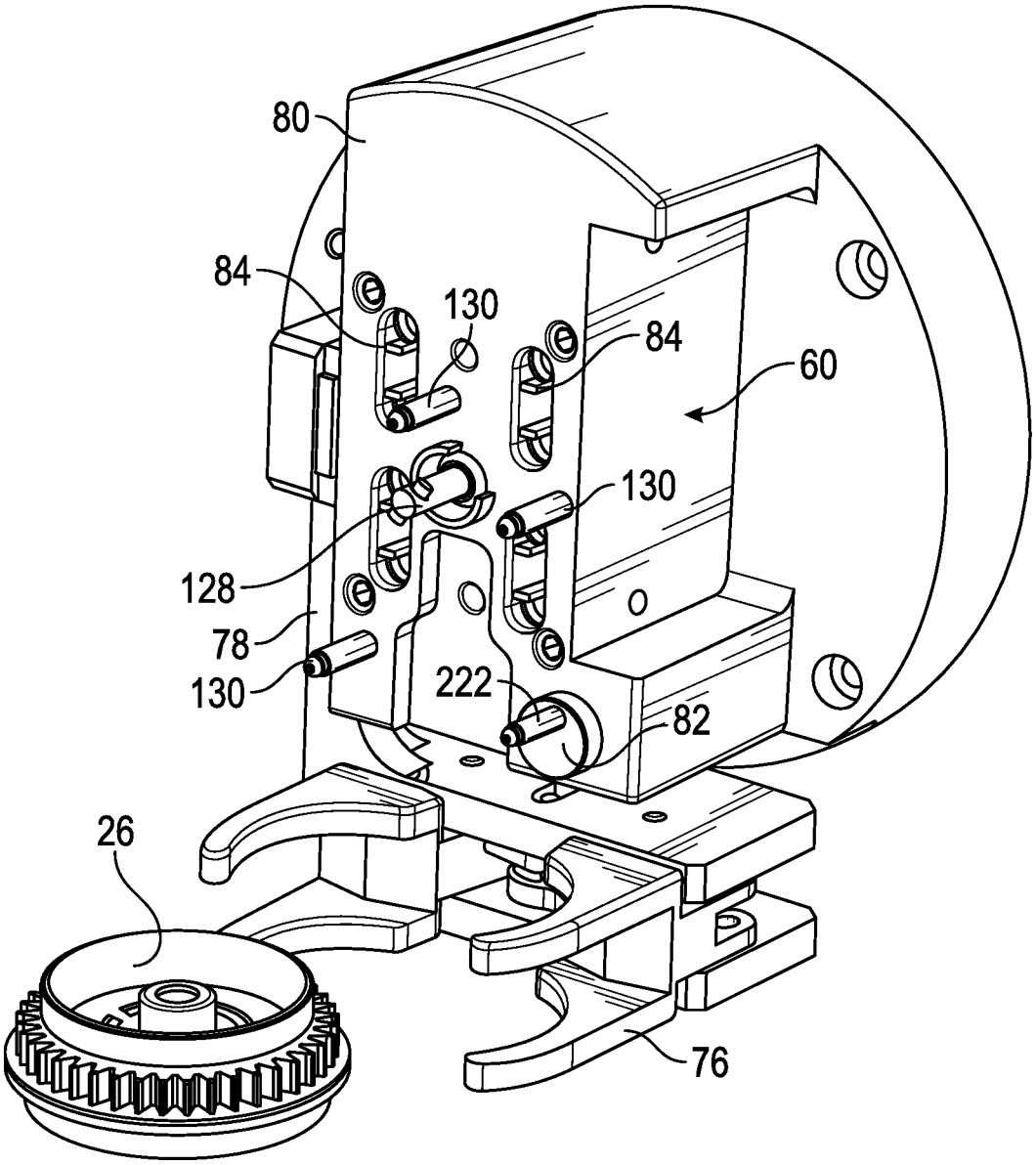
FIG. 13 illustrates a perspective view of the pump head assembly of FIG. 12 with an exemplary embodiment of a gripping system and vial puck in accordance with aspects of the present disclosure.
Figure 14:
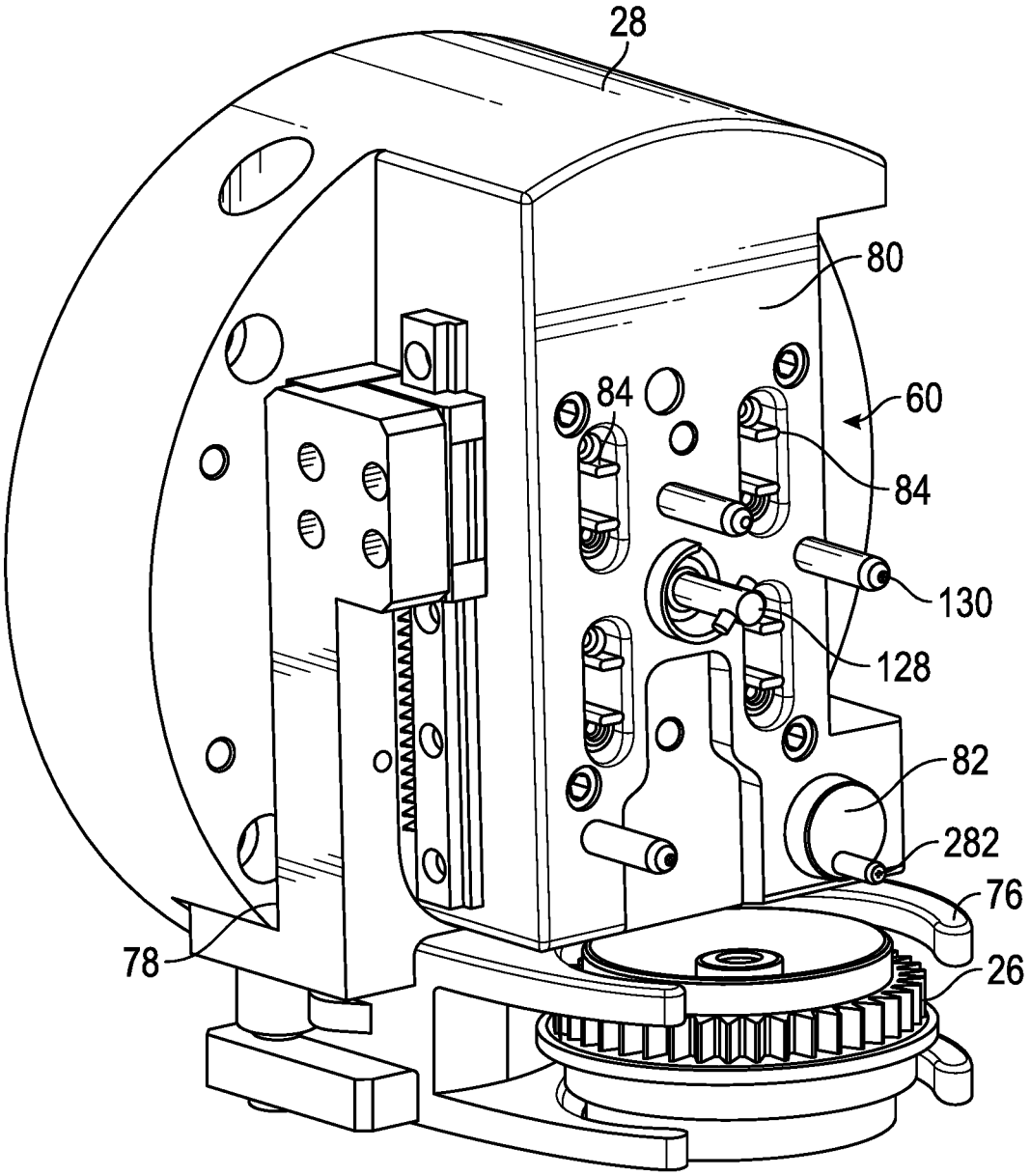
FIG. 14 illustrates a perspective view of the pump head assembly, gripping system and vial puck of FIG. 13 in accordance with aspects of the present disclosure.
Figure 15:
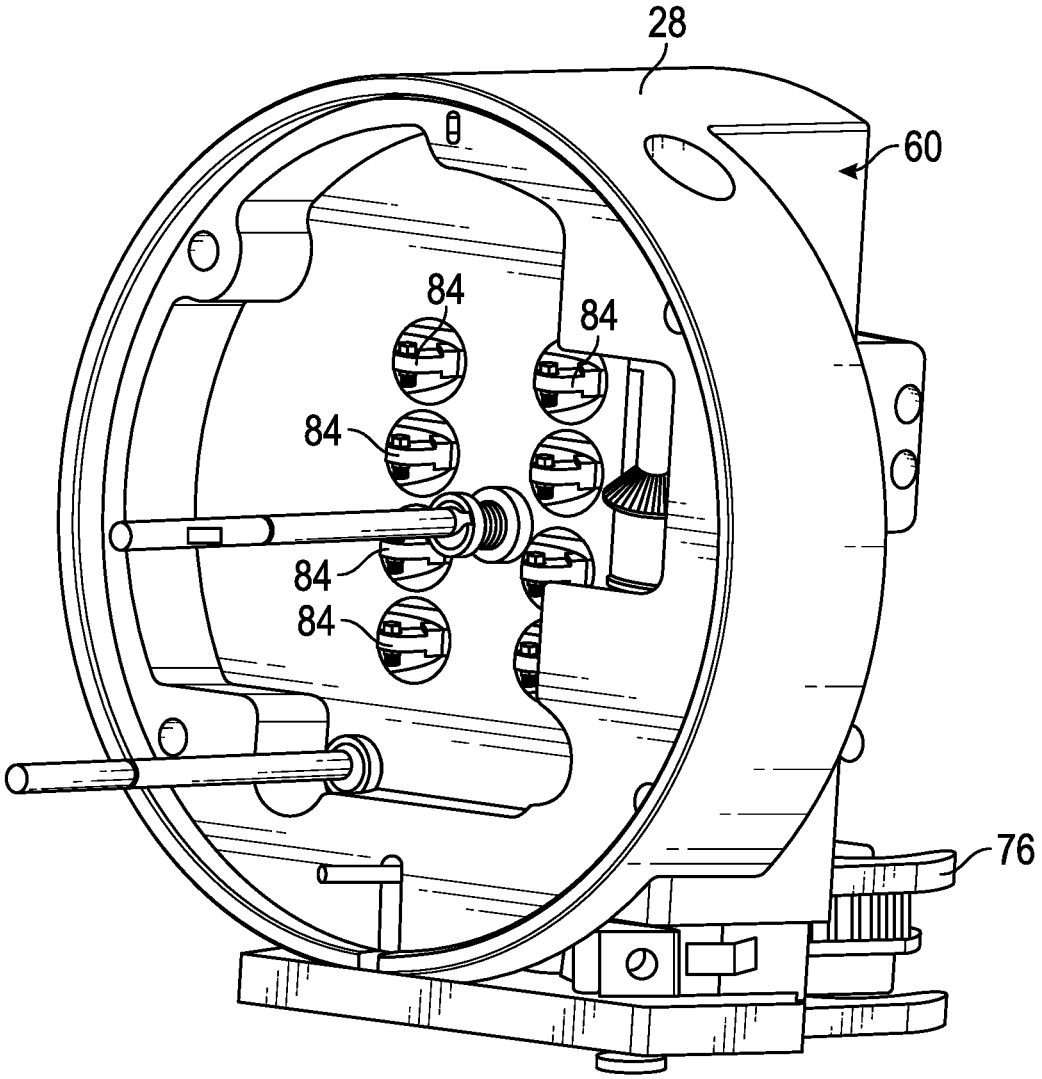
FIG. 15 illustrates a rear perspective view of the pump head assembly, gripping system and vial puck of FIG. 13 in accordance with aspects of the present disclosure.
Figure 16:
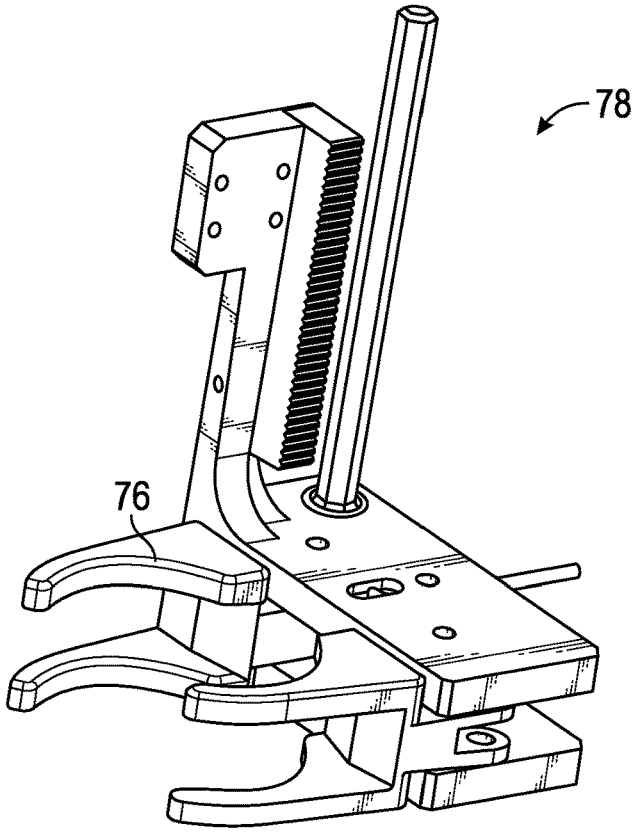
FIG. 16 illustrates a perspective view of an exemplary embodiment of a gripping system in accordance with aspects of the present disclosure.
Figure 17:
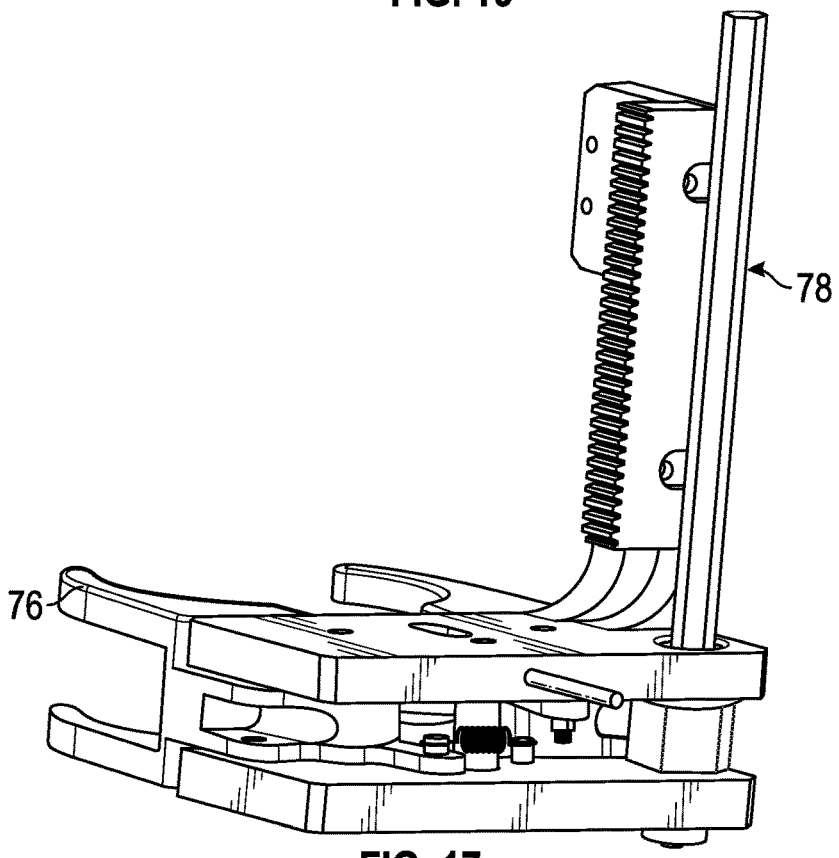
FIG. 17 illustrates a rear perspective view of the gripping system of FIG. 16 in accordance with aspects of the present disclosure.
Figure 18:
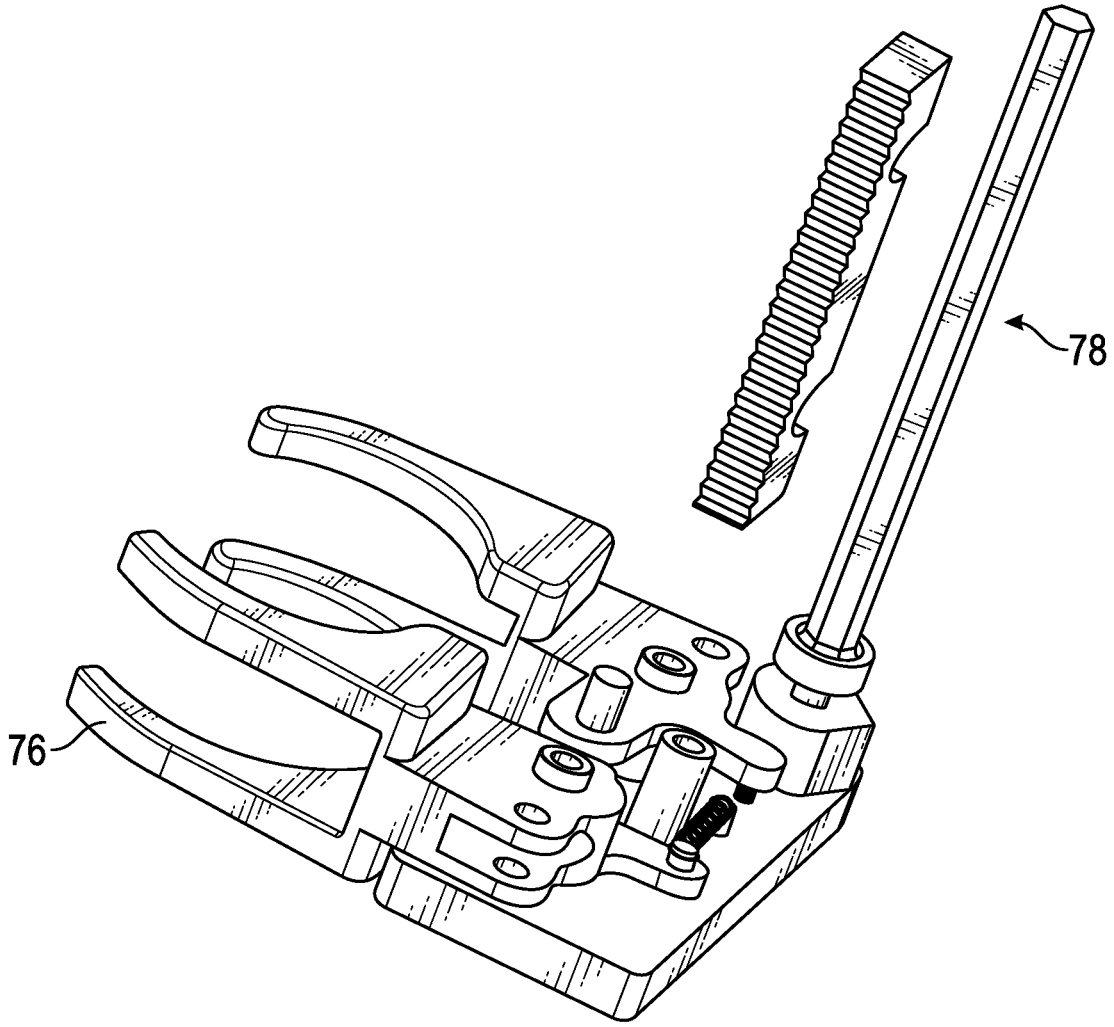
FIG. 18 illustrates a side perspective view of the gripping system of FIG. 16 in accordance with aspects of the present disclosure.
Figure 19:
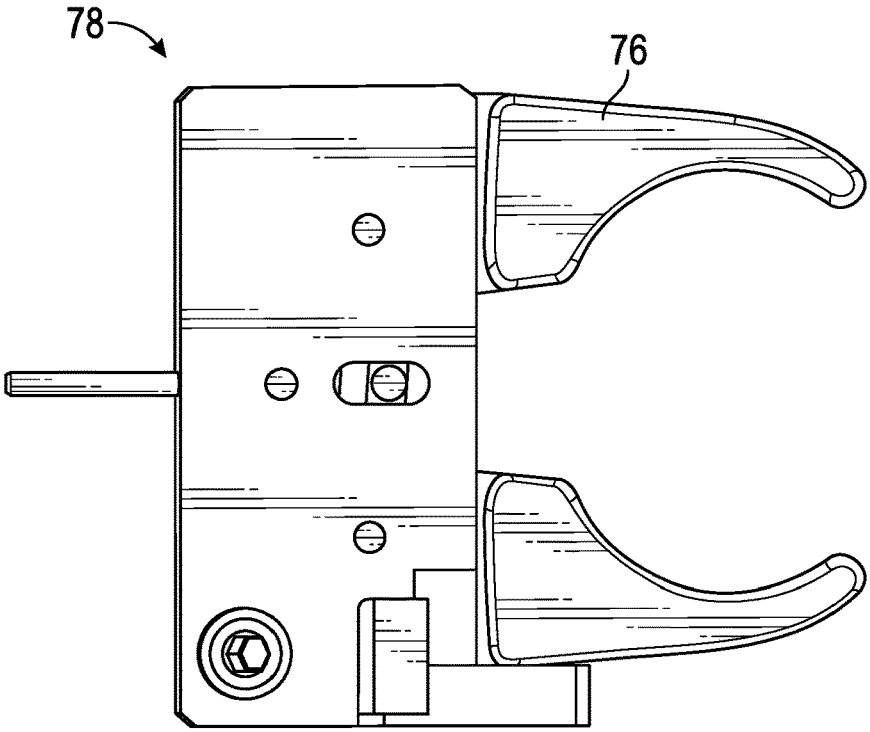
FIG. 19 illustrates a top plan view of the gripping system of FIG. 16 in accordance with aspects of the present disclosure.
Figure 20:
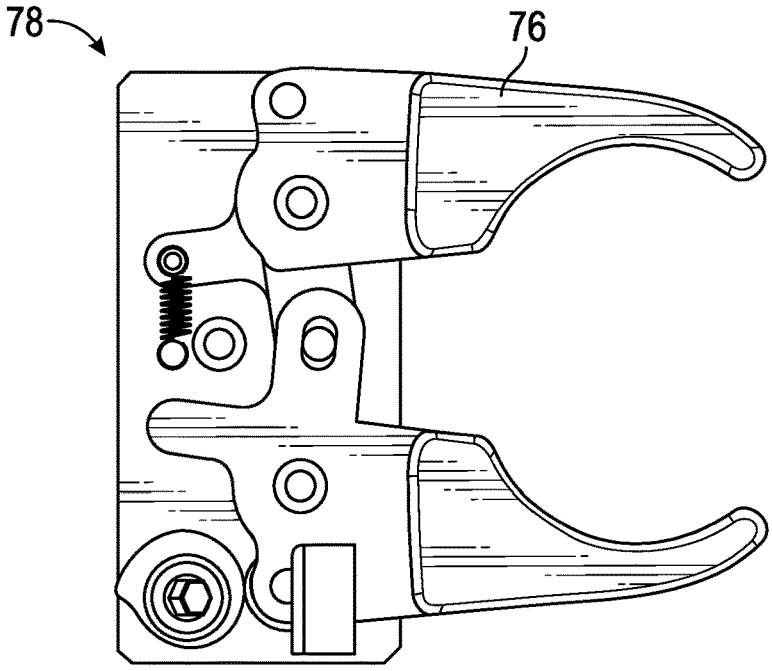
FIG. 20 illustrates a top plan view of the gripping system of FIG. 16 in accordance with aspects of the present disclosure.

The valve actuators 84 are illustrated in FIGS. 13 and 14, which show the pump head assembly 28 removed from the rest of the pump motor mechanism 20. Each one of the valves 190 has a corresponding valve actuator 84 that is controlled by a geared cam to cause axial movement of the valve actuator 84 into contact with the valve 190 to close the valve 190 and away from the valve 190 to open the valve 190. In one embodiment, eight valve actuators 84 are provided, one for each valve 190, and they are aligned with the positions of the valves 190 so they can extend through the openings 228 in the bezel 154 of the cartridge 16 and contact the valves 190. The valve actuators 84 are software controlled so that they can automatically cause the valves 190 to open and close depending on which flow paths 186 need to be opened and closed.

The valve actuators 84 are operated at different times in the pumping cycle depending on the required fluid flow path. The fill portion of the piston 166 starts as the piston rod 194 moves, and the inlet valve is opened and the outlet valve is closed. Other valves 190 will be opened and closed depending on the necessary fluid flow paths. At the end of the fill portion of the cycle when the piston 166 is at the bottom dead center position, the valve actuation changes to close the inlet and open the outlet valves. At this point, the delivery portion of the cycle starts and the piston 166 moves in the opposite direction. The delivery portion of the cycle ends when the piston 166 reaches the top dead center location, which is the home location. When the piston 166 reaches this position, a new cycle is started.

The movement of the eccentric drive shaft 82 can be in a clockwise direction under normal conditions when delivering fluid and counter clockwise when pulling fluid. The pump mechanism can be made to pump backwards depending on the required flow path. The drive shall not be inadvertently back driven in either direction by the effects of pressure in the disposable line up to 50 psi.

Figure 49:
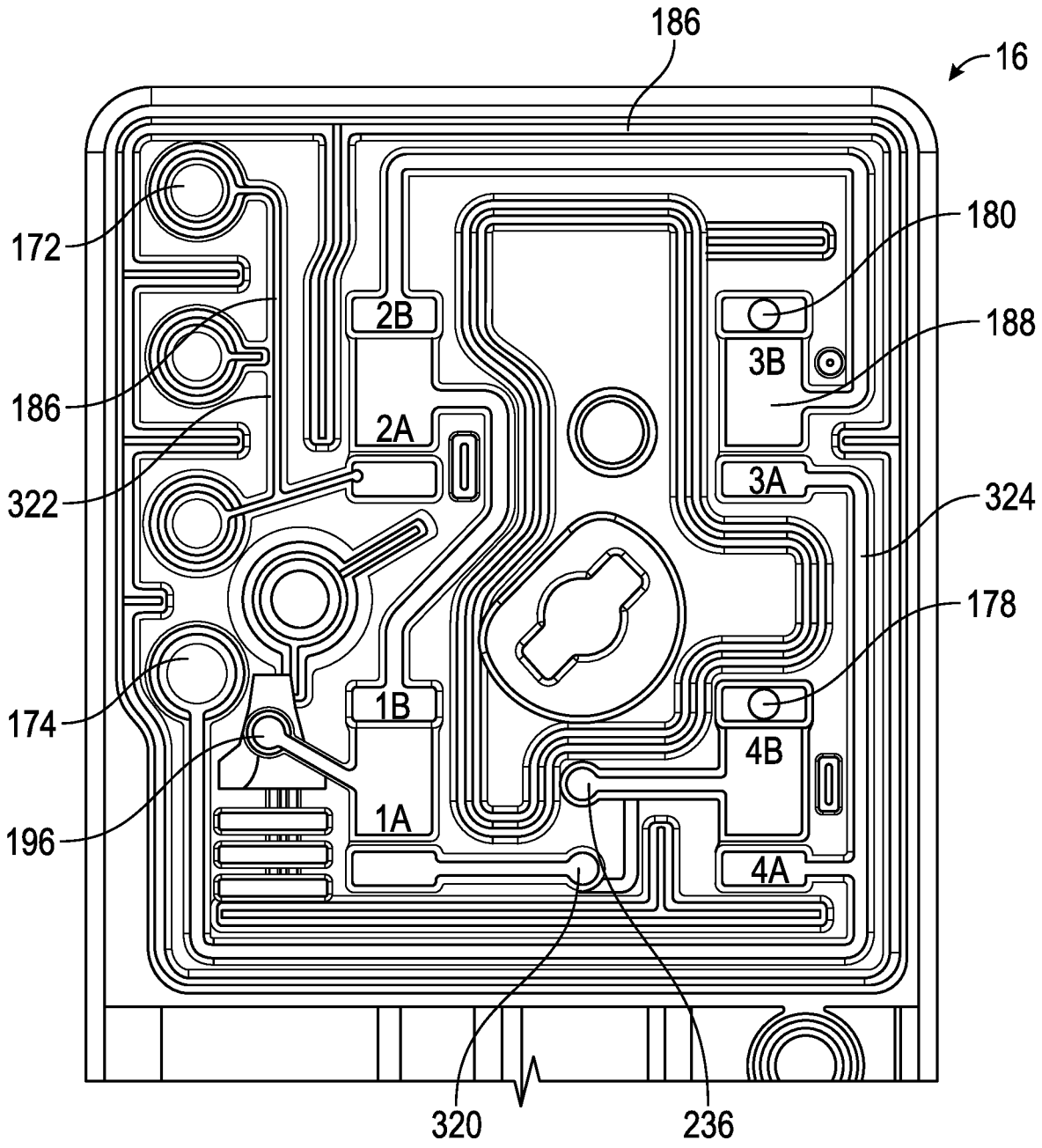
FIG. 49 illustrates an exemplary embodiment of a cartridge frame showing the valves and fluid flow paths in accordance with aspects of the present disclosure.

The operation of the cartridge 16 and the adjustment of the fluid flow paths 186 will now be described with reference to FIGS. 49-62 according to an embodiment. FIG. 49 shows a view of a cartridge 16 with both the bezel 164 and the sealing membrane 162 removed for clarity. It is to be understood that in normal operation, the bezel 164 seals the sealing membrane 162 against the cartridge frame 160 to form the various air and liquid tight flow paths 186. FIG. 49 illustrates a cartridge 16 with three diluent chambers 172 and one vapor waste chamber 174. An opening 196 allows access to the piston pump chamber 176 and allows the piston pump 166 to move fluid and/or vapor waste into and out of the pump chamber 176. The illustration also shows a port 180 to the receiving container 32, which in operation, will have a flexible tube attached to it. This opening 180 can also be seen in FIG. 37. Also shown are the vent port 178 for allowing filtered air to enter the system as well as a needle vent port 236 for allowing air to vent from the needle assembly 170 and a needle liquid port 320 to allow liquid to enter the needle assembly 170.

In the embodiment shown in FIGS. 49-62, the eight valves 190 are designated as 1A, 1B, 2A, 2B, 3A, 3B, 4A and 4B. It should be noted that in these figures, the valves 190 themselves are not shown. Valves 190 are formed as are part of the sealing membrane 162 as illustrated in FIGS. 40-42 and project into the chambers 188 that are designated with the valve numbers in FIGS. 49, 50, 53, 54, 56, 57, 58, 59, and 61-62. Also shown are the diluent chambers 172, the diluent lines 322, the vapor waste chamber 174, and the vapor waste line 324. All of these lines and chambers are formed in the surface 192 of the cartridge frame 160 and the sealing membrane 162 seals them once it is placed on top of the cartridge frame 160 and locked in place with the bezel 164.

Figure 51:
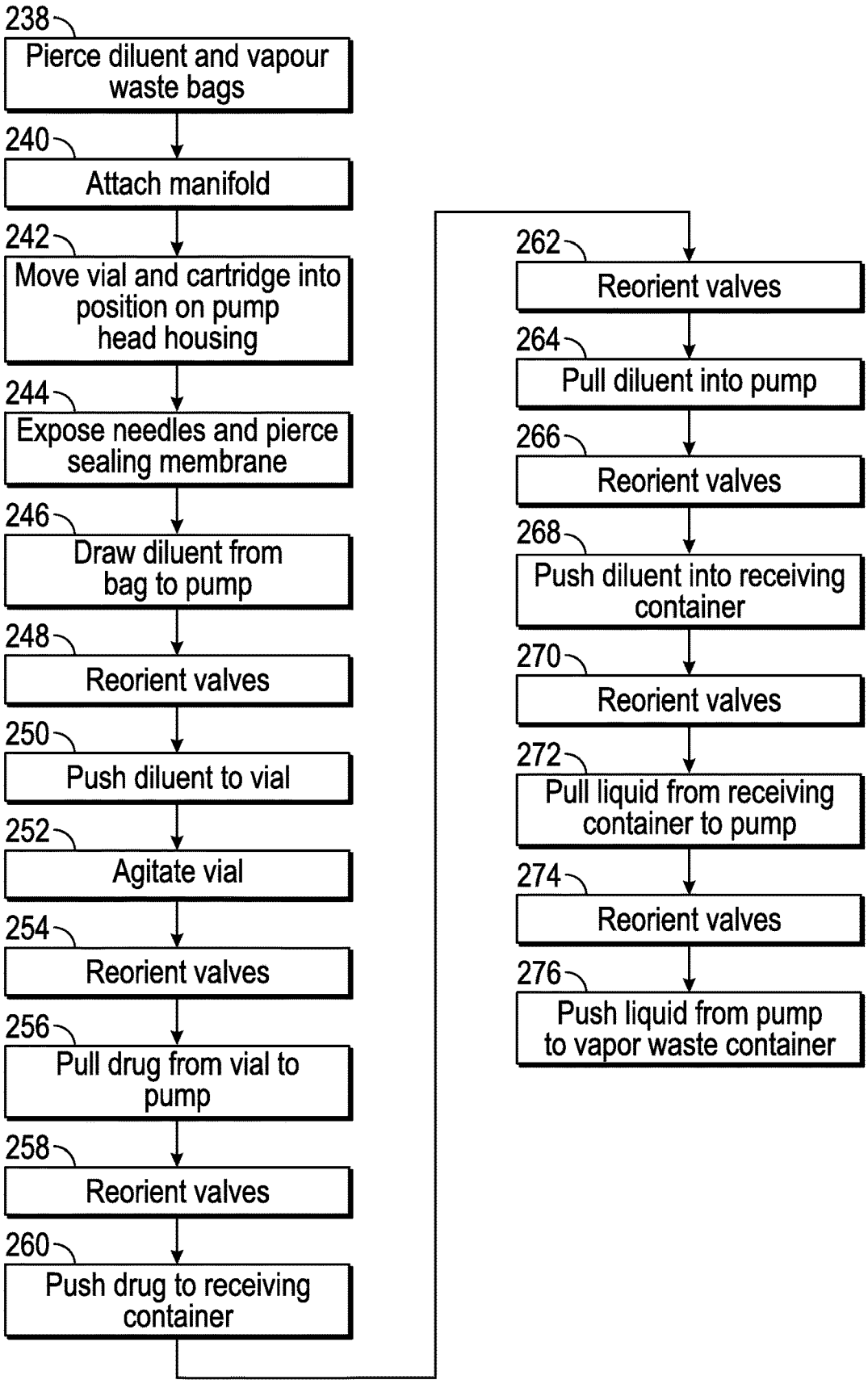
FIG. 51 is a flowchart illustrating the method steps of an exemplary embodiment in accordance with aspects of the present disclosure.

FIG. 50 is a chart showing the position and operation of the valves 190 during various portions of a reconstitution process. Certain valves 190 are associated with each other and/or with other parts of the system. For example, valves 1A and 1B are tied to the pumping mechanism and valves 3A, 3B, 4A and 4B are tied to each other and are timed 180° apart. FIG. 51 is a flow chart illustrating the steps of the process according to an embodiment.

Before the process begins, setup steps 238 and 240 may be performed to attach a flexible line 50 between each manifold and the diluent bag or vapor waste bag, and to position each detachable manifold 90 on the pump head assembly 28. Next, the cartridge 16 and vial 18 are moved 242 into place by the pump head assembly 28 and a flexible tube 38 with a connector is attached to the receiving container's port. In an embodiment, the movement of the cartridge 16 into place on the mounting posts 130 and locking bayonet 128 pushes back the sleeves on a manifold, exposing 244 the needles, which are inserted into the diluent chambers 172 and vapor waste chamber 174 by piercing the sealing membrane 162 above the chambers 172, 174. Each manifold has flexible tubes attached to it that run to the diluent bags 42 and the vapor waste bag 44.

Figure 52:
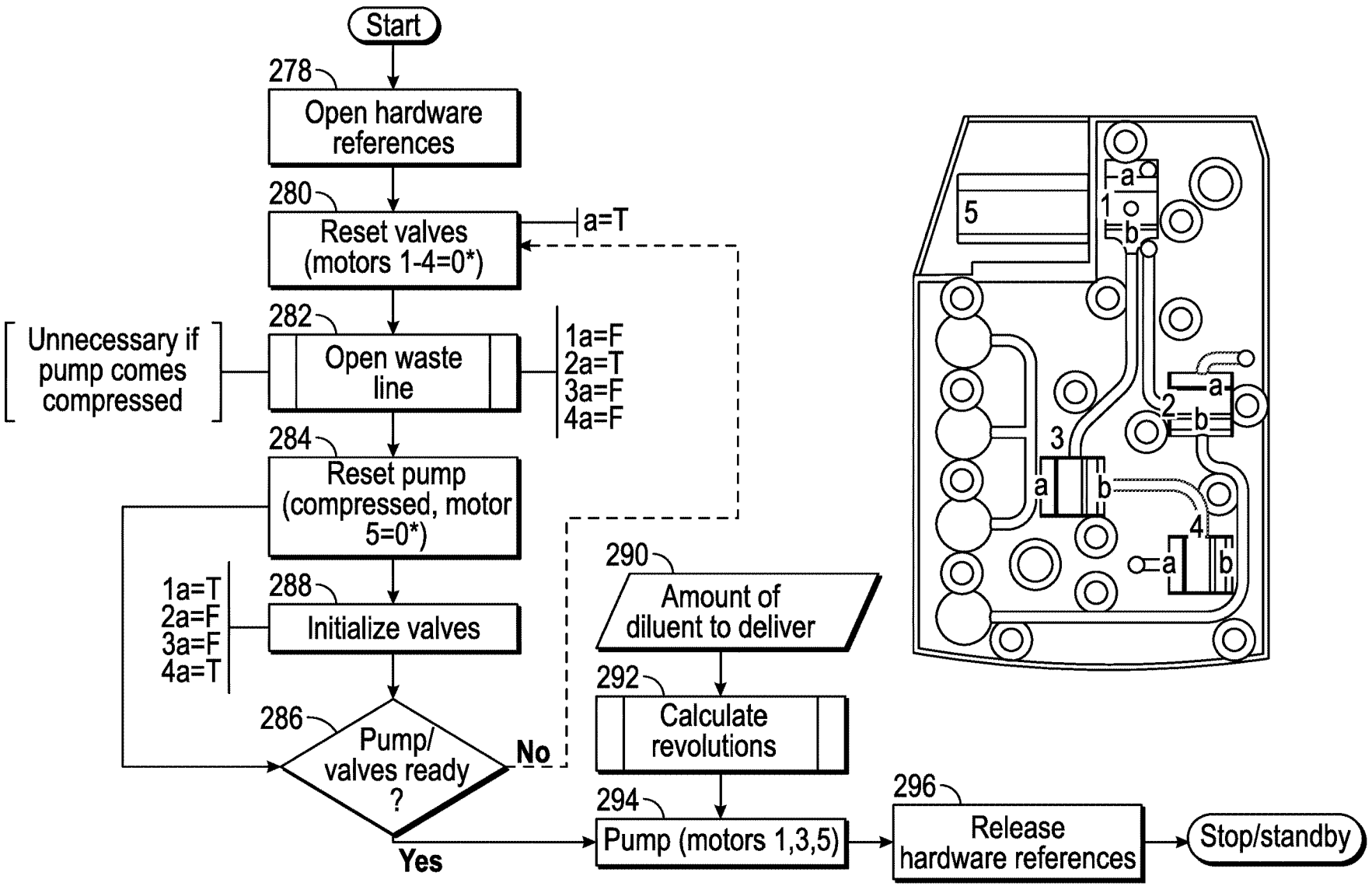
FIG. 52 is a flow chart illustrating the process of drawing diluent and pushing it into a vial in accordance with aspects of the present disclosure.

FIG. 52 is a flow chart illustrating the process of drawing diluent from the diluent containers 42 and pushing the diluent into the vial 18. At step 278, the hardware references are opened. Next 280 the valves 190 are reset. Next 282 the waste line is opened. The pump is then reset 284 and the valves 190 are checked 286 to see if they are ready. If they are not, they are initialized 288 to their proper positions. The amount of diluent to deliver is calculated at step 290 and the proper number of revolutions of the drive shaft for the pump is calculated 292. The pump then runs 294 to perform the process and the hardware references are released 296. The detailed steps of this process will now be described.

Figure 53:
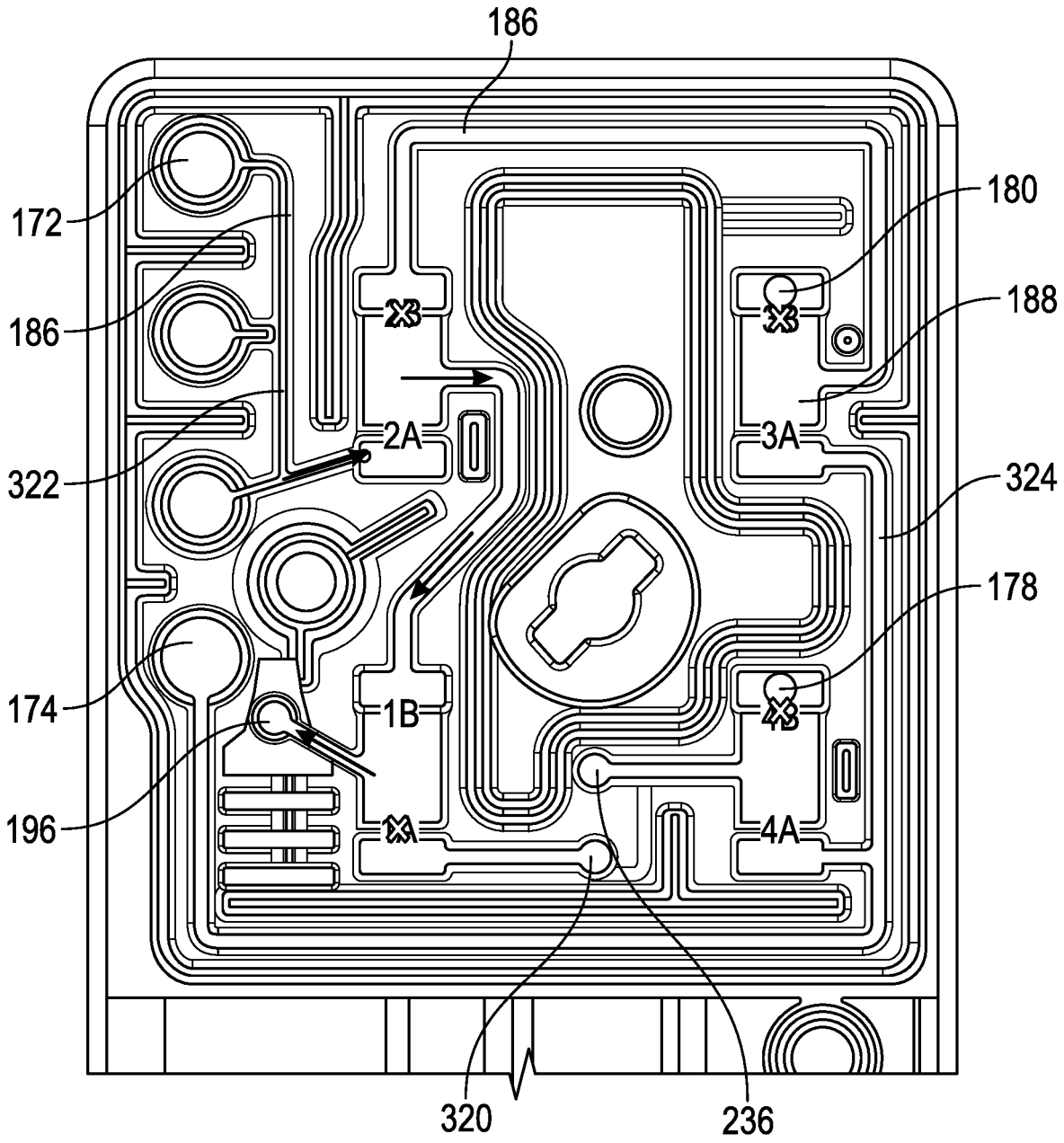
FIG. 53 illustrates the cartridge frame of FIG. 49 showing the valves and fluid flow paths in accordance with aspects of the present disclosure.

Referring back to FIG. 51, the first step 246 of the process is pulling diluent into the piston 166, as shown in FIG. 53. Valve 2A is open and valve 2B is closed. The piston 1166 is actuated to draw diluent from a diluent bag 42 into the fluid line along the pathway illustrated by the arrows in FIG. 53. Valve 1B is open and valve 1A is closed, thus allowing the piston 166 to draw the fluid along the fluid pathway 186 into the pump chamber opening 196.

Figure 54:
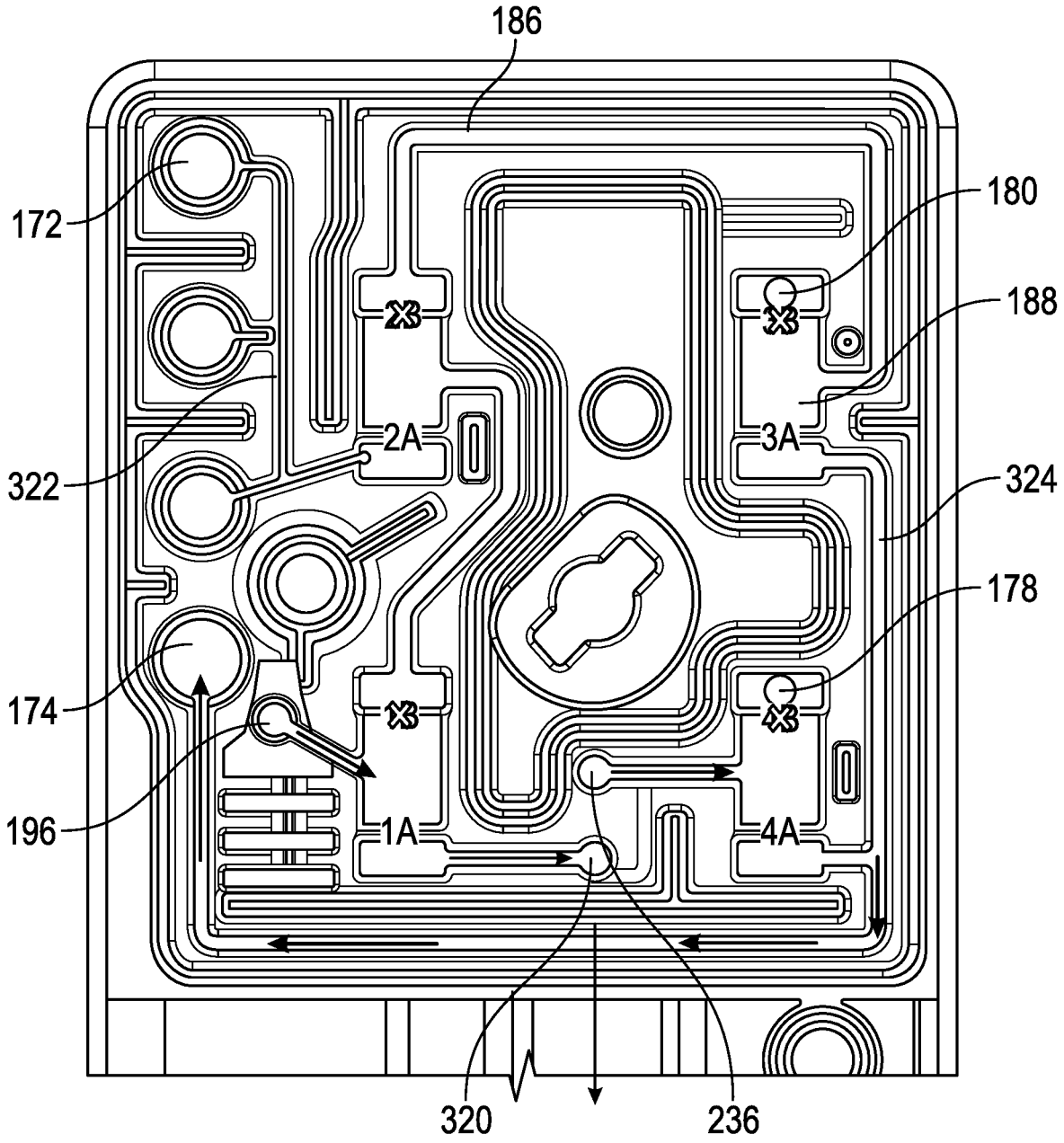
FIG. 54 illustrates the cartridge frame of FIG. 49 showing the valves and fluid flow paths in accordance with aspects of the present disclosure.

Next, the valves are reoriented 248. In the next step 250, as illustrated in FIG. 54, the diluent that has been pulled into the piston pump 166 is pushed into the vial 18 through one needle 316, while the air from the vial 18 exits the vial 18 through the other needle 318. Valve 2A remains open and valve 2B remains closed. Valve 1B is closed and valve 1A is opened to form a new fluid pathway 186 from the piston pump 166 to the needle liquid port 320, into the needle assembly 170 and into the vial 18. The piston pump 166 is actuated, thus pumping the diluent from the piston pump 166 along the flow path 186 illustrated by the arrows and into the vial 18. At the same time, valve 4B remains closed and valve 4A remains open. This allows the air from the vial 18 that is pushed out by the insertion of the diluent to exit the vial 18 through the needle assembly 170, our through the needle vent port 236, and into a separate flow path 186. This flow path 186 leads to the vapor waste port 174 and the air exits the cartridge 16 and flows to the vapor waste container 44.

Figure 55:
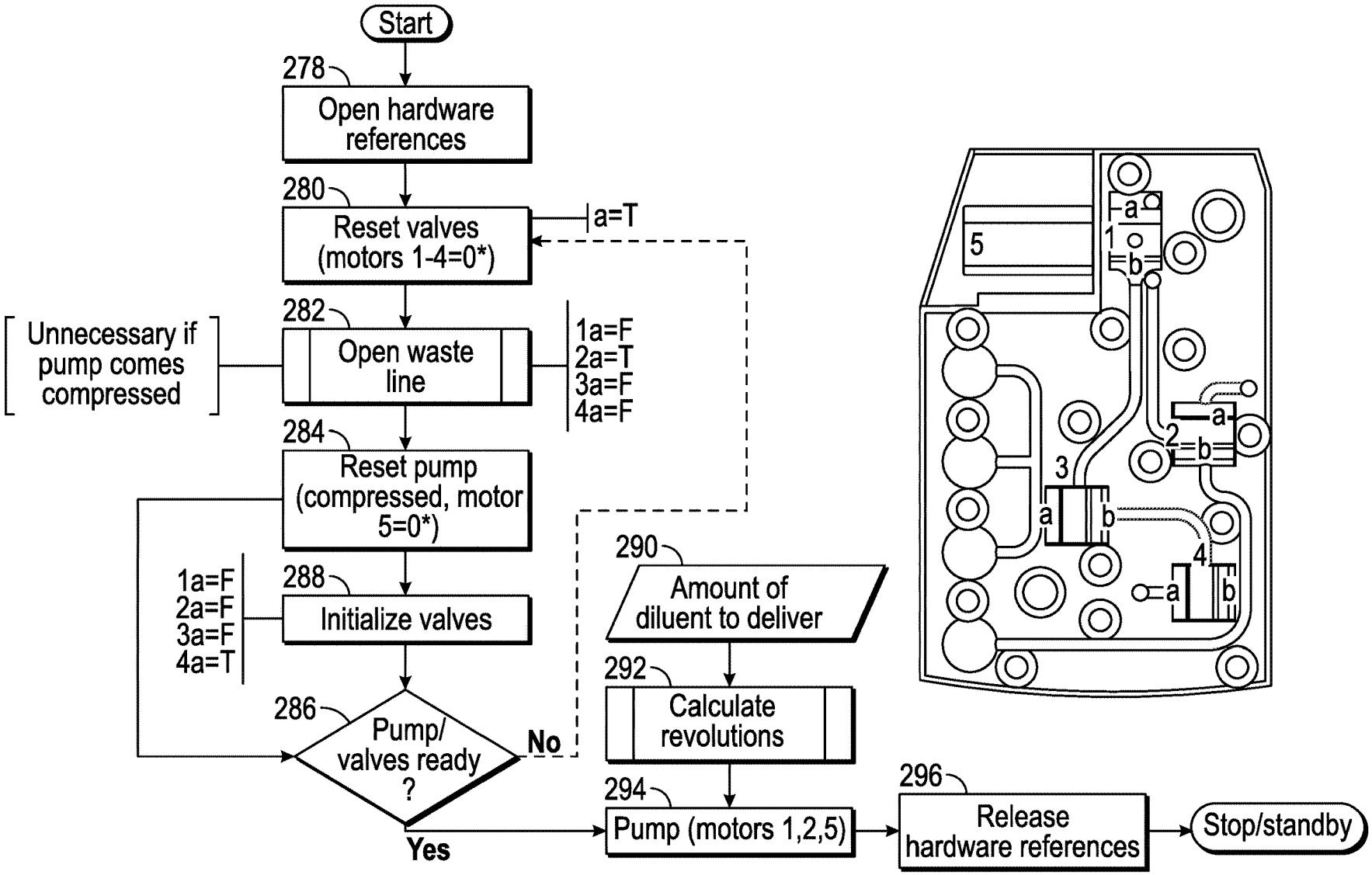
FIG. 55 is a flow chart illustrating the process of drawing a reconstituted drug from a vial and pushing into a receiving container in accordance with aspects of the present disclosure.
Figure 56:
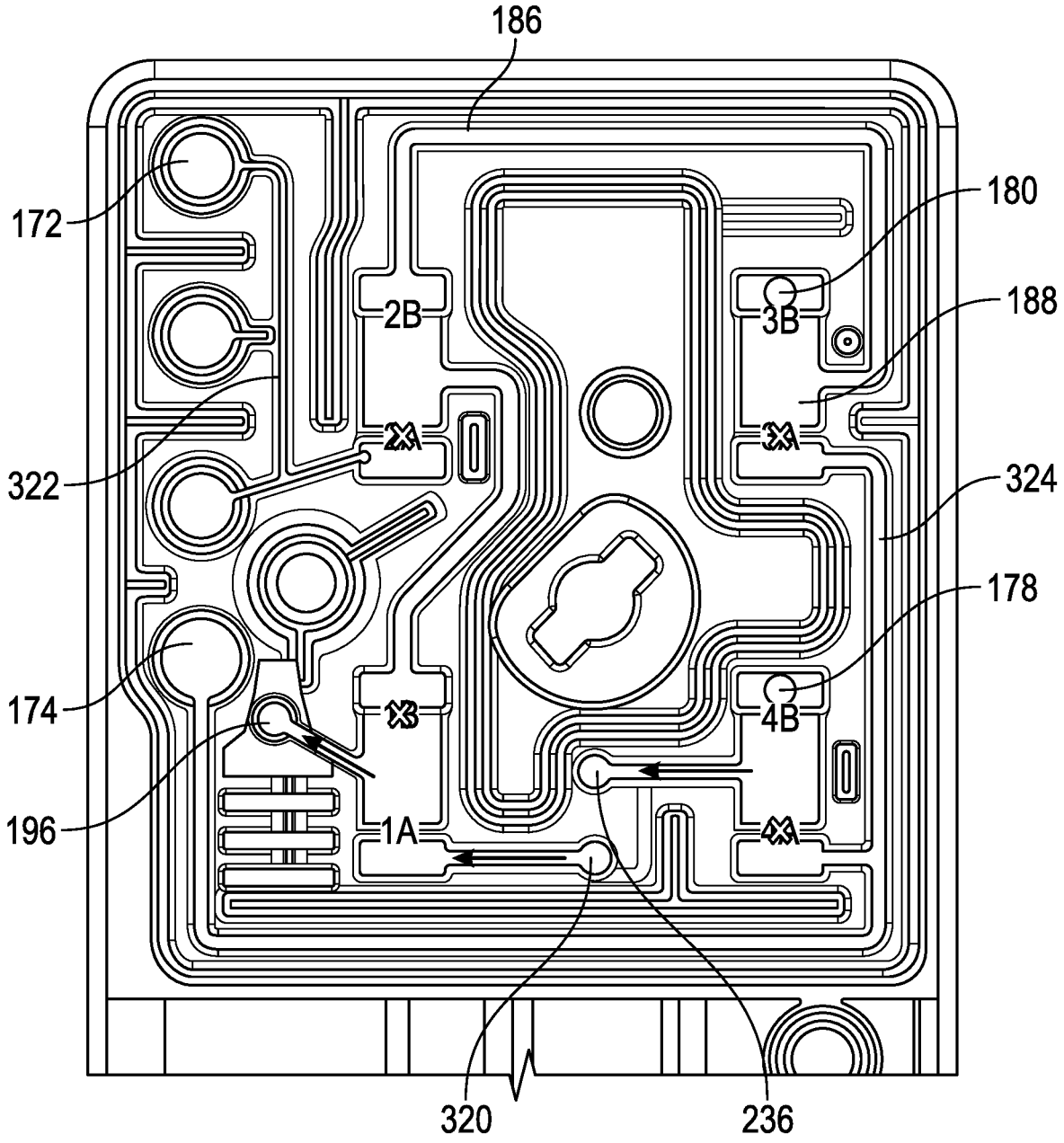
FIG. 56 illustrates the cartridge frame of FIG. 49 showing the valves and fluid flow paths in accordance with aspects of the present disclosure.

After this step, the vial is agitated 252 (e.g., using an agitation pattern specific to the drug being reconstituted) by the pump motor mechanism 20 to reconstitute the drug. After reconstitution, the vial is presented at an orientation that is easy to visual verify whether there is powder in the solution. If the operator indicates, upon visual inspection, that the reconstitution is complete, the process continues in the cartridge. First, the valves are reoriented 254. FIG. 55 is a flow chart illustrating the step 256 of drawing the reconstituted drug from the vial 18 and pushing it into the receiving bag 32. At step 278, the hardware references are opened. Next 280 the valves 190 are reset. Next 282 the waste line is opened. The pump is then reset 284 and the valves 190 are checked 286 to see if they are ready. If they are not, they are initialized 288 to their proper positions. The amount of diluent to deliver is calculated at step 290 and the proper number of revolutions of the drive shaft for the pump is calculated 292. The pump then runs 294 to perform the process and the hardware references are released 296. The detailed steps of this process will now be described.

As shown in FIG. 561, valve 1A is opened and valve 1B is closed. The piston pump 166 is actuated and draws the reconstituted drug from the vial 18 through the needle assembly 170, through the needle liquid port 320 and into the fluid pathway 186 shown by the arrows. The reconstituted drug is drawn into the piston pump 166. During this time, the diluent is locked out of the system by closing valve 2A. The vapor waste pathway is also locked out of the system by closing valve 4A. Valve 4B is opened to allow filtered air to enter the system and flow into the vial 18 through the needle assembly 170 as the reconstituted drug flows out of the vial 18 through another fluid pathway 186, thus preventing a vacuum in the system.

Figure 57:
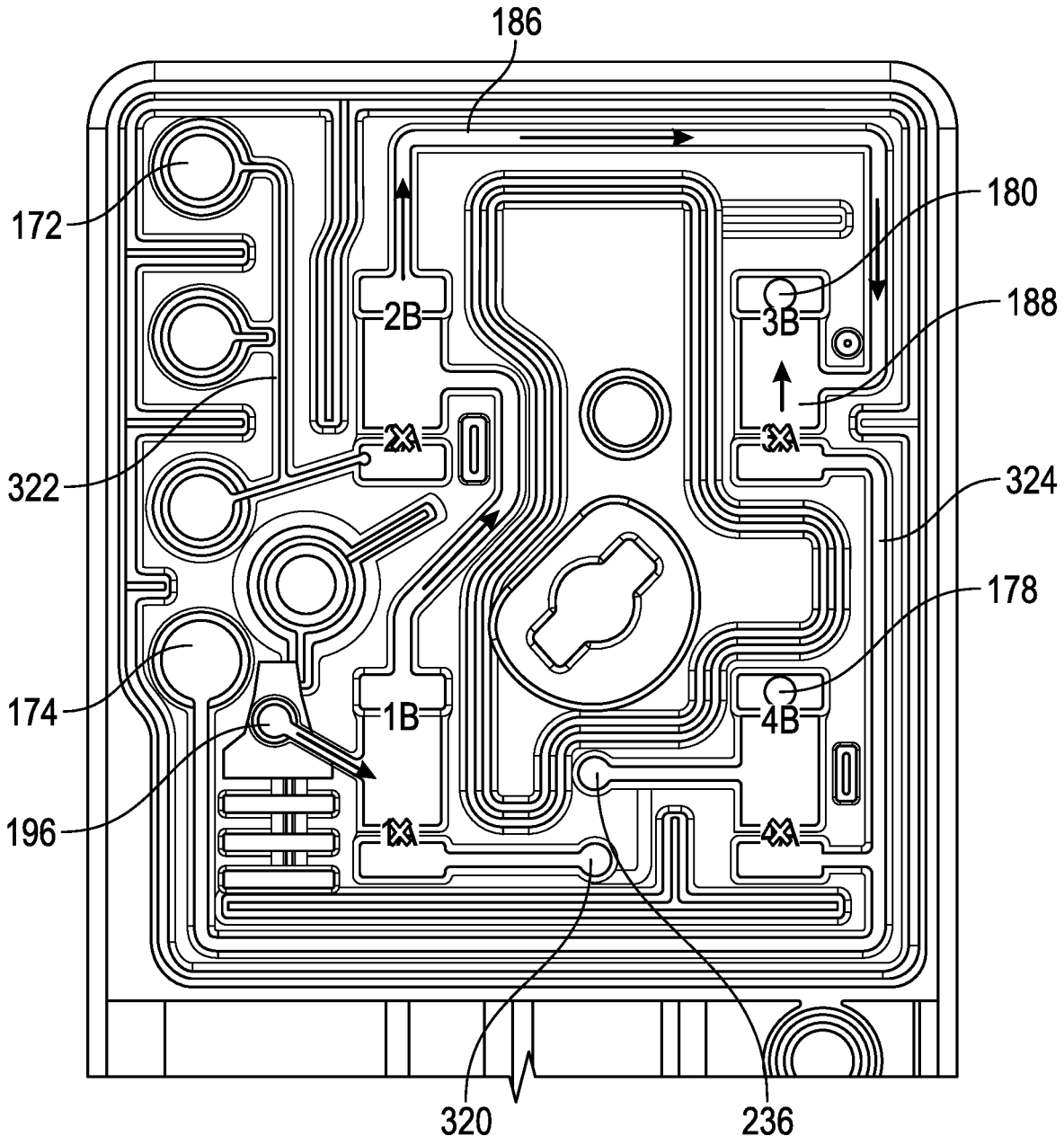
FIG. 57 illustrates the cartridge frame of FIG. 49 showing the valves and fluid flow paths in accordance with aspects of the present disclosure.

Next, the valves are reoriented 258. The next step 260 in the process is to push the reconstituted drug from the piston pump 166 into the receiving container 32 as shown in FIG. 57. Valve 1A is closed and valve 1B is opened. Valve 2A remains closed in order to lock the diluent out of the system. Valve 2B remains open as well as valve 3B. Valve 3A remains closed. The piston pump 166 is actuated and pushes the reconstituted drug out of the piston pump 166 and along the fluid pathway 186 as shown by the arrows to the exit port 180 that leads to the receiving container 32.

Figure 58:
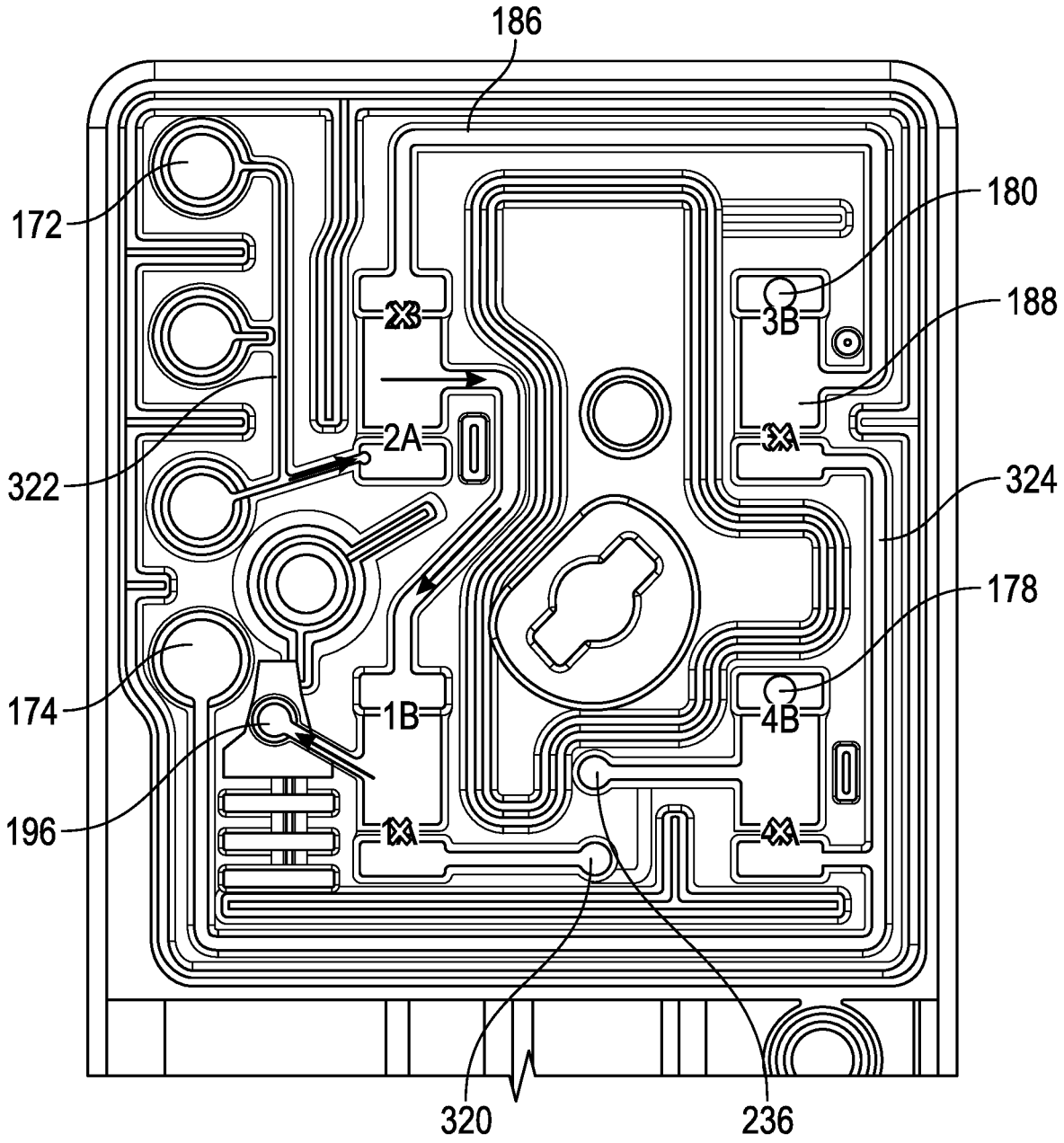
FIG. 58 illustrates the cartridge frame of FIG. 49 showing the valves and fluid flow paths in accordance with aspects of the present disclosure.
Figure 59:
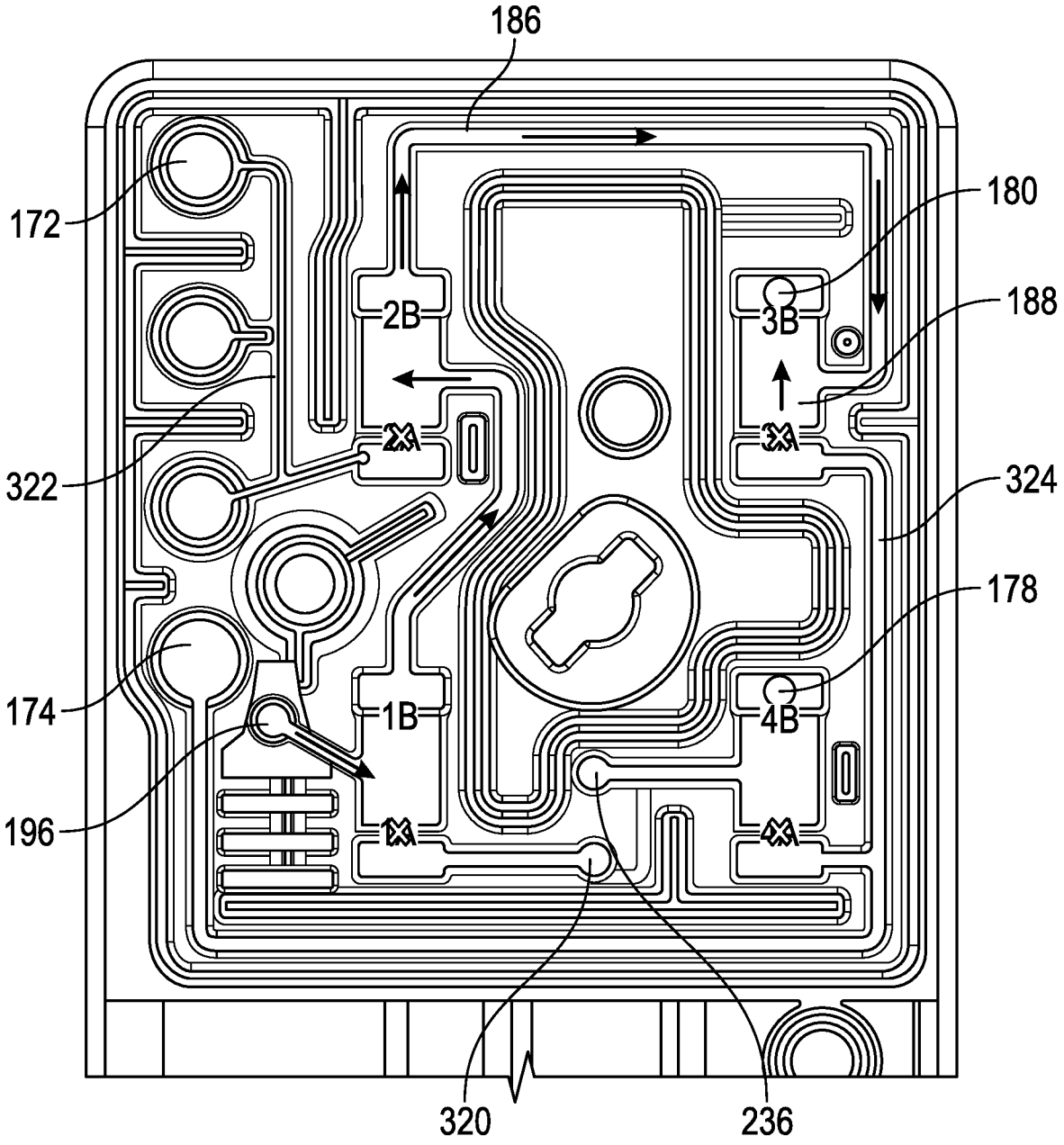
FIG. 59 illustrates the cartridge frame of FIG. 49 showing the valves and fluid flow paths in accordance with aspects of the present disclosure.

Next, the valves are reoriented 262. The next step is to add extra diluent to the receiving container 32 if necessary. Referring to FIG. 58, valve 2A is opened and valve 2B is closed to allow diluent to enter the system. Valve 1B is opened and valve 1A is closed, allowing the piston pump 166 to draw 264 diluent into the piston pump chamber 166 along the fluid pathway 186 designated by arrows. The vial 18 is locked out of the system by the closure of valve 1A. Once the diluent is in the piston pump 166, the next step commences as shown in FIG. 59. The valves 190 are reoriented 266. The vial 18 remains locked out of the system by the closure of valve 1A. Valve 1B remains open and valve 2A is closed to lock the diluent containers out of the system. Valve 2B is open allowing access to the fluid pathway 186 to the port 180 that leads to the receiving container 32. The pump 166 is actuated and pushes 268 the diluent along the fluid flow path 186 designated by the arrows and out the port 180 into the flexible tube 50 and into the receiving container 32.

Figure 60:
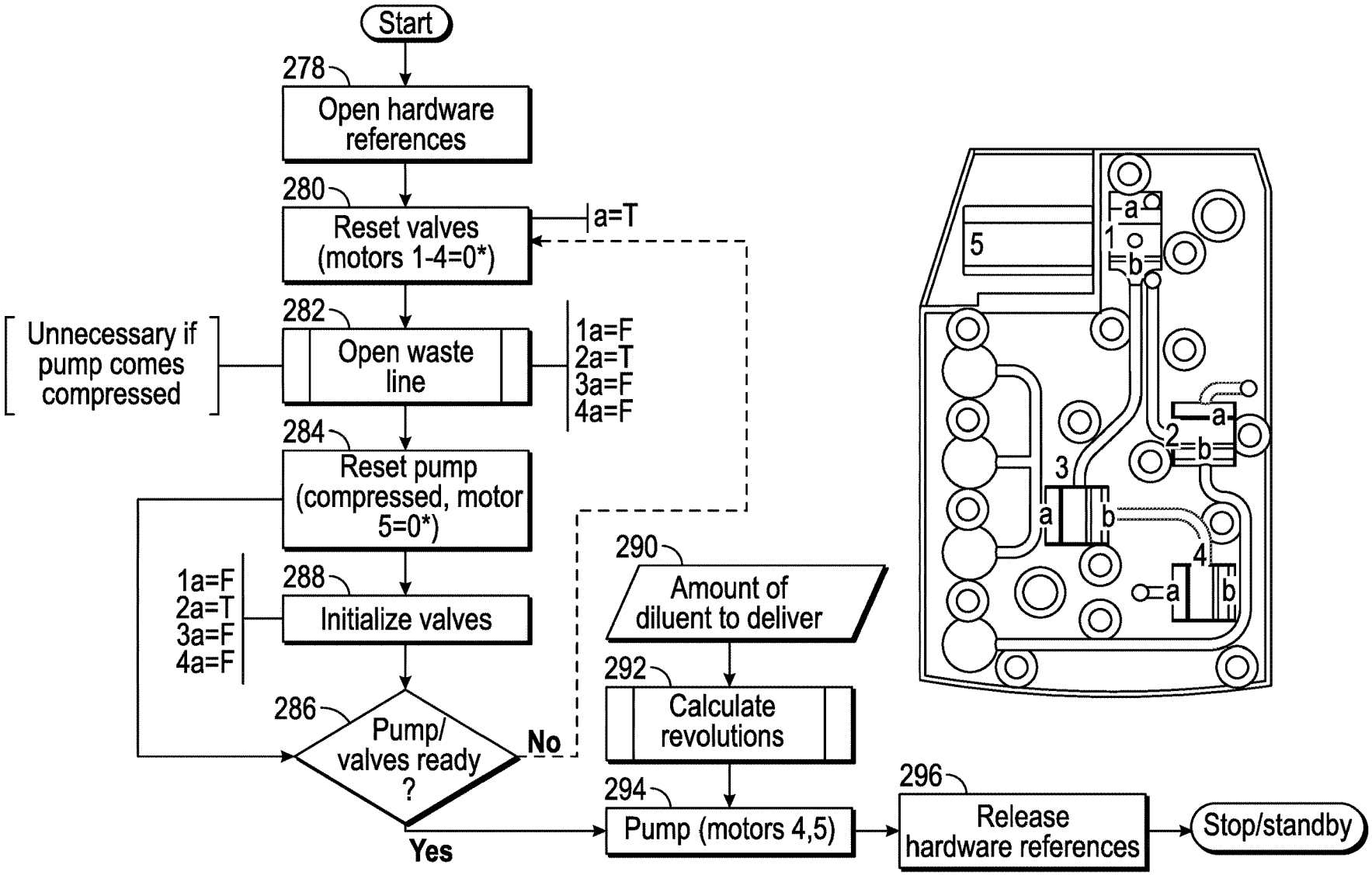
FIG. 60 is a flow chart illustrating the process of moving liquid from the receiving bag to the vapor waste bag in accordance with aspects of the present disclosure.
Figure 61:
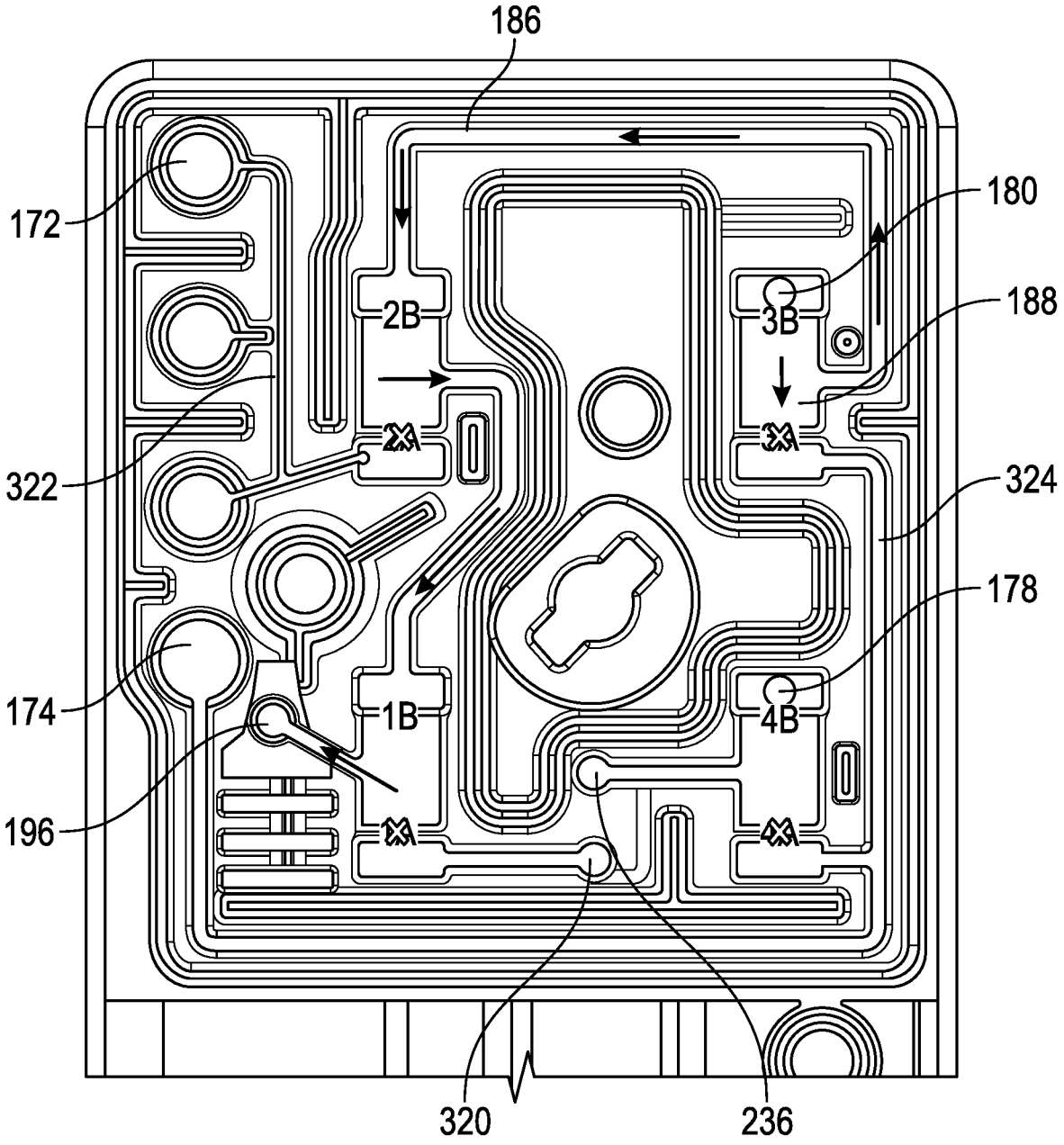
FIG. 61 illustrates the cartridge frame of FIG. 49 showing the valves and fluid flow paths in accordance with aspects of the present disclosure.
Figure 62:
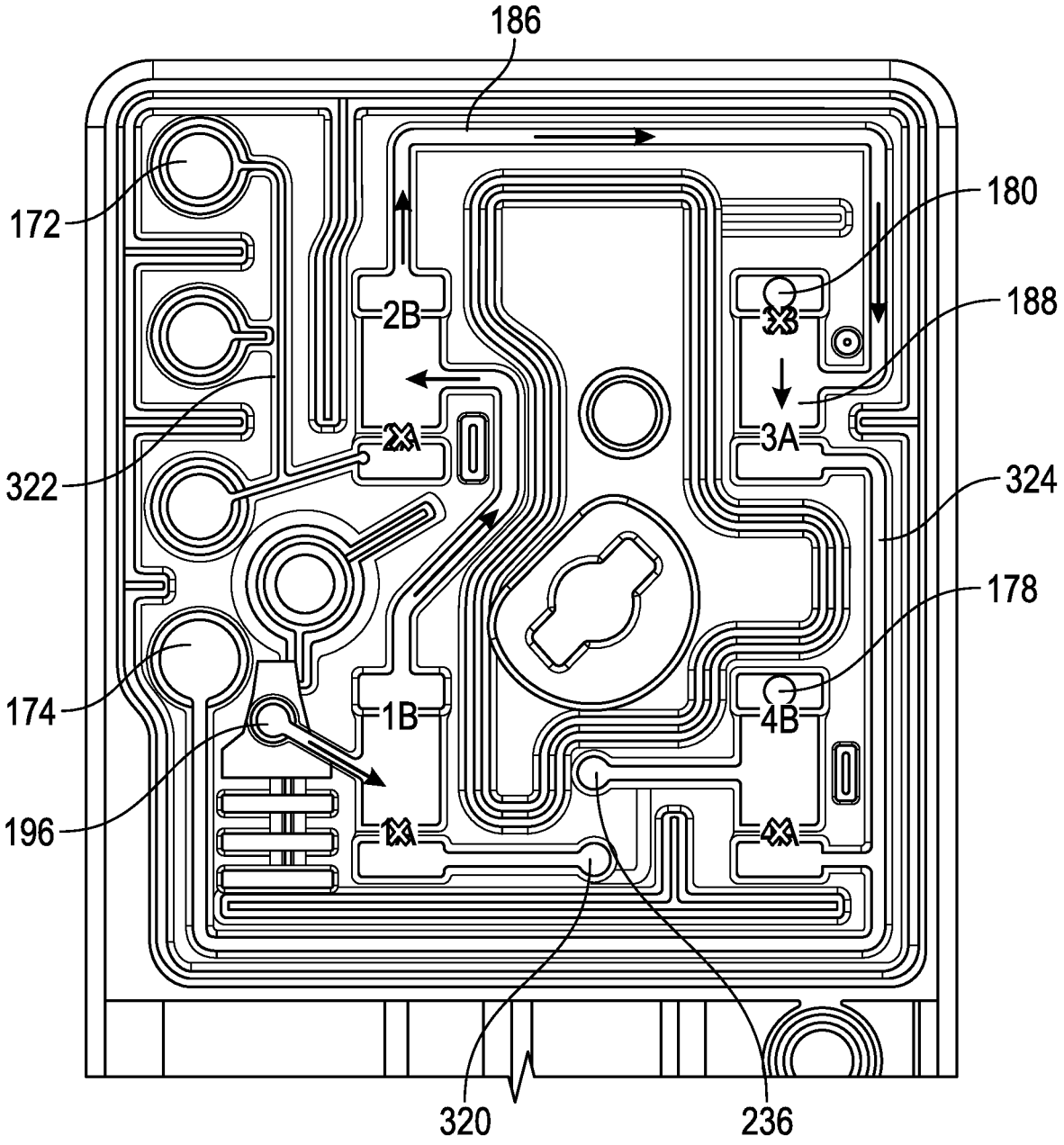
FIG. 62 illustrates the cartridge frame of FIG. 49 showing the valves and fluid flow paths in accordance with aspects of the present disclosure.
Figure 63:
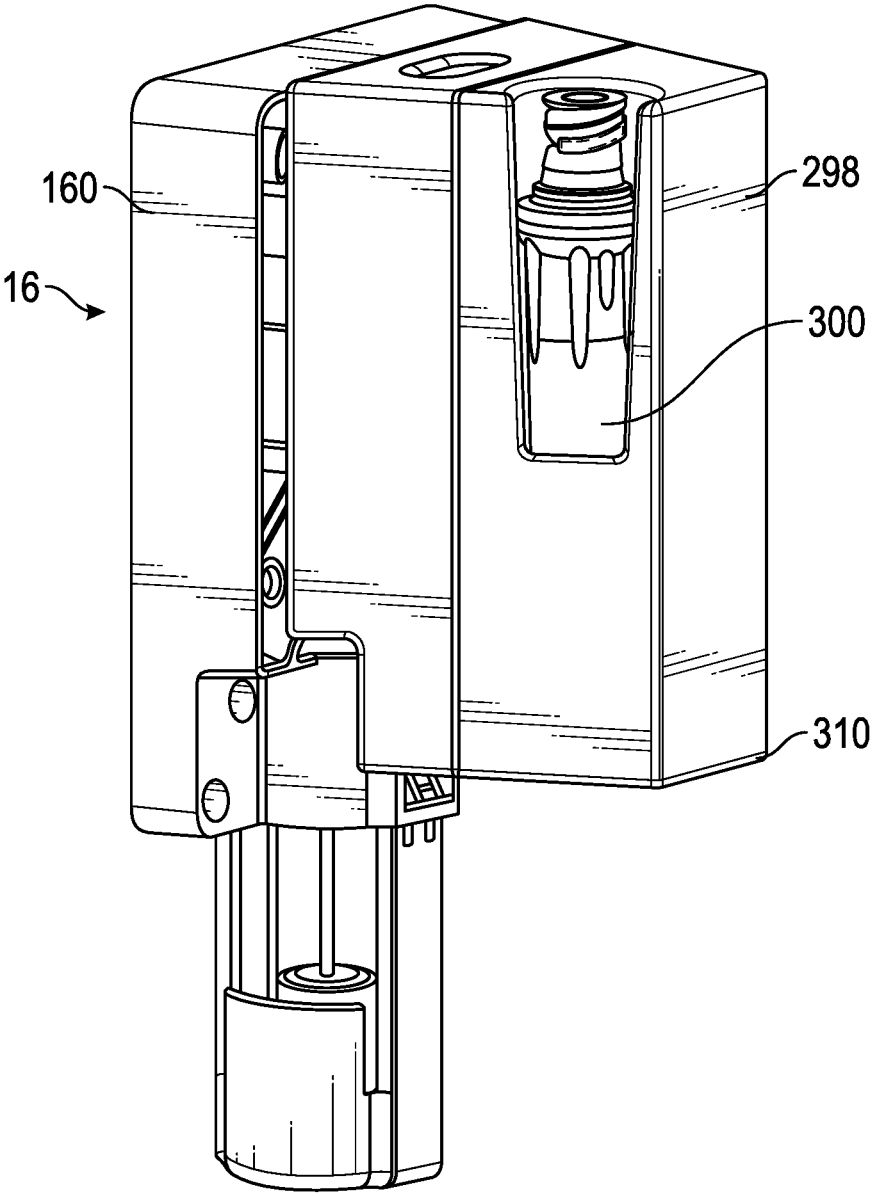
FIG. 63 illustrates a perspective view of an exemplary embodiment of a cartridge with a backpack attachment in accordance with aspects of the present disclosure.
Figure 64:
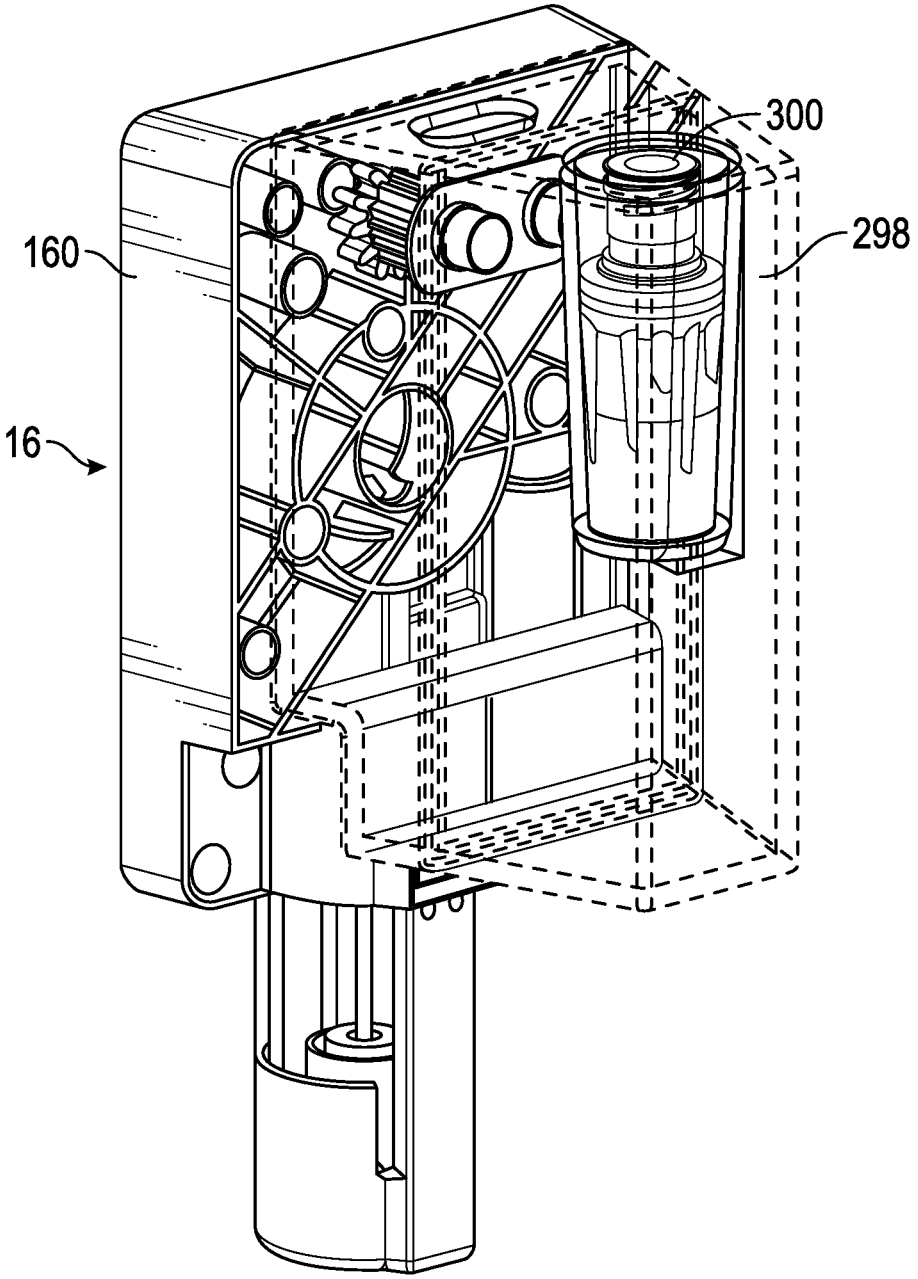
FIG. 64 illustrates a perspective view of the cartridge of FIG. 63 with a transparent backpack attachment in accordance with aspects of the present disclosure.
Figure 65:
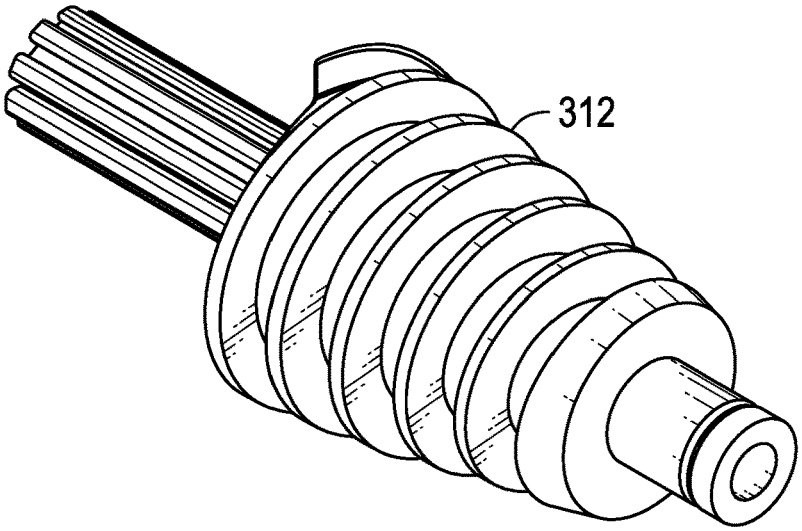
FIG. 65 illustrates a perspective view of a screw in accordance with aspects of the present disclosure.
Figure 66:
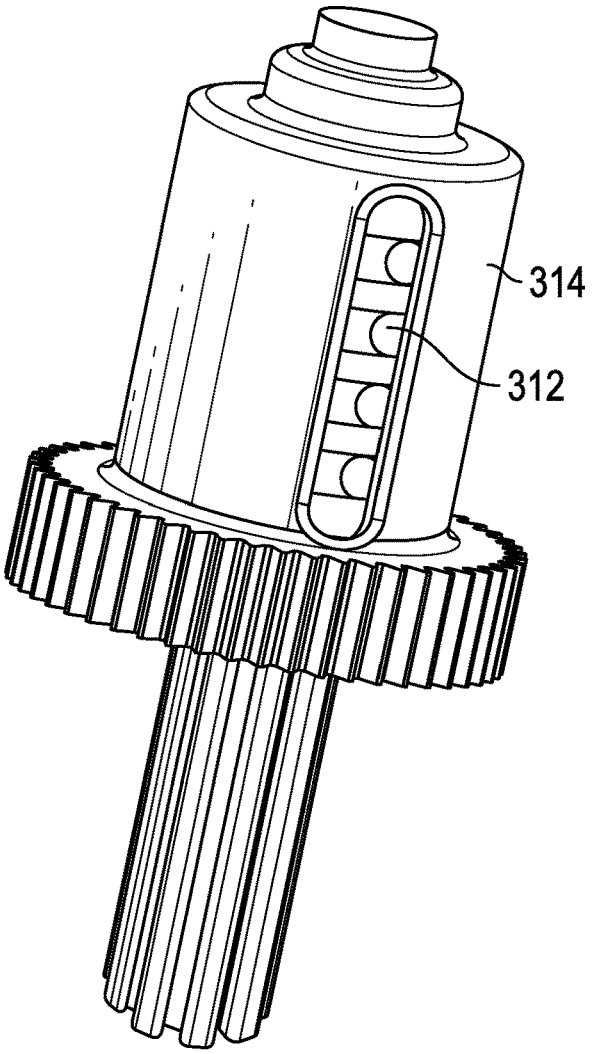
FIG. 66 illustrates a perspective view of the screw of FIG. 65 inside a screw chamber in accordance with aspects of the present disclosure.

Steps 270-276 may be performed as a QS process to remove extra fluid and/or vapor from the receiving container if necessary. FIG. 60 is a flow chart illustrating operations that may be performed as part of this QS process. As shown in FIG. 60, at step 278, the hardware references are opened. Next 280 the valves 190 are reset. Next 282 the waste line is opened. The pump is then reset 284 and the valves 190 are checked 286 to see if they are ready. If they are not, they are initialized 288 to their proper positions. The amount of diluent to deliver, if relevant, is calculated at step 290 and the proper number of revolutions of the drive shaft for the pump is calculated 292. The pump then runs 294 to perform the process and the hardware references are released 296.

Returning now to FIG. 51, at step 270, the valves are reoriented. For example, referring to FIG. 61, the diluent is locked out of the system by closure of valve 2A. Valve 3B is opened while valve 3A remains closed. Valve 1B is opened and the vial 18 is locked out of the system by the closure of valve 1A. The piston pump 166 is actuated and draws (step 272, FIG. 51) liquid from the receiving bag 32 into the pump chamber 176. The valves are reoriented 274. For example, as shown in FIG. 52, valve 2A remains closed to lock out the diluent. Valve 1B remains open and valve 1A remains closed. Valve 3B is closed and valve 3A is opened, allowing fluidic access to the vapor waste port 174 through the fluid flow path 186 designated by the arrow. Valve 1A is closed to keep the vial 18 locked out of the system. The piston pump 166 is actuated and the fluid is pumped 276 out of the piston pump chamber 176, through the flow paths 186 designated by the arrows, out of the cartridge 15 through the vapor waste port 174 and into the vapor waste container 44.

An alternative embodiment of the cartridge 16 utilizing a "backpack" to coil the flexible tubing 38 is illustrated in FIGS. 63-66. The backpack 298 is attached to the back 200 of the cartridge frame 16 and one end of the flexible tube 38 is attached to the outlet port 180 on the back 200 of the cartridge frame 16. The backpack 298 comprises a housing 310 with a screw 312 (as shown outside of the screw chamber 314 in FIG. 65 and inside the screw chamber 314 in FIG. 66) defined in a chamber 314 that can rotate to coil the flexible tubing 38. At the opposite end of the tubing is a connector 300 (e.g., an ISO Luer connector such as a Texium® attachment) that a user can pull out of the backpack 298 and attach to the receiving bag 32. In some embodiments, the tubing attached to the connector 300 may be automatically extended from within backpack 298 to facilitate attachment by the user. Upon completion of the filling of the bag 32, the screw mechanism 312 can draw the flexible tubing 38 back into the backpack 298 and out of the way so that the next cartridge 16 in the carousel 14 can be utilized. Retraction of the flexible tubing may be automatic once the ISO Luer is placed into the opening in the backpack.

Figure 67:
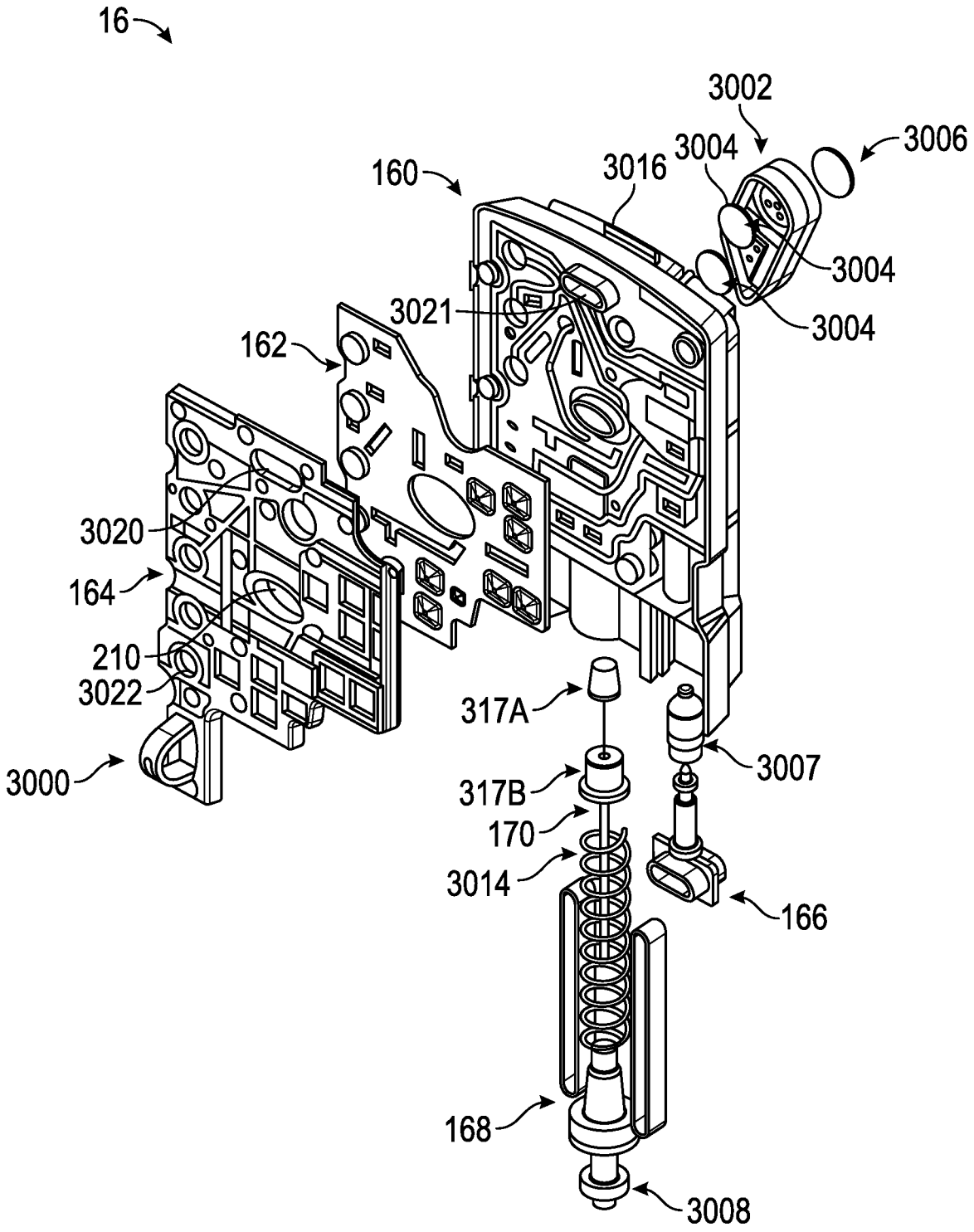
FIG. 67 illustrates an exploded perspective view of another embodiment of a pump cartridge in accordance with aspects of the present disclosure.

Turning now to FIG. 67, an exploded perspective view of another embodiment of cartridge 16 shows the three main portions of the cartridge 16: the cartridge frame 160, the cartridge sealing membrane 162, the cartridge bezel 164, as well as the piston pump 166, the needle housing 168 and the needle assembly 170. In the example of FIG. 67, cartridge bezel 164 includes an additional opening 3022 to provide access to a pressure dome formed on membrane 152 to allow sensing of pressure in the fluid pathways of cartridge 16. An air-in-line sensor fitment 3000 is also provided that is configured to mate with an air-in-line (AIL) sensor in the compounder.

In order to control the flow of gasses such as vapor waste and sterile air within the cartridge, cartridge 16 may be provided with gas flow control structures such as an air filter 3005 and one or more check valve discs 3004 that mount to frame 160 with a check valve cover 3002. Air filter 3006, check valve discs 3004, and check valve cover 3002 may cooperate to allow vapor waste to flow in only one direction from the vial to the waste port and to allow sterile (filtered) air to flow in only one direction into the cartridge from a vent adjacent the air filter to the vial. In this way, unwanted vapor waste may be prevented from flowing out of the pump cartridge and may be instead guided to a vapor waste container.

As shown in FIG. 67, piston 165 may include a piston boot 3007 that, for example, provides one or more moveable seals (e.g., two moveable seals) for controlling the volume of a pump chamber when piston 166 is actuated, FIG. 67 also shows various structures for control of another embodiment of needle housing 168 in which needle assembly 170 includes a dual lumen needle with a first needle overmold 317A, a second needle overmold 317B, a needle spring 3014, and a needle membrane 3008. An opening 3020 in bezel 154 may be provided that aligns with a corresponding opening 3021 in frame 160 to allow a view through cartridge 16 (e.g., by a sensor of the pump drive mechanism) into a backpack that is mounted to cartridge 16 as will be described in further detail hereinafter. A protrusion 3016 formed on a top side of cartridge frame 160 may be provided as a mounting structure for the backpack.

Figure 68A:
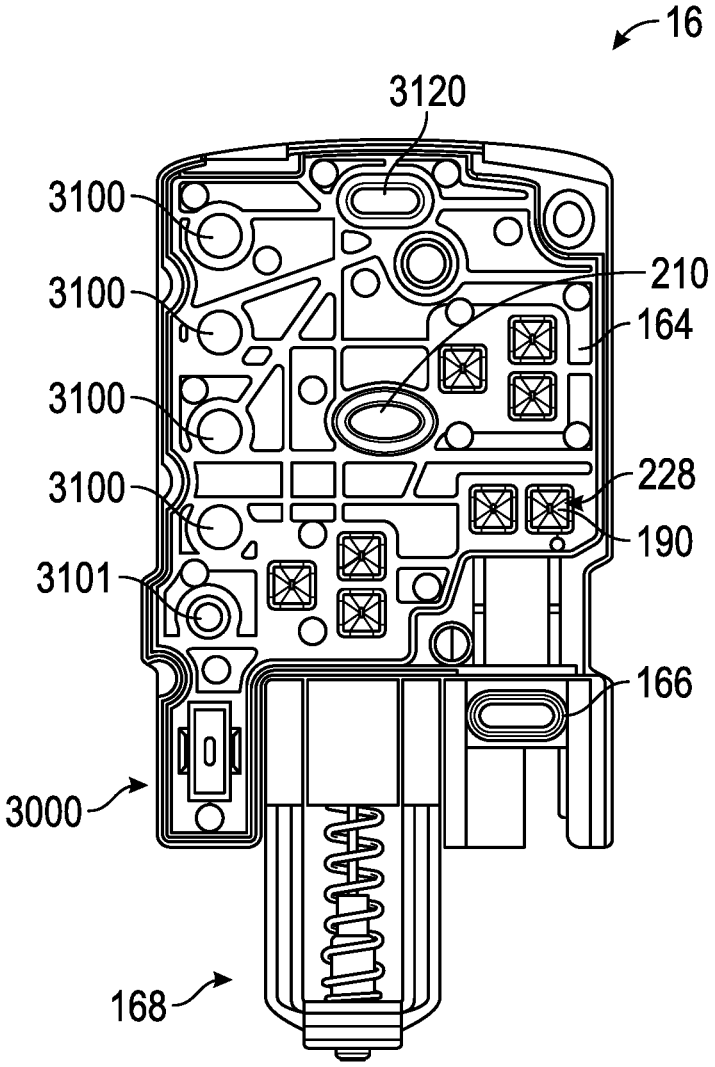
FIG. 68A illustrates a rear plan view of the cartridge of FIG. 67 in accordance with aspects of the present disclosure.
Figure 68B:
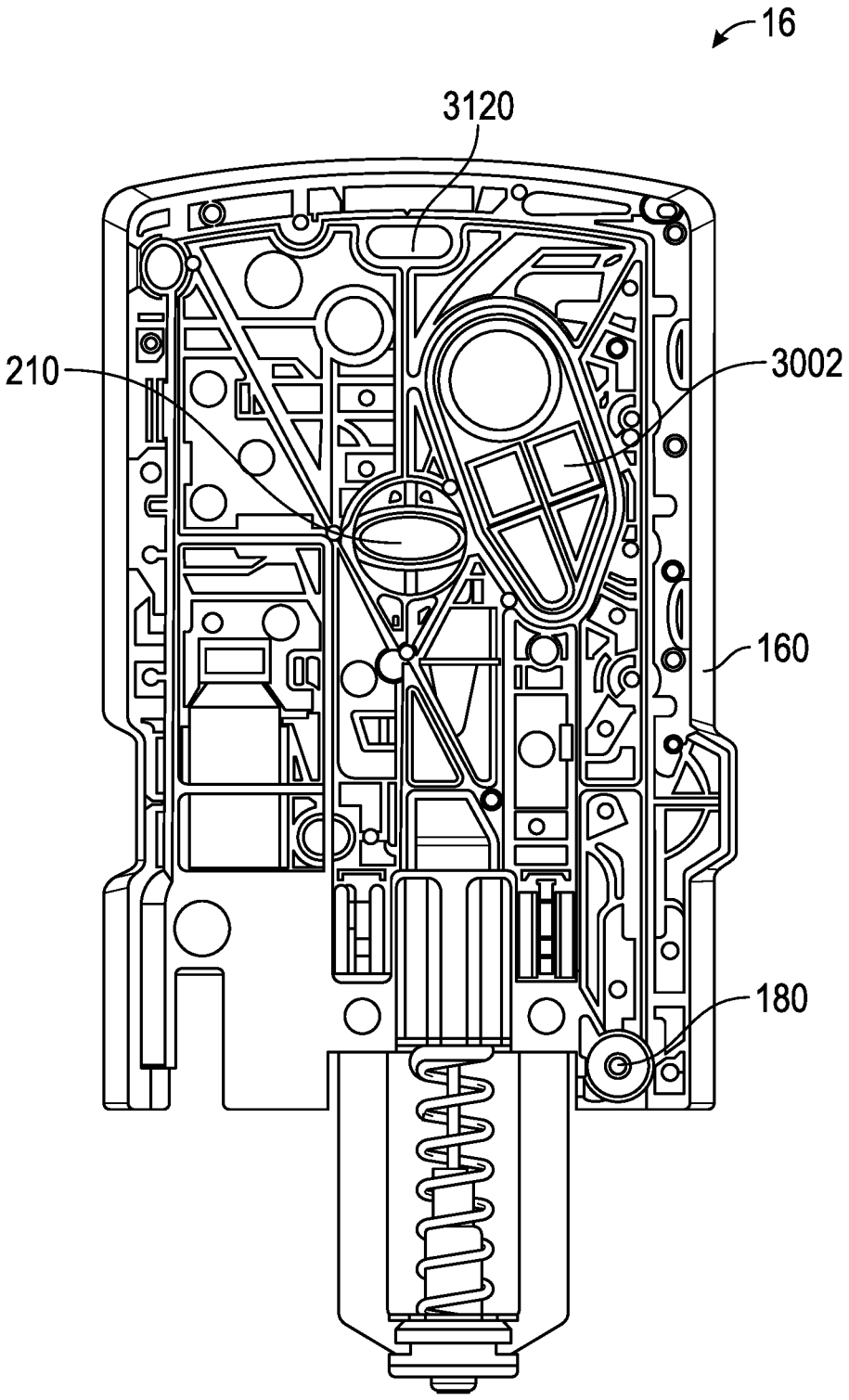
FIG. 68B illustrates a front plan view of the cartridge of FIG. 67 in accordance with aspects of the present disclosure.

FIGS. 68A and 68B show assembled views of the cartridge embodiment shown in FIG. 67 from the bezel side and frame side respectively in which an opening 3120 (formed by openings 3020 and 3021 of FIG. 67) that allows a view completely through cartridge 16 can be seen. As shown in FIG. 68A, in some embodiments, cartridge 16 may include four diluent and waste ports 3100 and a pressure dome 3101. For example, three of the ports 3100 may be configured as diluent ports and one of the ports 3100 may be configured as a waste port. A pressure sensor in the pump head assembly 28 may determine pressure within the fluid pathways in cartridge 16 by contacting pressure dome 3101. Each of the ports 3100 may be formed from an opening in bezel 154 and a chamber located behind a portion of membrane 162 in frame 160.

Figure 69:
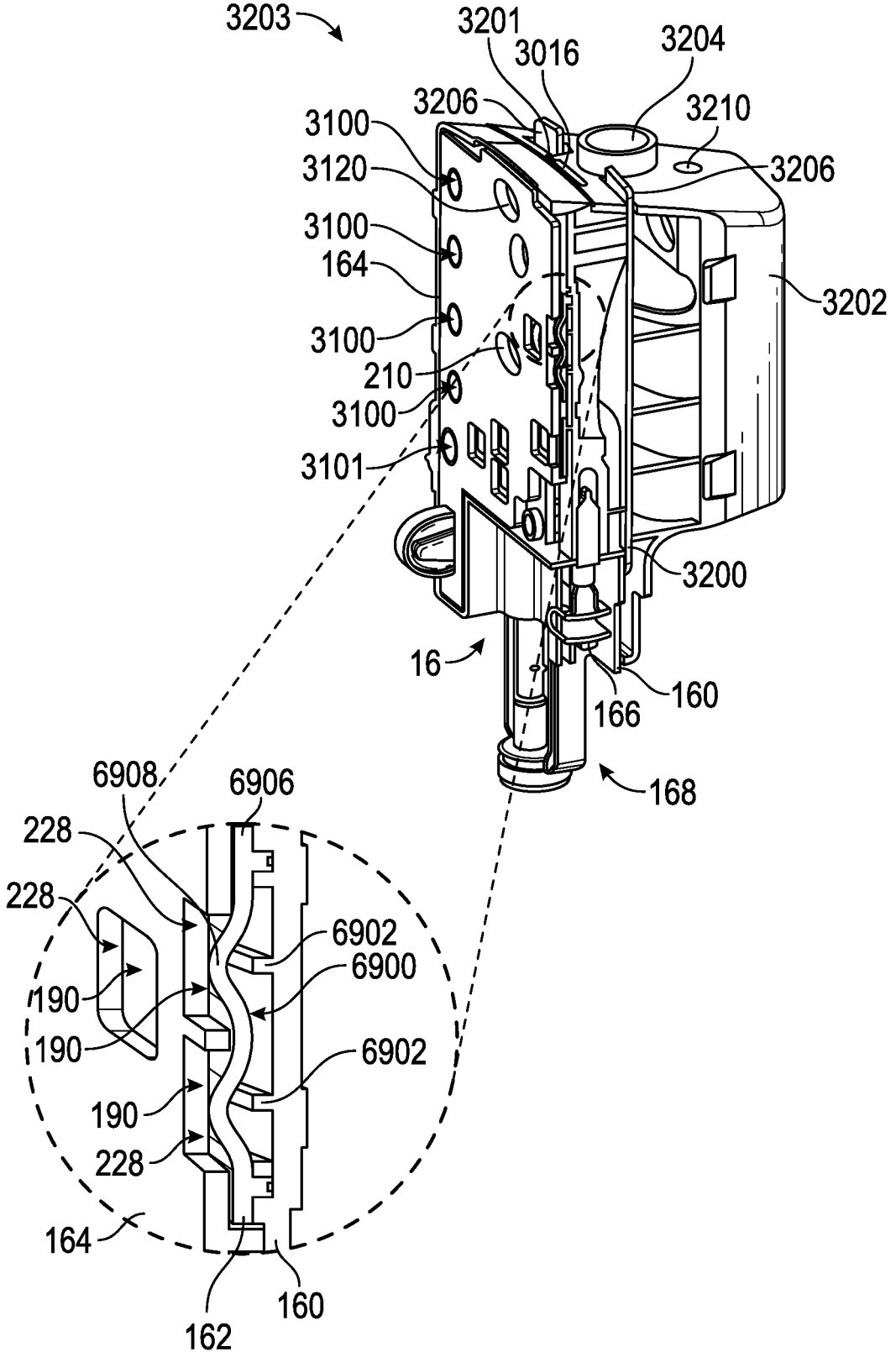
FIG. 69 illustrates a cross-sectional perspective view of the cartridge of FIG. 67 with an attached backpack in accordance with aspects of the present disclosure.

FIG. 69 is a cross-sectional perspective side view of an assembled cartridge 16 having a backpack 3202 (e.g., an implementation of backpack 2900 of FIG. 29) attached thereto to form a cartridge and backpack assembly 3203. As shown in FIG. 69, protrusion 3016 may extend into an opening 3201 in the backpack 3202 to latch the backpack to cartridge 16 at the top side. Additional latching structures at the bottom side will be described in further detail hereinafter. An additional structure 3200 may be disposed between backpack 3202 and cartridge 16. Structure 3200 may be substantially planar and may be shaped and positioned to latch cartridge and backpack assembly 3203 to carousel 14. For example, protrusions 3206 that extend from the top of the backpack 3202 may be actuatable to facilitate installation and removal of the cartridge and backpack assembly into and out of the carousel. For example, ramp structures on the carousel may compress protrusions 3206 when cartridge and backpack assembly 3203 is pushed into the carousel until protrusions 3206 snap up into a locked position to secure the cartridge and backpack assembly in the carousel. To remove cartridge and backpack assembly 3203 from the carousel for compounding operations, a bayonet 128 that extends into opening 210 may be turned to lower protrusions 3206 to release the cartridge and backpack assembly from the carousel. Further features of the coupling of cartridge and backpack assembly 3203 to the carousel will be described hereinafter.

Tubing (e.g., flexible tubing 38) for fluidly coupling cartridge 16 to a receiving container 32 may be housed within backpack 3202. For example, the tubing may be coupled at an output port 180 (e.g., a receiving container port—see, e.g., FIG. 58B) to cartridge 16, coiled within an internal cavity of backpack 3202, and extend through opening 3210 so that an end of the tubing can be pulled by an operator to extend the tubing for coupling to the receiving container. An additional opening 3204 may be provided within which a connector such as a Texium® connector coupled to the end of the tubing can be stored when the cartridge and backpack assembly is not in use. When instructed (e.g., by onscreen instructions on display 86) an operator may remove the connector from opening 3204, pull the tubing from within backpack 3202, and connect to the connector to a receiving container. For example, processing circuitry of the compounder system may provide instructions, using the display, to (a) remove a connector that is coupled to the tubing from an additional opening in the backpack, (b) pull the tubing from the backpack, and (c) connect the connector to the receiving container. In another embodiment, extension of the flexible tubing is automatic (e.g., software determines the precise moment the flexible tube should be extended, the pump head operates screw mechanism to extend the tubing, and a signal to the user to pull the ISO Luer out of the backpack opening is provided). Compounder 10 may include a sensor such as an optical sensor that determines whether the connector is present within opening 3204 (e.g., by viewing the connector through opening 3120).

Compounder 10 may determine, based on whether the connector is within opening 3204, whether and when to release the cartridge and backpack assembly from the pump head assembly. For example, following compounding operations, an operator may be instructed to remove the connector from the receiving container and return the connector into opening 3204. Backpack 3202 may include features and components for facilitating the storage and extraction of the tubing from within the internal cavity. When the connector is detected in opening 3204, the pump drive mechanism 20 may operate one or more coiling mechanisms within backpack 3202 to pull the extended tubing back into the backpack and may turn the bayonet to lower protrusions 3206 so that the cartridge and backpack assembly can be returned to the carousel.

FIG. 69 also shows an enlarged view of a portion of cartridge 16 with the cross-section taken through two of valves 190. As shown in the enlarged view, each valve 190 may be formed from a raised portion 6908 of sealing membrane 162 that extends from a planar portion 6906 of sealing membrane 162 into a corresponding opening 228 in cartridge bezel 164. In the example shown in, for example, FIGS. 67-69, raised portion 6908 is a pyramid-shaped dome formed in opening 228. In a portion of the fluid path 6900 formed between sealing membrane 162 and frame 160 adjacent each valve 190, frame 160 may include a rib 6902 in spaced opposition to the raised portion 6908 of the sealing membrane for that valve. When raised portion 6908 is in a raised position as illustrated in FIG. 69, fluid and/or vapor can flow over rib 6902 through the open valve. In operation, a valve actuator 84 that extends from and is operable by pump head assembly 28 can extend through opening 228 to compress raised portion 6908 against rib 6902 to close the valve and prevent fluid from flowing therethrough.

Figure 70:
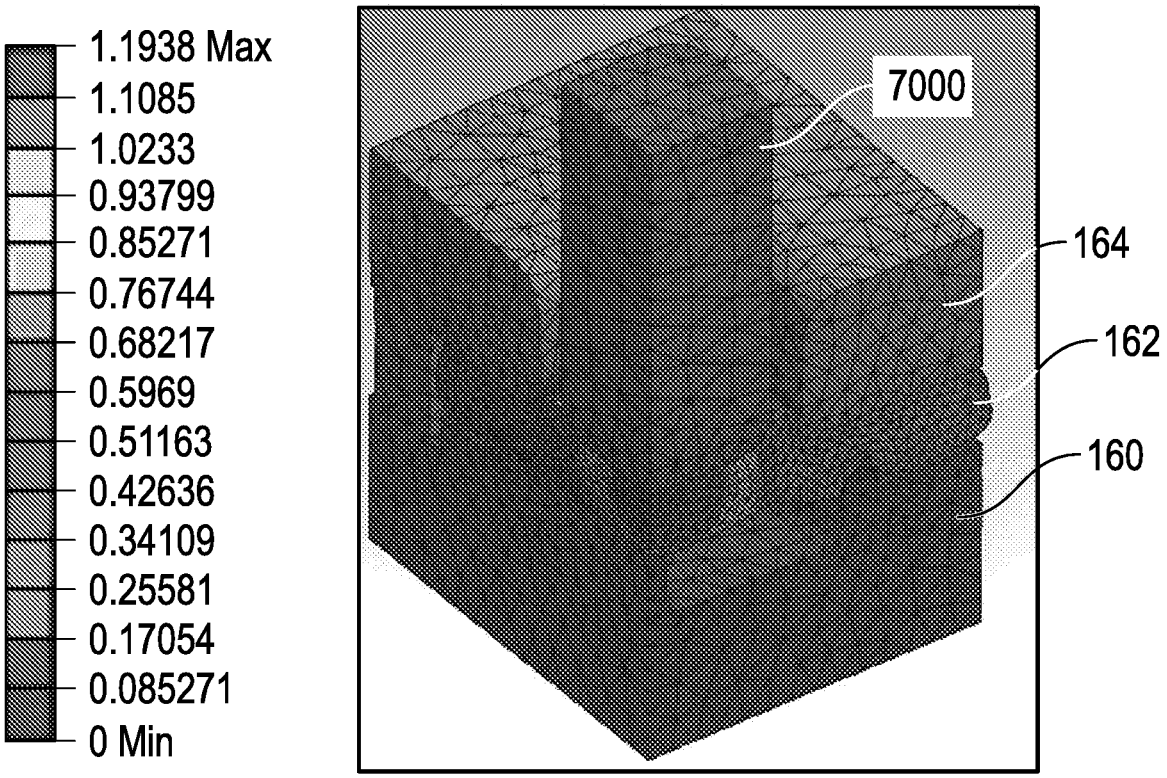
FIG. 70 illustrates a finite element representation of a valve and valve actuator for a cartridge in accordance with aspects of the present disclosure.

FIG. 70 shows a finite element representation of a cross-sectional view of a portion of a valve 190 in which sealing membrane 162 is compressed against cartridge frame 160 by valve actuator 7000 (e.g., one of valve actuators 84) to close the valve. Finite-element analysis indicates that providing a valve having a raised portion 6908 in, for example, the form of a pyramid-shaped dome may allow valves 190 to be operated with relatively less stress in comparison with a flat membrane valve and may therefore provide longer lasting valves. The reduced stresses may allow membrane 162 to be formed from relatively less expensive or easier to work with materials such as polyisoprene or thermoplastic elastomeric (TPE) materials.

Figure 71:
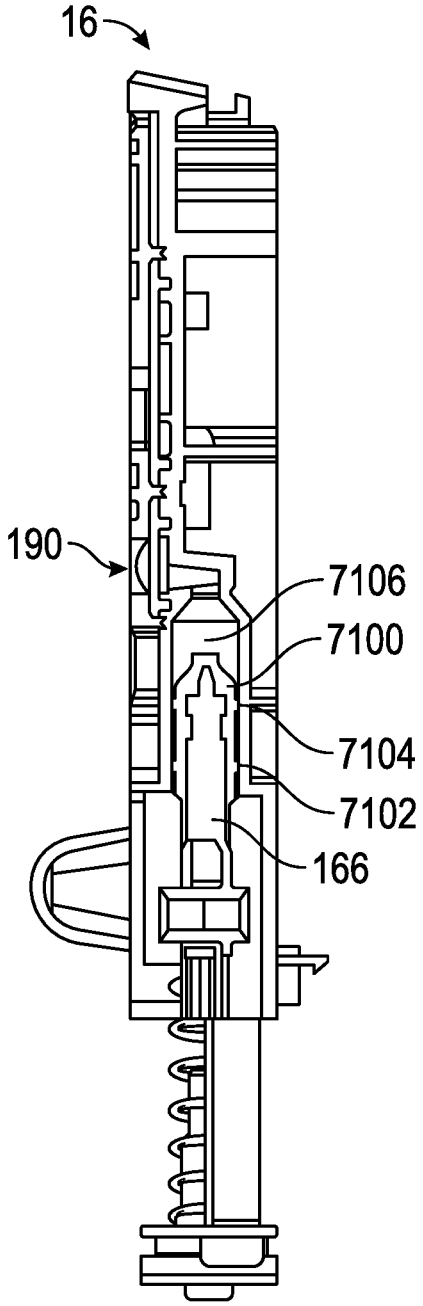
FIG. 71 illustrates a cross-sectional side view of the cartridge of FIG. 67 in accordance with aspects of the present disclosure.

FIG. 71 is a cross-sectional side view of the cartridge of FIG. 67 showing piston pump 166. As shown in FIG. 71, piston pump 166 may include a silicon boot 7100 having first and second seals 7102 and 7104. Forward seal 7104 may form a moving boundary of a pump chamber 6106. Rearward seal 7102 may prevent dust or other contaminants from contacting forward seal 7104. Pump chamber 7106 may be formed adjacent one or more valves 190 (e.g., a pair of valves may be disposed on opposing sides of the pump chamber to control fluid flow into and out of the pump chamber). The operation of valves 190 in cooperation with piston pump 166 are described in further detail hereinafter in connection with, for example, FIGS. 72-77.

Figure 72:
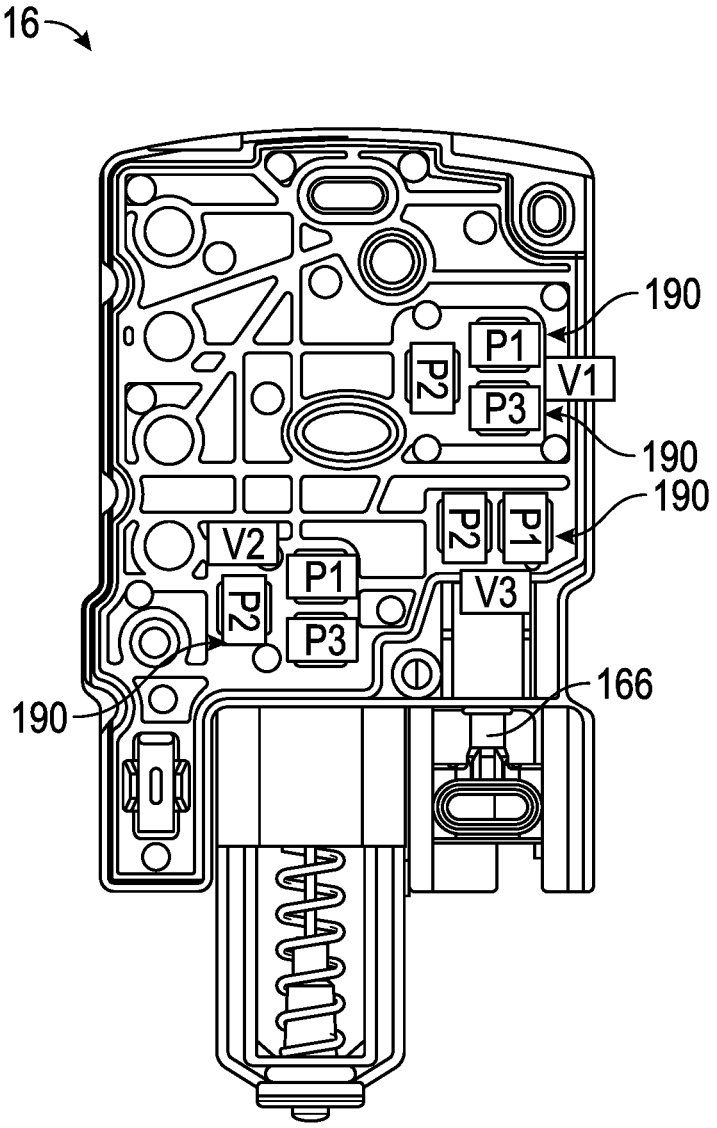
FIG. 72 illustrates the cartridge of FIG. 67 showing the valves and fluid flow paths in accordance with aspects of the present disclosure.

In FIG. 72, for purposes of discussion herein, valves 190 are labeled in three valve groups V1, V2, and V3. Valve group V1 may be a diluent valve group having three valves P1, P2, and P3. Valve group V2 may be a reconstitution valve group having three valves P1, P2, and P3. Piston pump valves P1 and P2 of valve group V3 (e.g., a piston pump valve group) may be operated alternately in cooperation with piston pump 166. For example, during a forward stroke of piston pump 166, valve V1/P1 may be closed and valve V3/P2 may be open and during a backward stroke of piston pump 166, valve V1/P1 may be open and valve V3/P2 may be closed to pump fluid in a first direction within the fluid pathways of cartridge 16. In another example, to pump fluid in an opposite, second direction within the fluid pathways of cartridge 16, during a forward stroke of piston pump 166, valve V3/P1 may be Open and valve V3/P2 may be closed and during a backward stroke of piston pump 166, valve V3/P1 may be closed and valve V3/P2 may be open.

Figure 73:
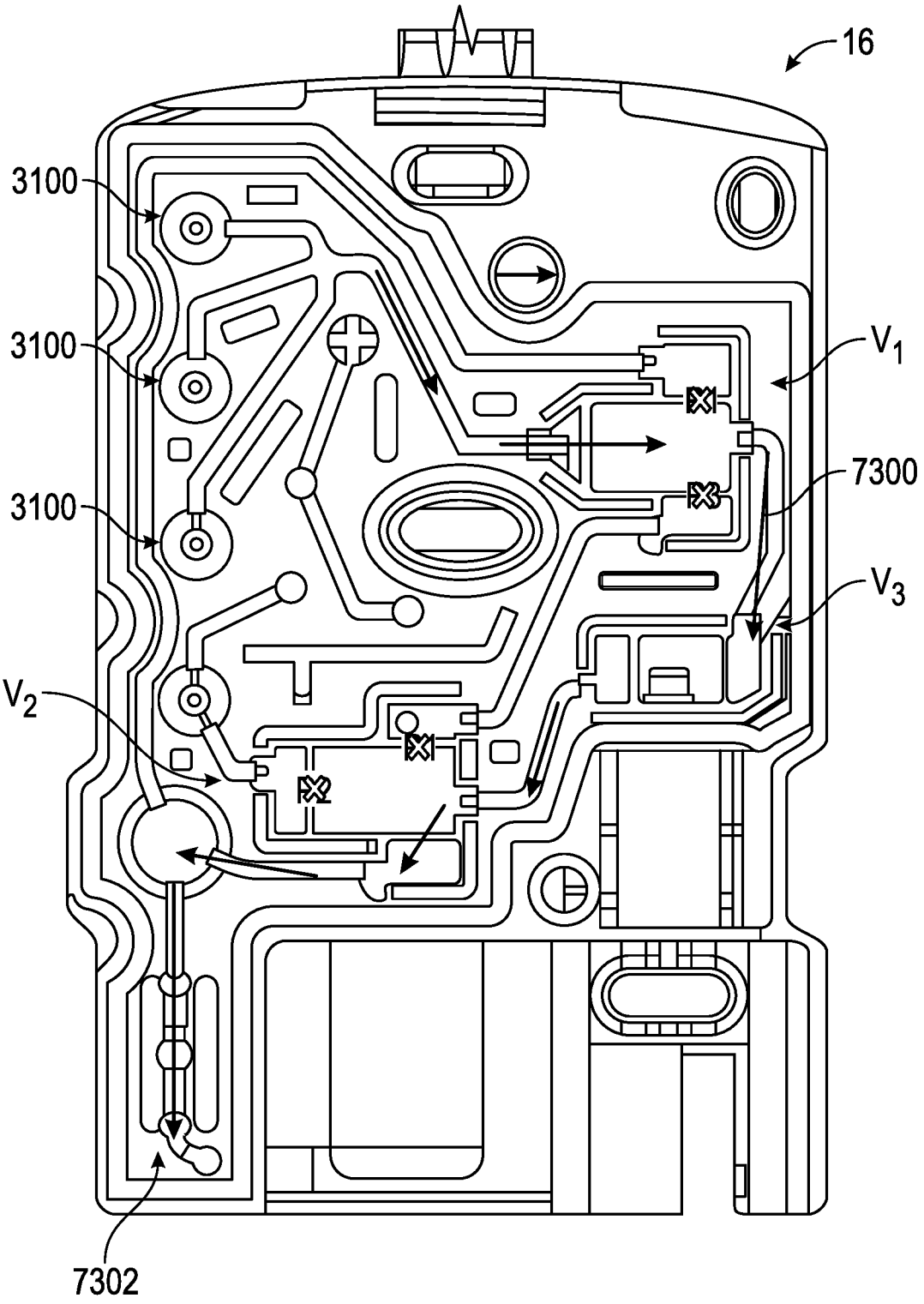
FIG. 73 illustrates the cartridge of FIG. 67 showing a valve configuration for a diluent to receiving container fluid path in accordance with aspects of the present disclosure.

FIGS. 73-76 show various examples of valve configurations for pumping fluids through cartridge 16 for various portions of a compounding operation using the valve labels shown in FIG. 72 for reference. In the example of FIG. 73, the valves of valve groups V1 and V2 are configured for pumping diluent from a diluent container directly to a receiving container (e.g., valves P1 and P3 of group V1 are closed, valve P2 of group V1 is open, valves P1 and P2 of group V2 are closed, and valve P3 of group V2 is open to form a fluid path 7300 from one of diluent ports 3100 to receiving container port 7302).

Figure 74:
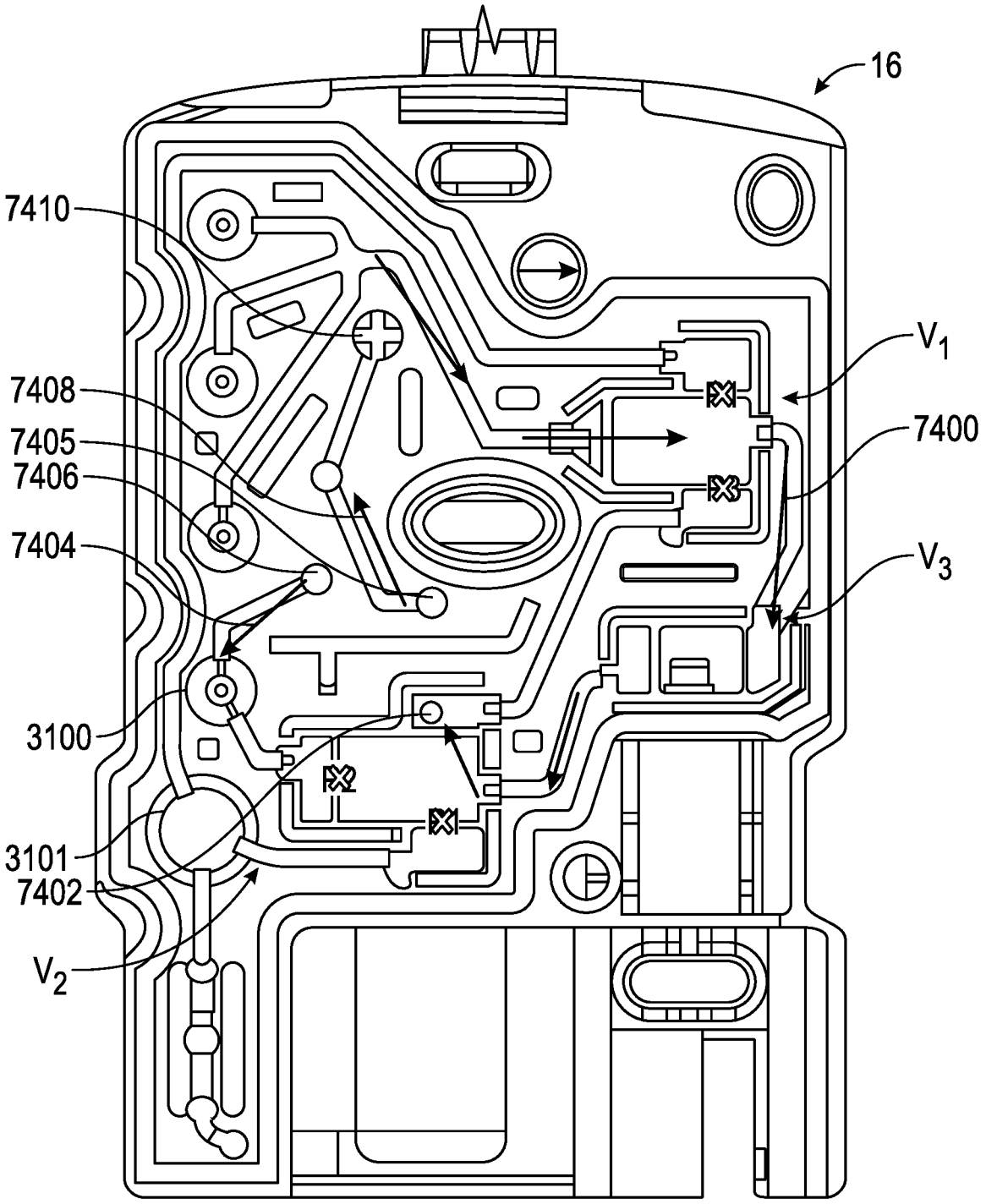
FIG. 74 illustrates the cartridge of FIG. 67 showing a valve configuration for a reconstitution fluid path through in accordance with aspects of the present disclosure.

In the example of FIG. 74, the valves of valve groups V1 and V2 are configured for pumping diluent from a diluent container to a vial for reconstitution operations (e.g., valves P1 and P3 of group V1 are closed, valve P2 of group V1 is open, valves P2 and P3 of group V2 are closed, and valve P1 of group V2 is open to form a fluid path 7400 from one of diluent ports 3100 to vial port 7402). As shown, during reconstitution operations, a hazardous vapor path 7404 may be formed from a vial waste port 7406 to waste port 3100 to be provided to waste container 44. In some embodiments, a non-hazardous waste path 7408 may be provided from a non-hazardous vial waste port 7405 to air filter port 7410. However, this is merely illustrative. In some embodiments, air filter port 7410 may be associated with air filter check valve structures 3004, 3004, and 3006 that prevent flow of any vapor waste along path 7408 and ensure that all vapor waste from vial 18 is moved along path 7404 through waste port 3100.

Figure 75:
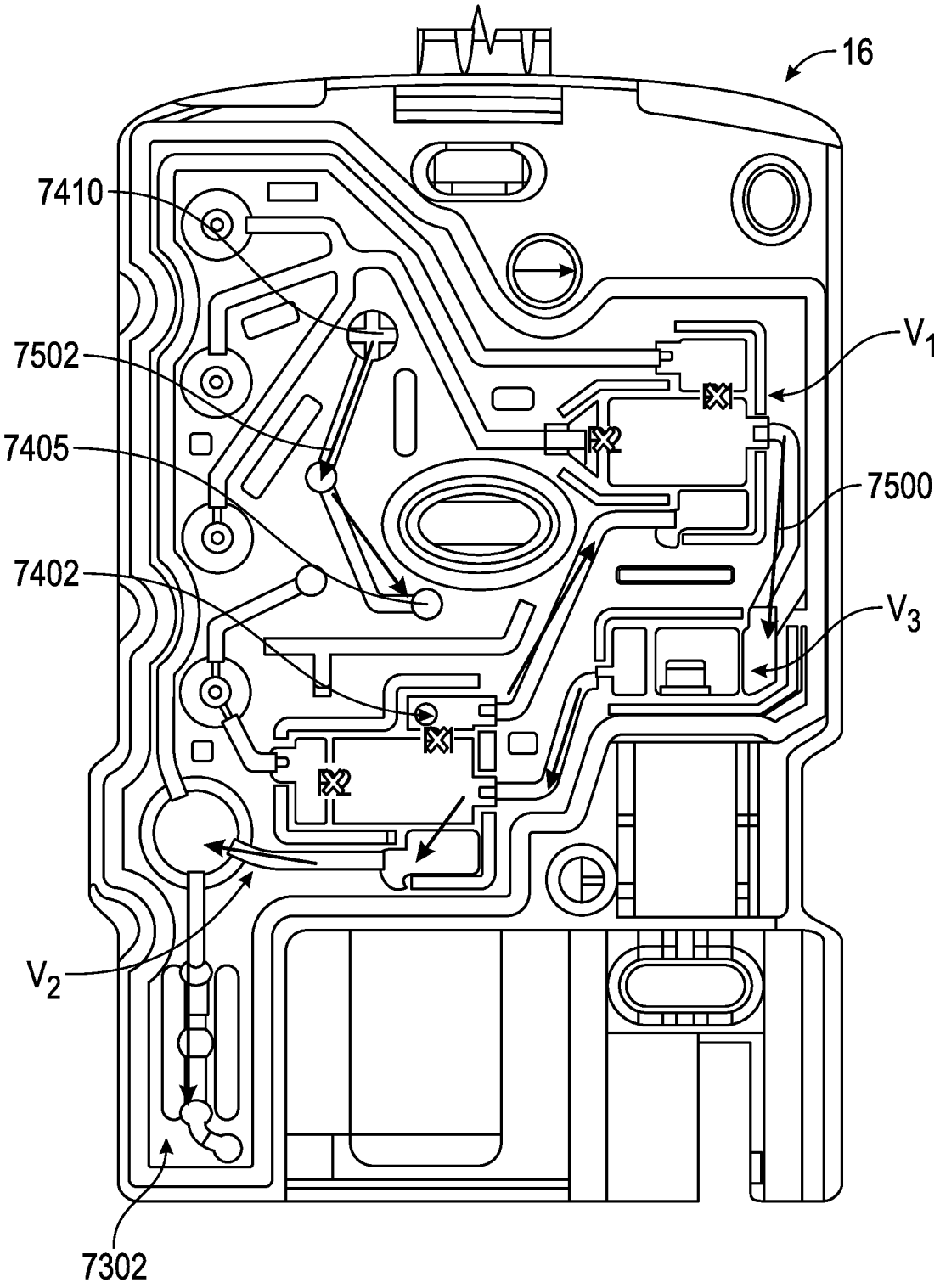
FIG. 75 illustrates the cartridge of FIG. 67 showing a valve configuration for a compounding fluid path from in accordance with aspects of the present disclosure.

In the example of FIG. 75, the valves of valve groups V1 and V2 are configured for pumping a reconstituted drug from a vial to a receiving container for compounding operations (e.g., valves P1 and P2 of group V1 are closed, valve P3 of group V1 is open, valves P1 and P1 of group V2 are closed, and valve P3 of group V2 is open to form a fluid path 7500 from vial port 7402 to receiving container port 7302). As shown, during compounding operations, a path 7502 may be formed from air filter port 7410 to non-hazardous vapor vial port 7405 to provide filtered, sterile air from outside cartridge 16 into the vial to prevent a vacuum from being generated when the drug is pumped from the vial.

Although the receiving container 32 is shown in, for example, FIGS. 1, 3, 24, and 25 as an IV bag, in some scenarios, the receiving container 32 may be implemented as a syringe. For example, a Texium® connector coupled by tubing to an output port such as receiving container port 7302 may be connected to a needle free valve connector such as a SmartSite® connector, the SmartSite® connector being coupled by additional tubing to another needle free valve connector (e.g., another SmartSite® connector) that is connected to a syringe for receiving a reconstituted drug. In scenarios in which the receiving container is a syringe, it may be desirable, after pumping the drug from the vial into the syringe, to remove air or other vapors from the syringe.

Figure 76:
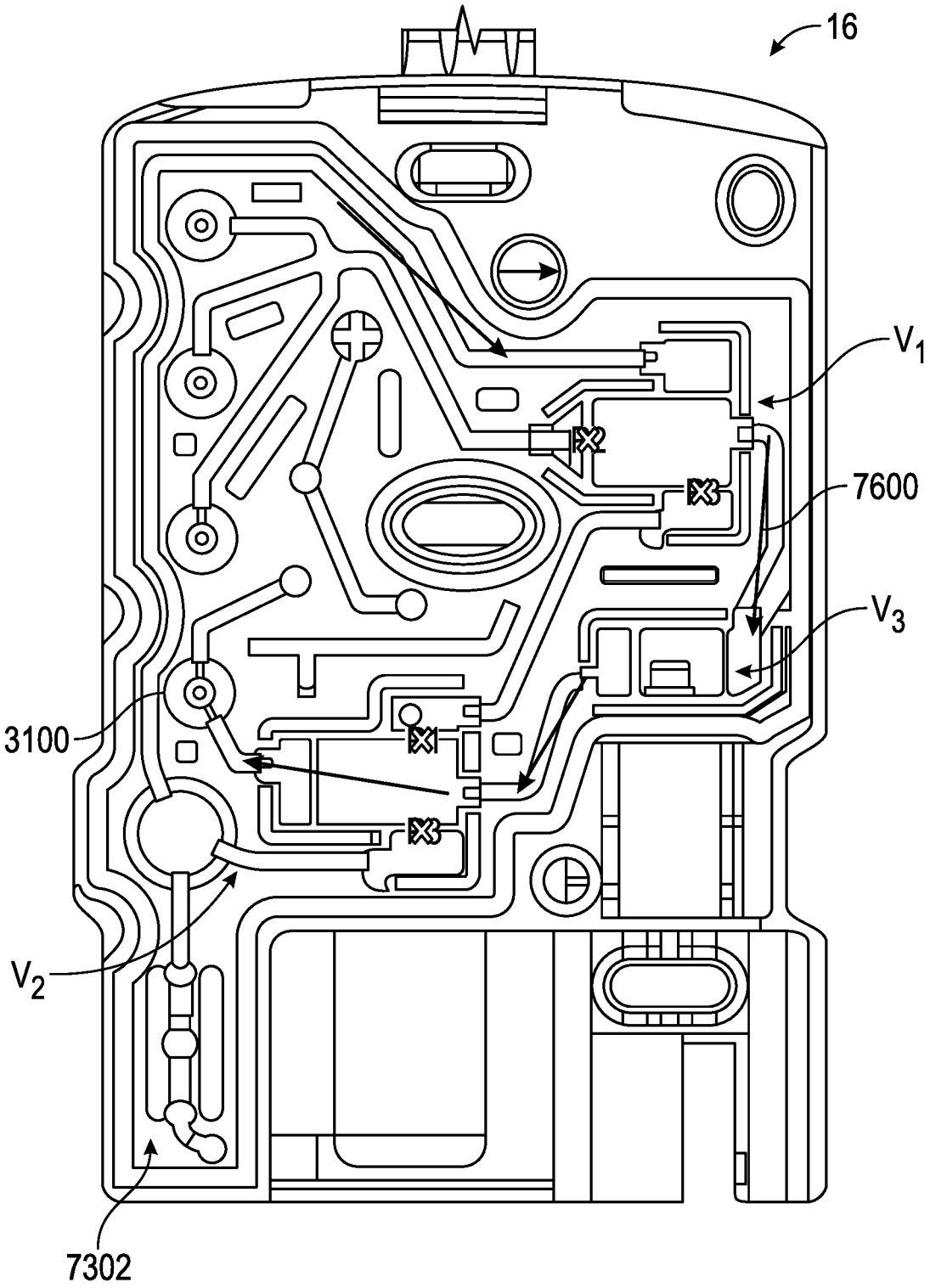
FIG. 76 illustrates the cartridge of FIG. 67 showing a valve configuration for an air removal fluid path in accordance with aspects of the present disclosure.

In the example of FIG. 76, the valves of valve groups V1 and V2 are configured for pumping air from a receiving container such as a syringe (e.g., valves P1 and P3 of group V1 are closed, valve P2 of group V1 is open, valves P2 and P3 of group V2 are closed, and valve P1 of group V2 is open to form a fluid path 7600 from receiving container port 4302 to waste port 3100). In each of the configurations of FIGS. 73-76, the valves P1 and P2 of group V3 may be alternately opened and closed in cooperation with the motion of piston pump 166 to move the desired fluid or vapor along the fluid pathways defined by valves 190.

FIG. 77 is a chart showing the position and operation of the valves 190 as labeled in FIG. 72 during various portions of a reconstitution/compounding process as described above in connection with FIGS. 73-76.

Figure 78:
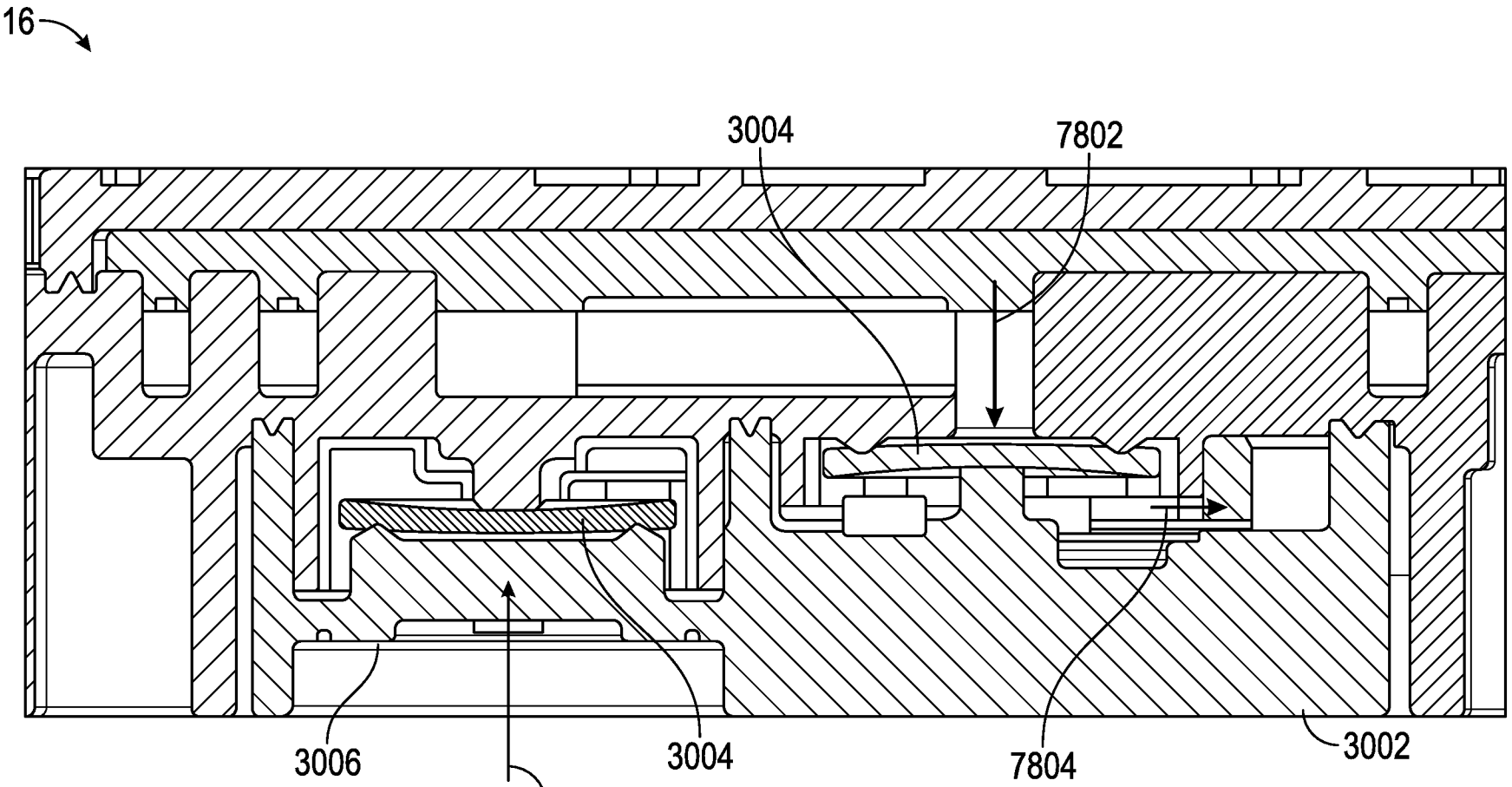
FIG. 78 illustrates a cross-sectional view of the cartridge of FIG. 67 taken through an air filter in accordance with aspects of the present disclosure.

FIG. 78 is a cross-sectional top view of cartridge 16 taken through air filter housing 3002 along a line that passes through both check valve discs 3004. As shown in FIG. 78, a first one of check valve discs 3004 may be aligned with air filter 3006 and may have a concave side facing the air filter. In this way, that disc 3004 may form a check valve that allows filtered air to flow through filter 3006 along a path 7800 into cartridge 16 and prevents flow of air or other (e.g., hazardous) vapors out of cartridge 16. The other of check valve discs 3004 may have an opposite orientation and may have a concave side that receives vapor flow from within cartridge 16 (e.g., along path 7802 from vial 18) and allows flow of the vapor along a path 7804 to a waste container while preventing flow of the vapor to air filter 7800. Air filter 3006 may be configured to provide, for example, 0.2 micron filtration and may be formed from a polytetrafluoroethylene (PTFE) or polypropylene (PP) material (as examples). Check valve cover 3002 may be configured to hold check valve discs 3004 in place and may be secured in cartridge housing using, for example, ultrasonic welding.

Figure 79:
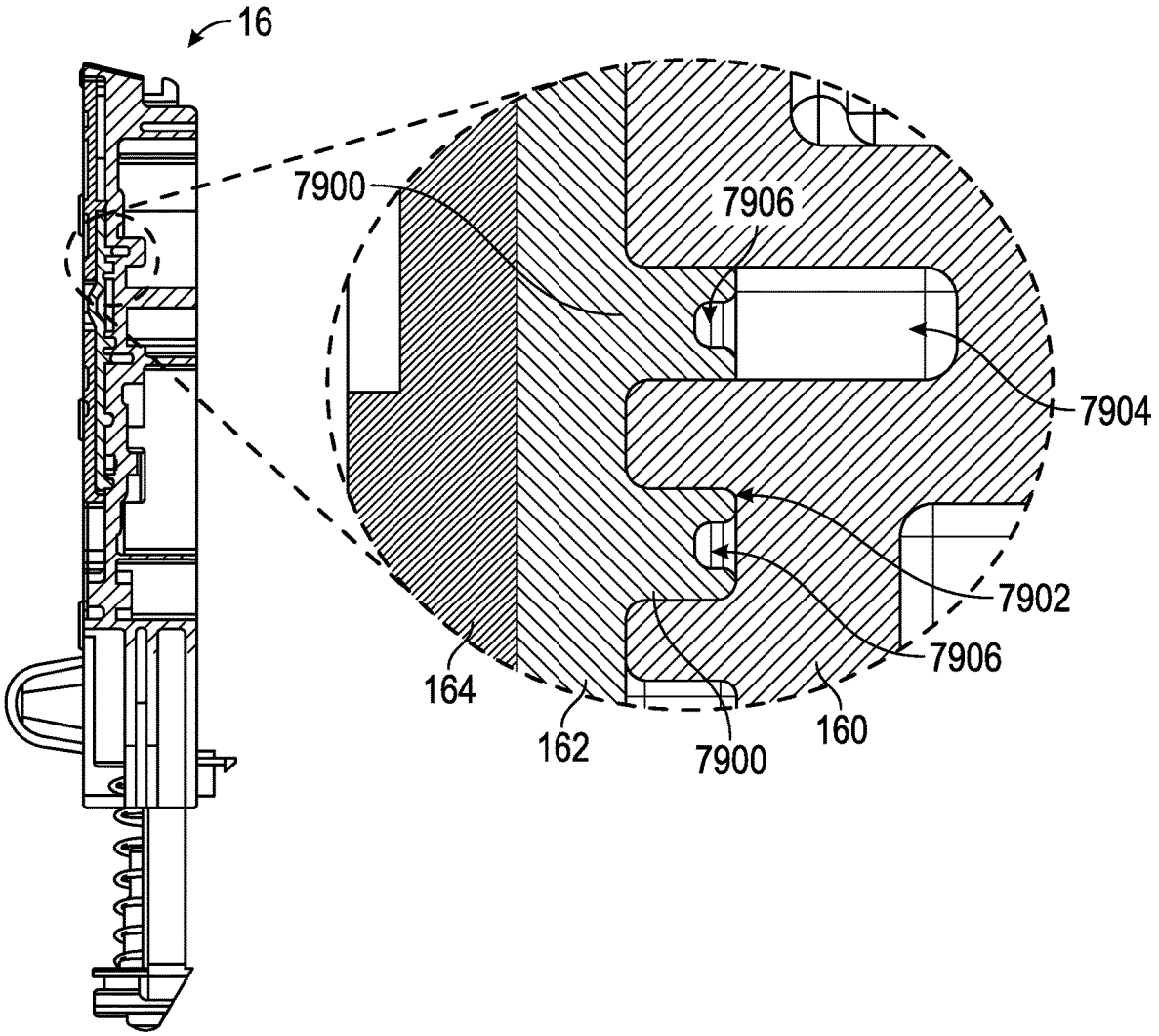
FIG. 79 illustrates a close up cross-sectional view of the cartridge of FIG. 67 showing a portion of a fluid flow path in accordance with aspects of the present disclosure.

FIG. 79 illustrates a cross-sectional side view of cartridge 16 along with an enlarged view of a portion of the cartridge in the vicinity of sealing member engagement features that secure and seal the sealing membrane 162 to cartridge frame 160. As shown in FIG. 79, sealing membrane 162 may include one or more compression ribs 7900 that extend perpendicularly from the overall planar structure of the membrane. Ribs 7900 may be compressed into valve pockets 7902 and/or fluidic paths 7904 to seal the valve pockets and/or fluidic paths. When pressed into pockets 7902 and/or fluidic paths 7904, ribs 7900 may be compressed by, for example, 8%-10% radially (e.g., compressed a distance of approximately 0.1 mm for a rib having a width of 1.2 mm) to form a compression seal. Each rib may be provided with a relief channel 7906 to ease the initial compression of the rib as it is pressed into the relevant opening in frame 160.

Figure 80:
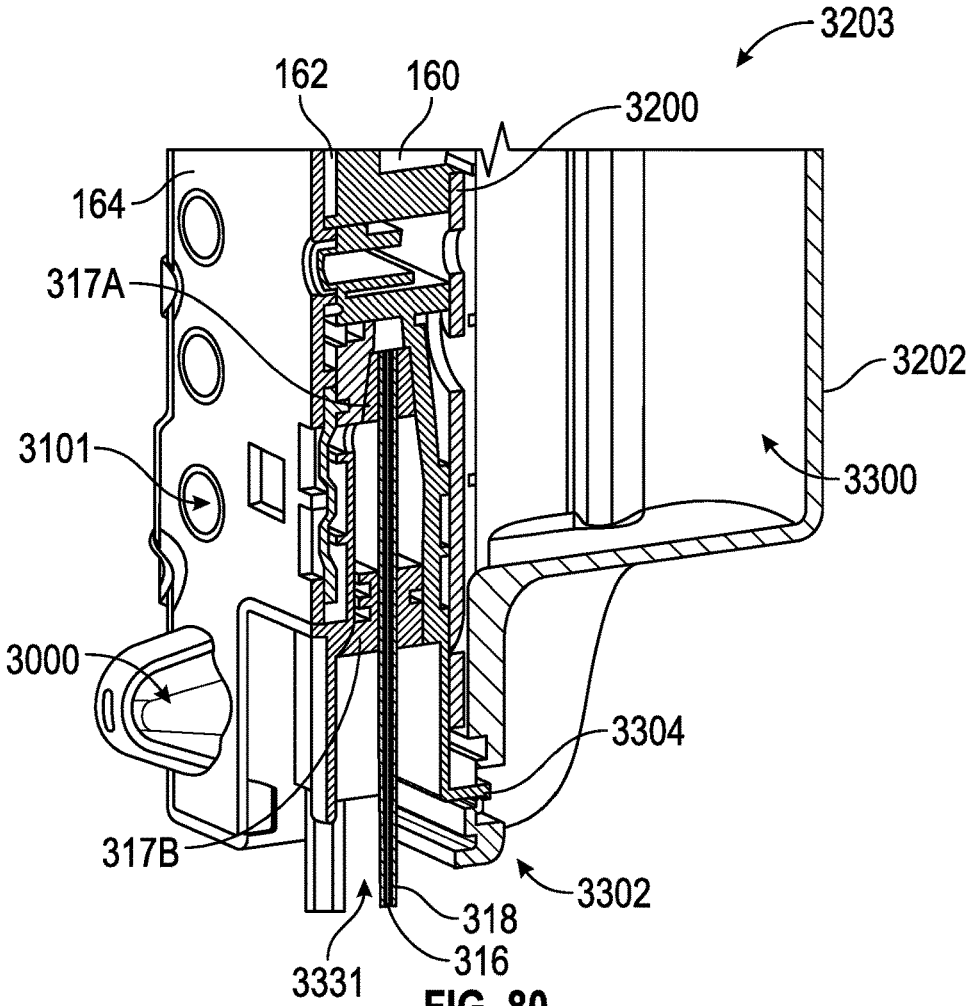
FIG. 80 illustrates a cross-sectional perspective view of a portion of the cartridge of FIG. 67 taken through a needle housing in accordance with aspects of the present disclosure.

FIG. 80 is an enlarged cross sectional perspective side view of a portion of the cartridge and backpack assembly in which the internal cavity 3300 and bottom side latching features 3302 of backpack 3202 can be seen. As shown, a protruding portion 3304 of cartridge frame 160 can extend perpendicularly from the frame and between latching features 3302 of backpack 3202 (e.g., through an opening in backpack 3202) to secure the backpack to cartridge 16 at the bottom side. Needle housing members 317A and 317B are also shown disposed in a needle cavity 3331 in cartridge frame 160 respectively securing needles 316 and 318 therein.

Figure 81:
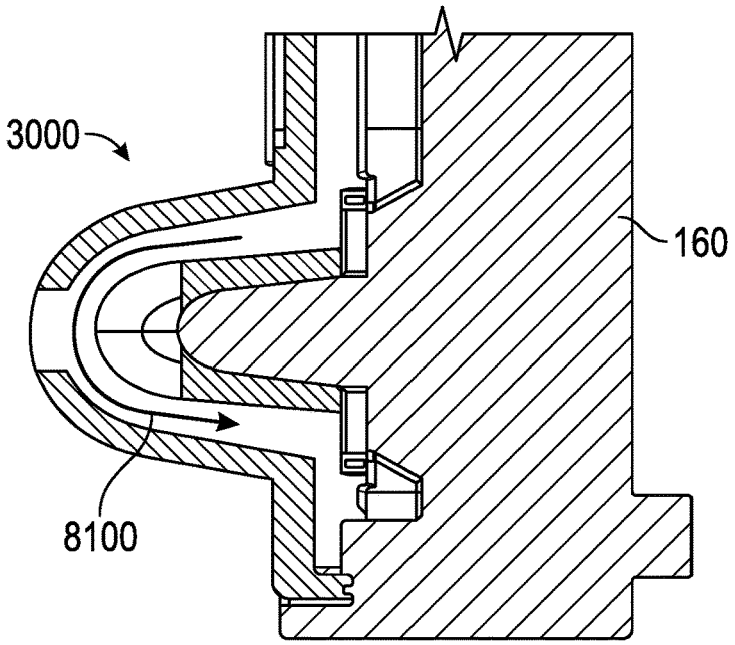
FIG. 81 illustrates a cross-sectional view of a portion of the cartridge of FIG. 67 taken through an air-in-line fitment in accordance with aspects of the present disclosure.
Figure 82A:
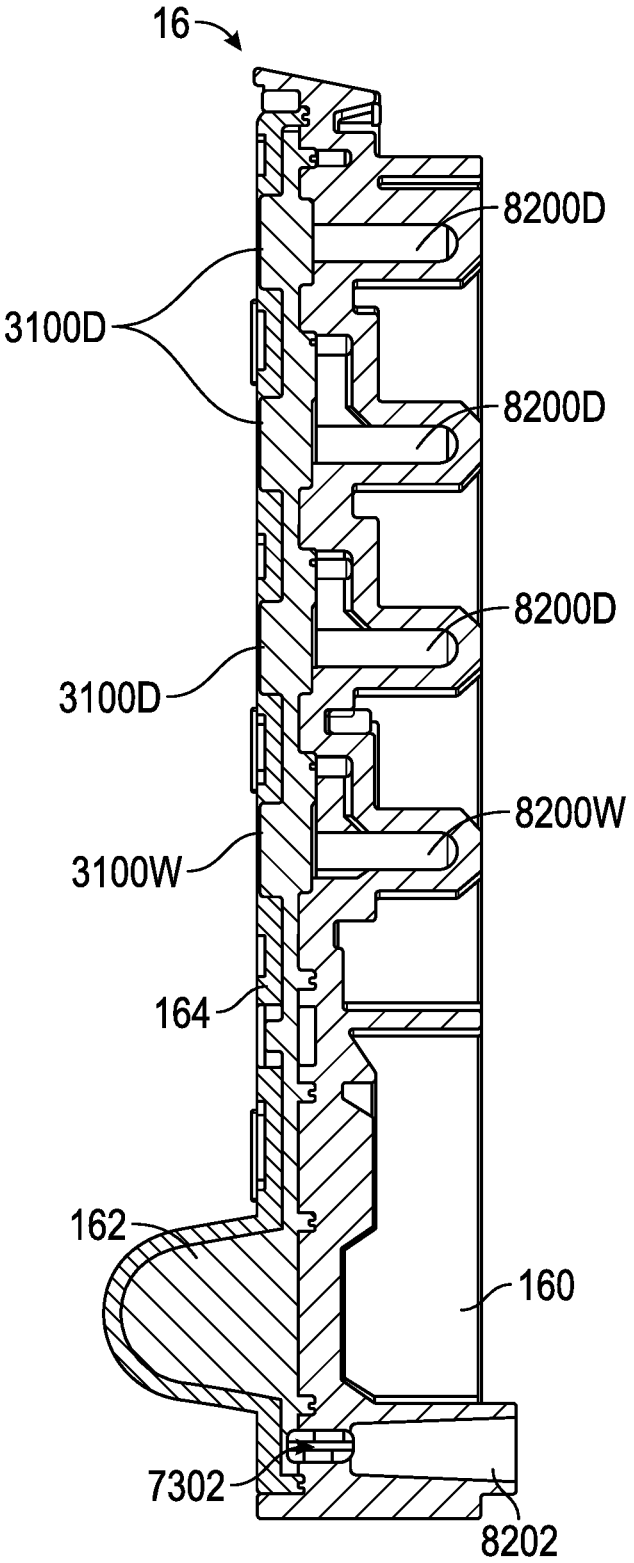
FIG. 82A illustrates a cross-sectional side view of the cartridge of FIG. 67 showing a plurality of ports in accordance with aspects of the present disclosure.

FIG. 81 is an enlarged cross-sectional side view of air-in-line sensor fitment 3000 showing how a flow path 8100 may be provided in the fitment that can be viewed and/or monitored by an air-in-line sensor in pump head assembly 28. FIG. 82A is a cross-sectional side view of cartridge 16 with the cross section take through diluent ports 3100D, waste port 3100W, and receiving container port 7302. As shown in the example of FIG. 82A, each diluent port 3100D may be formed by a portion of membrane 162 that is formed within an opening in bezel 164 and adjacent to a diluent, chamber 8200D. Waste port 3100W may be formed by a portion of membrane 162 that is formed within an opening in bezel 164 and adjacent to a vapor waste chamber 8200W. Receiving container port 7302 may be formed from an opening that leads to a receiving container chamber 8202 in which tubing that extends into backpack 3202 may be disposed to form a fluid path to the receiving container from cartridge 16.

Figure 82C:
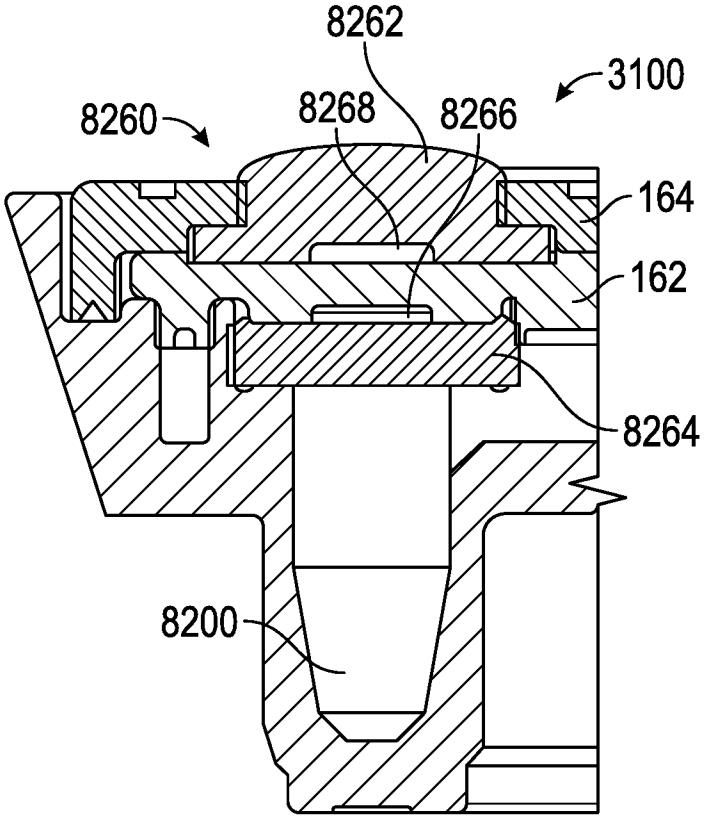
FIG. 82C illustrates a cross-sectional side view of a portion of the cartridge of FIG. 67 showing port seals formed by a plurality of sealing members in accordance with aspects of the present disclosure.
Figure 82B:
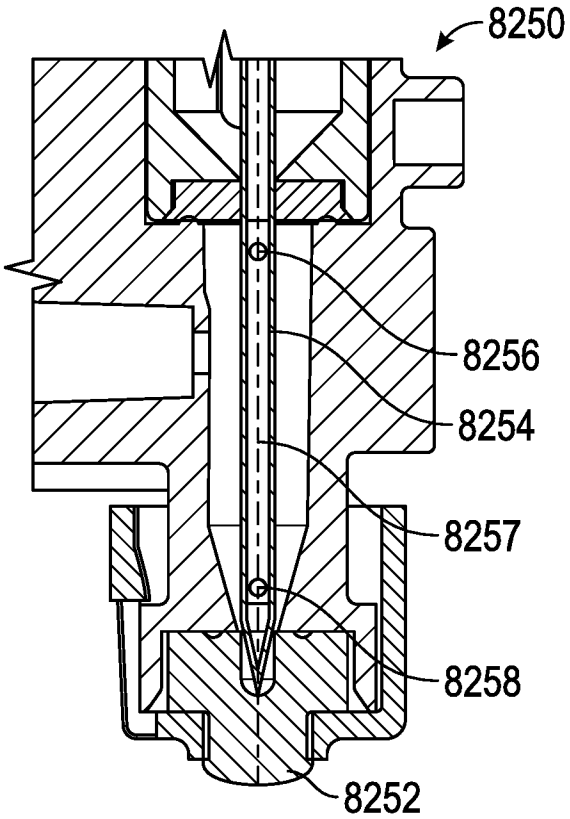
FIG. 82B illustrates a cross-sectional side view of a portion of a diluent manifold having a needle that may interface with one of the ports of FIG. 82A in accordance with aspects of the present disclosure.

When compressed by a sealing manifold membrane such as sealing manifold membrane 8252 of manifold 8250 of FIG. 82B, the portion of sealing membrane 162 that forms diluent and/or waste ports 3100 creates a drip-free connection between the manifold 8250 and the cartridge. A manifold needle 8254 of a selected diluent manifold 8250 and a manifold needle of a waste manifold can extend through the corresponding manifold membrane 8252 and the sealing membrane 162 in the respective diluent and waste port to form fluid paths through sealing membrane 162 (e.g., through opening 8256, central bore 8257, and opening 8258 of needle 8254) for diluents and waste vapors for reconstitution and compounding operations.

However, the example of FIG. 82A, in which the seal of ports 3100D and 3100W are formed solely by a portion of membrane 162 that extends into an opening in bezel 164 is merely illustrative. In some embodiments, in order to provide an improved drip-free seal, the seal of each of ports 3100D and port 3100W may be formed by a plurality of sealing members. In one example, three sealing members may be provided to form a port seal for cartridge 16.

FIG. 82C shows a cross-sectional view of a port of cartridge 16 in an implementation with three sealing members. As shown in FIG. 82C, a port 3100 (e.g., one of diluent portion 3100D or waste port 3100W) may be formed from a portion of membrane 162 that is disposed between an outer sealing member 8252 (formed in an opening 8260 in bezel 164) and an inner sealing member 8264. Inner sealing member 8264 may be disposed between membrane 152 and chamber 8200.

As shown in FIG. 82C, outer sealing member 8260 may include a portion that extends through opening 8260 and may also include a recess 8268 on an interior surface adjacent to membrane 152. Membrane 162 may also include a recess 8266 on an interior surface adjacent to inner sealing member 8264. Providing a portion 3100 with multiple sealing members such as the three sealing members (i.e., member 8262, member 8264, and the portion of membrane 162 formed between members 8262 and 8264) may provide an enhanced wiping of needle 8254 to provide an improved dry disconnect in comparison with implementations with a single sealing member. However, this is merely illustrative. In various embodiments, one, two, three, or more than three sealing members for each port may be provided. Similarly, interstitial spaces formed from recesses 8266 and 8268 may further increase the efficiency of the wiping of needle 8254, however, in various embodiments, sealing members may be provided with or without recesses 8266 and/or 8268.

Figure 82D:
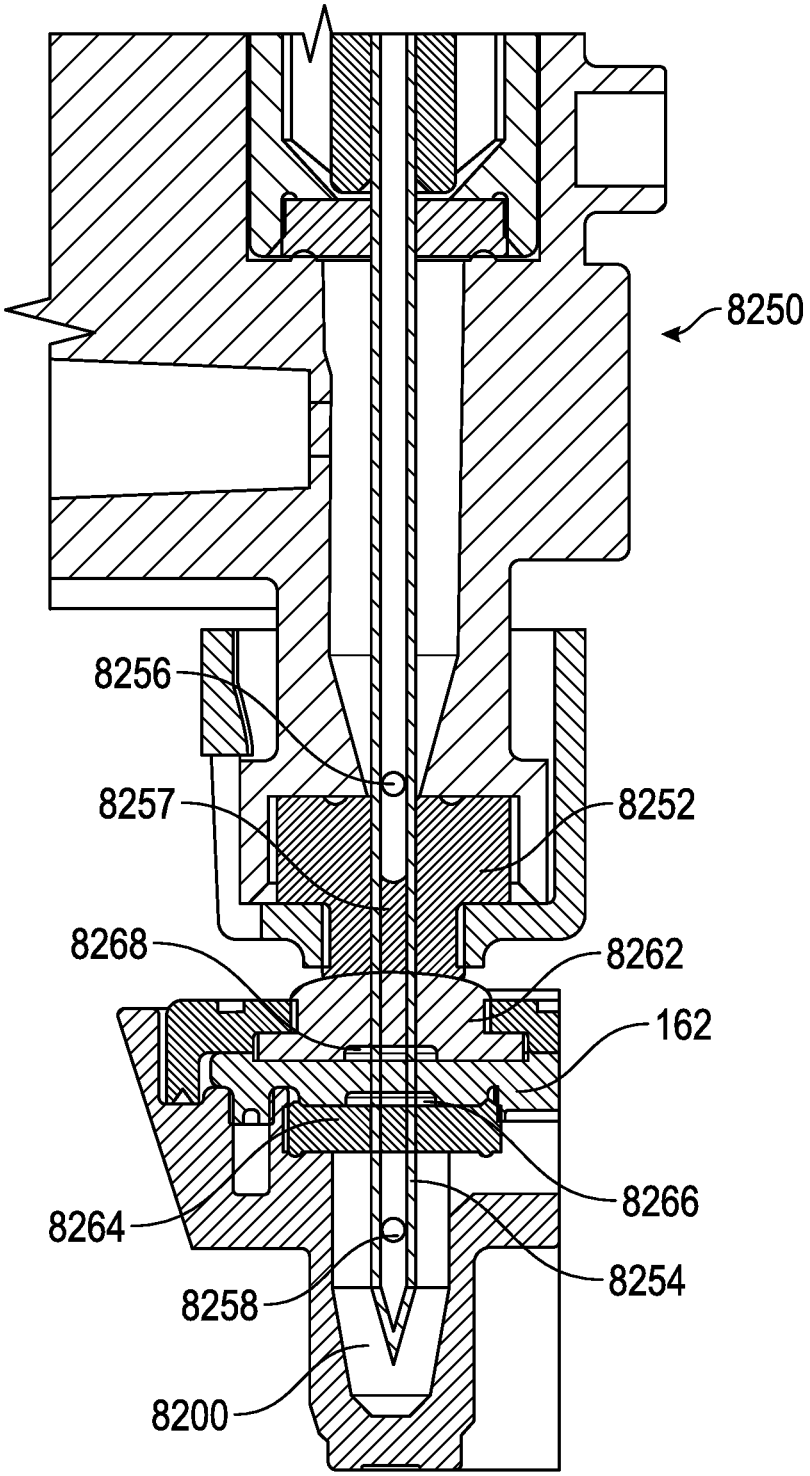
FIG. 82D illustrates a cross-sectional side view of the portion of the manifold of FIG. 82B compressed against the portion of the cartridge of FIG. 82C in accordance with aspects of the present disclosure.

FIG. 82D shows the manifold 8250 of FIG. 82B with manifold sealing member 8252 compressed against outer sealing member 8262 of port 3100 of FIG. 82C. As shown in FIG. 82D, needle 8254 is extended from manifold 8250 through sealing members 8252 and 8262, through interstitial space 8268, through membrane 152, through interstitial space 8266, and through inner sealing member 8264 such that openings 8256 and 8258 and central bore 8257 form a fluid pathway between cartridge 16 and manifold 8250.

In the example of FIG. 82A, the portion of membrane 162 that extends into the openings in bezel 164 in ports 3100 may be compressed (e.g., compressed by 10% radially) to cause a wiping effect on the diluent needles that are extended therethrough and withdrawn therefrom so that when the diluent needles are retracted into the manifold, no liquid is left on the diluent needle or one the outer surfaces of the cartridge or the membrane.

In the example of FIGS. 82C and 82D, the portion of sealing member 8262 that extends into the openings in bezel 164 in ports 3100 may be compressed (e.g., compressed by 10% radially) to cause a wiping effect on the diluent needles that are extended therethrough and withdrawn therefrom so that when the diluent needles are retracted into the manifold, no liquid is left on the diluent needle or one the outer surfaces of the cartridge or the membrane. The multiple sealing members of FIGS. 82C and 82D may be arranged to each provide a wiping effect on needle 8254 that complements the wiping effect of the other sealing members (e.g., by providing, with each member, a peak wiping force on the needle at locations angularly spaced with respect to the peak wiping force of other members).

Figure 83:
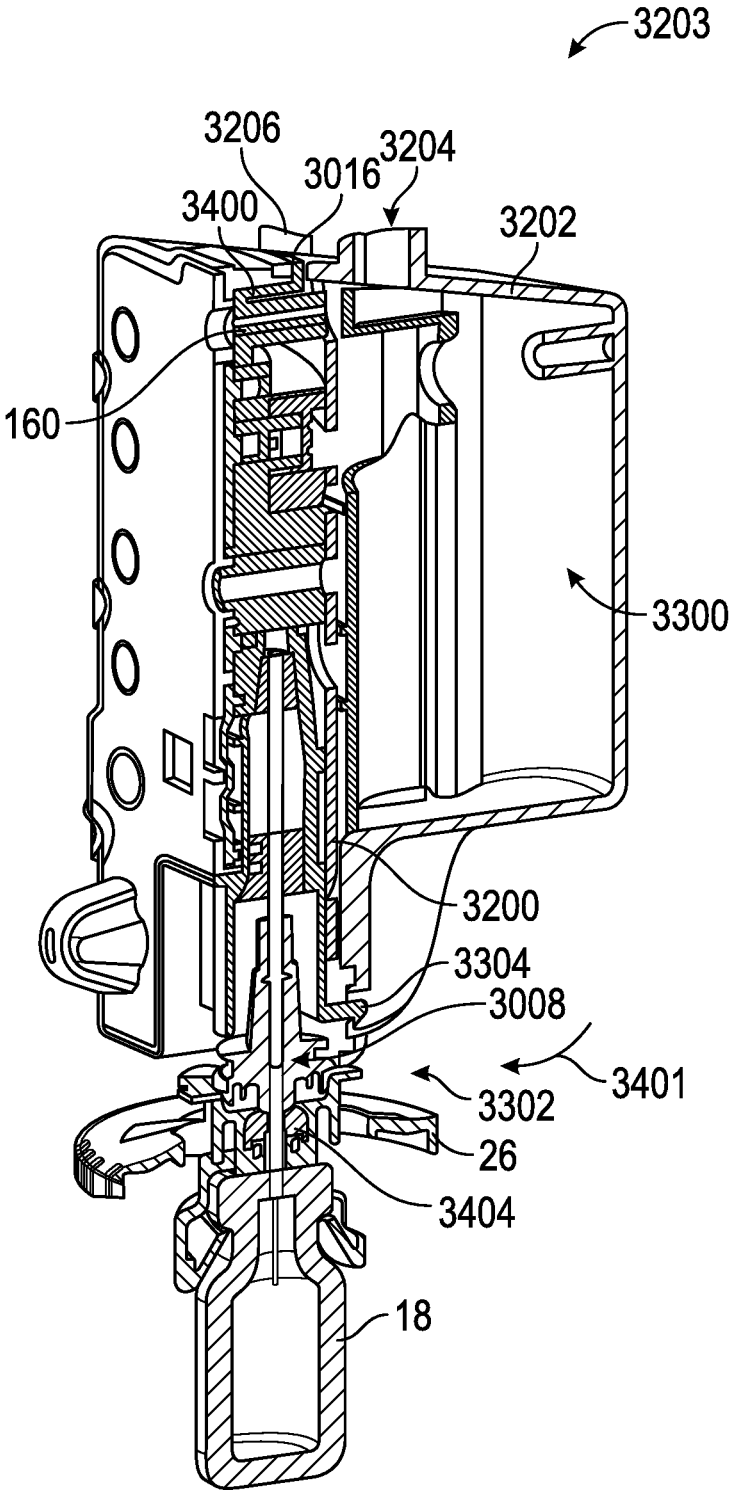
FIG. 83 illustrates a cross-sectional perspective view of the cartridge of FIG. 67 disposed adjacent a vial in accordance with aspects of the present disclosure.

FIG. 83 is cross-sectional perspective side view of cartridge and backpack assembly 3203 in which protrusion 3016 and protrusion 3304 of cartridge frame 160 can be seen cooperating to couple cartridge 16 to backpack 3202 to form cartridge and backpack assembly 3203. To install backpack 3202 onto cartridge 16, opening 3201 of backpack 3202 can be positioned over protrusion 3016 and backpack 3202 can be rotated (e.g., in a direction 3401) to push latching features 3302 of backpack 3202 against latching protrusion 3304 until latching protrusion 3304 snaps into position between latching features 3302. As shown, protrusion 3016 may be formed on an additional latching structure of cartridge 16 such as a flexible arm 3400. Flexible arm 3400 may allow backpack 3202 to be pulled downward by a small distance when backpack 3202 is rotated to press latching feature 3302 onto protrusion 3304. Flexible arm 3400 may be resilient to maintain an upward force the holds latching features 3302 in a latched position against protrusion 3304.

In the example of FIG. 83, a vial 18 and vial puck 26 are positioned adjacent to cartridge and backpack assembly 3203 with needle assembly 170 extended into the vial through sealing member 3402 of cartridge 15 and sealing member 3404 of vial puck 26 which may provide a drip free seal and allow fluid to be provided into and/or removed from vial 18. Sealing member 3402 may be, for example, an implementation of sealing member 3008. As shown, when the needle assembly 170 is extended into the vial, portions of the vial puck 26 may be located adjacent to latching features 3302 of backpack 3202.

Figure 84:
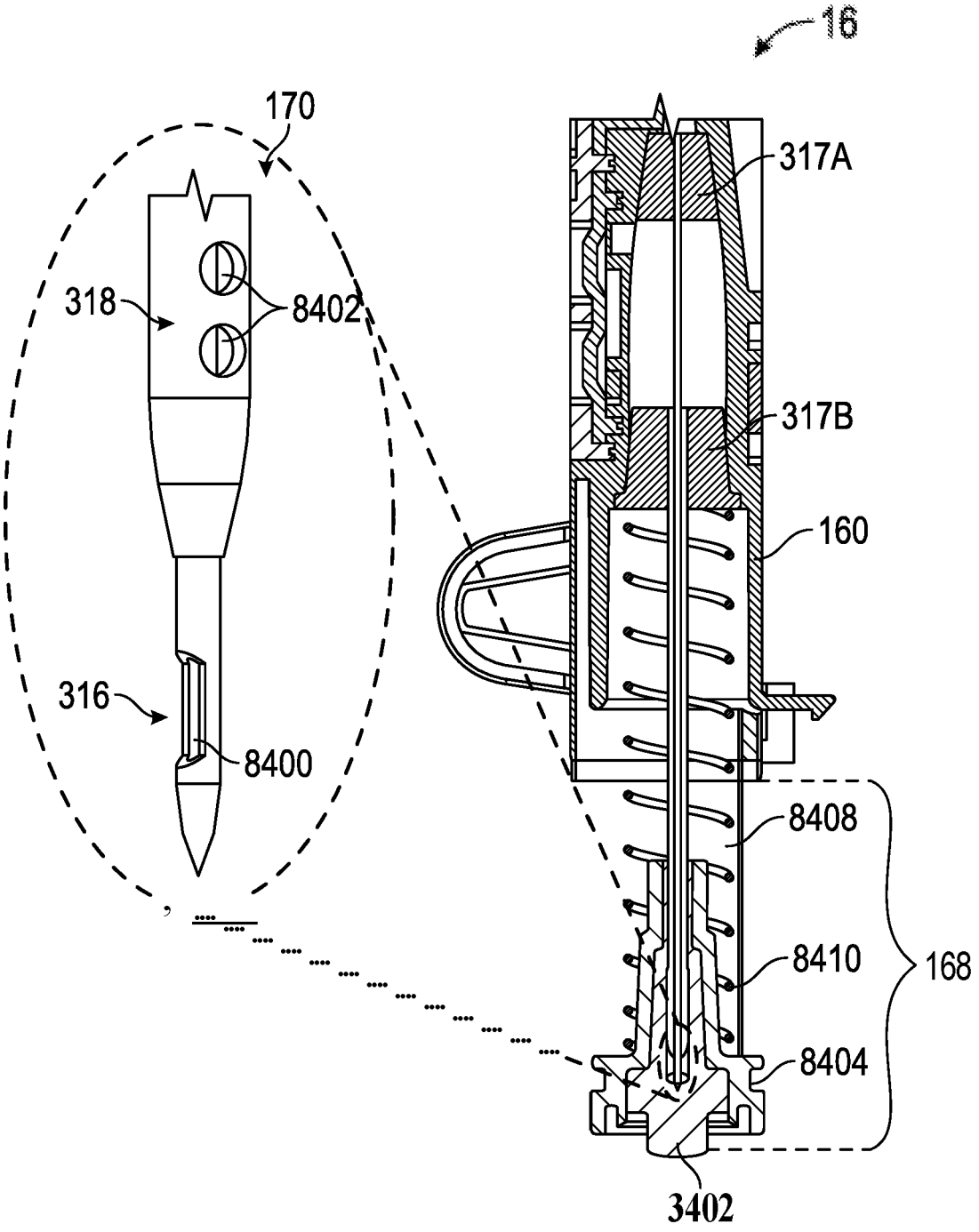
FIG. 84 illustrates a cross-sectional side view of a portion of the cartridge of FIG. 67 in the vicinity of a dual lumen needle in accordance with aspects of the present disclosure.

FIG. 84 shows a cross-sectional view of a portion of cartridge 16 along with an enlarged view of a portion of needle assembly 170. As shown in FIG. 84, needle housing 168 may include a sealing membrane 3402 formed within an annular housing member 8404 that is attached to cartridge frame 160 via one or more housing arms 8408. A spring 8410 may be provided that extends from needle housing member 317B into needle housing 168 such that compression of spring 8410 is necessary to extend needles 316 and 318 through sealing membrane 3402. In this way, a user handling cartridge 16 is prevented from being injured by access to needle assembly 170. In operation, a vial puck may be pressed against annular housing member 8404 to compress spring 8410 such that needle assembly 170 extends through sealing membrane 3402 and through a sealing membrane of the vial puck into the vial.

Dual lumen needles 316 and 318 may be respectively provided with openings 8400 and 8402 that provide fluid access to central bores of the needles. Needle 316 may, for example, be a 24 gauge needle held in cartridge frame 160 by a high density polyethylene (HDPE) overmold 317A, the needle having an opening 8400 for venting the drug vial. Opening 8400 may be formed using a slot cut as shown to reduce coring of the sealing membranes as the needle is inserted and retracted. Needle 318 may, for example, be an 18 gauge needle held in cartridge frame by a high density polyethylene (HDPE) overmold 317B with one or more openings 8402 for fluid flow into and/or out of the vial. Openings 8402 may include two drilled holes configured to reduce coring and to allow up to, for example, 60 mL/min of fluid flow.

In this way, during reconstitution operations, diluent may be provided into the vial via openings 8402 of needle 318 and vapor waste may be simultaneously extracted from the vial via opening 8400 in needle 316. During compounding operations, a reconstituted drug may be pulled from the vial via openings 8402 of needle 318 and sterile air may be provided into the vial via opening 8400 of needle 316.

Figure 85:
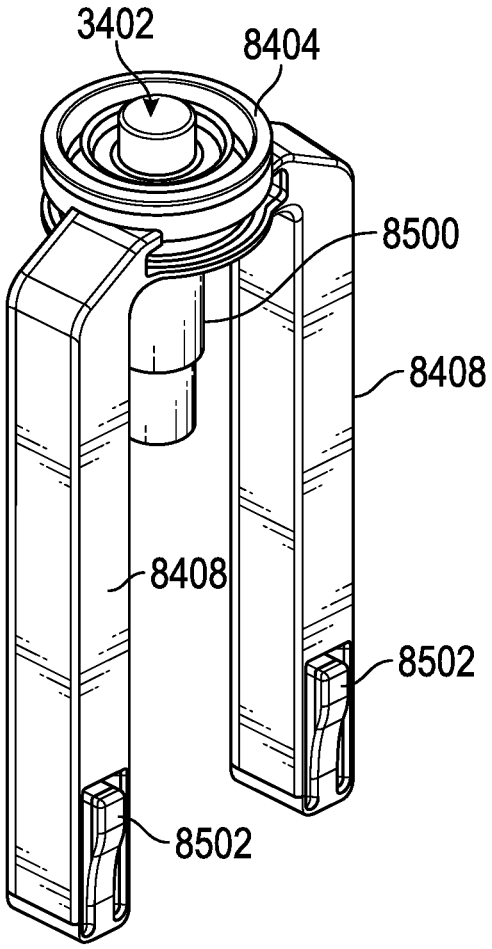
FIG. 85 illustrates a perspective view of a needle housing member of the cartridge of FIG. 67 in accordance with aspects of the present disclosure.

FIG. 85 shows an inverted perspective view of annular housing member 8404 and housing arms 8408 showing how housing members 8404 and 8408 may be formed from an integral structure that houses sealing membrane 3402. A needle guide structure 8500 may extend from annular housing member 8404 between arms 8408. Engagement features such as compressible snap features 8502 may be provided on arms 8408 for securing arms 8408 within cartridge frame 160.

Figure 86:
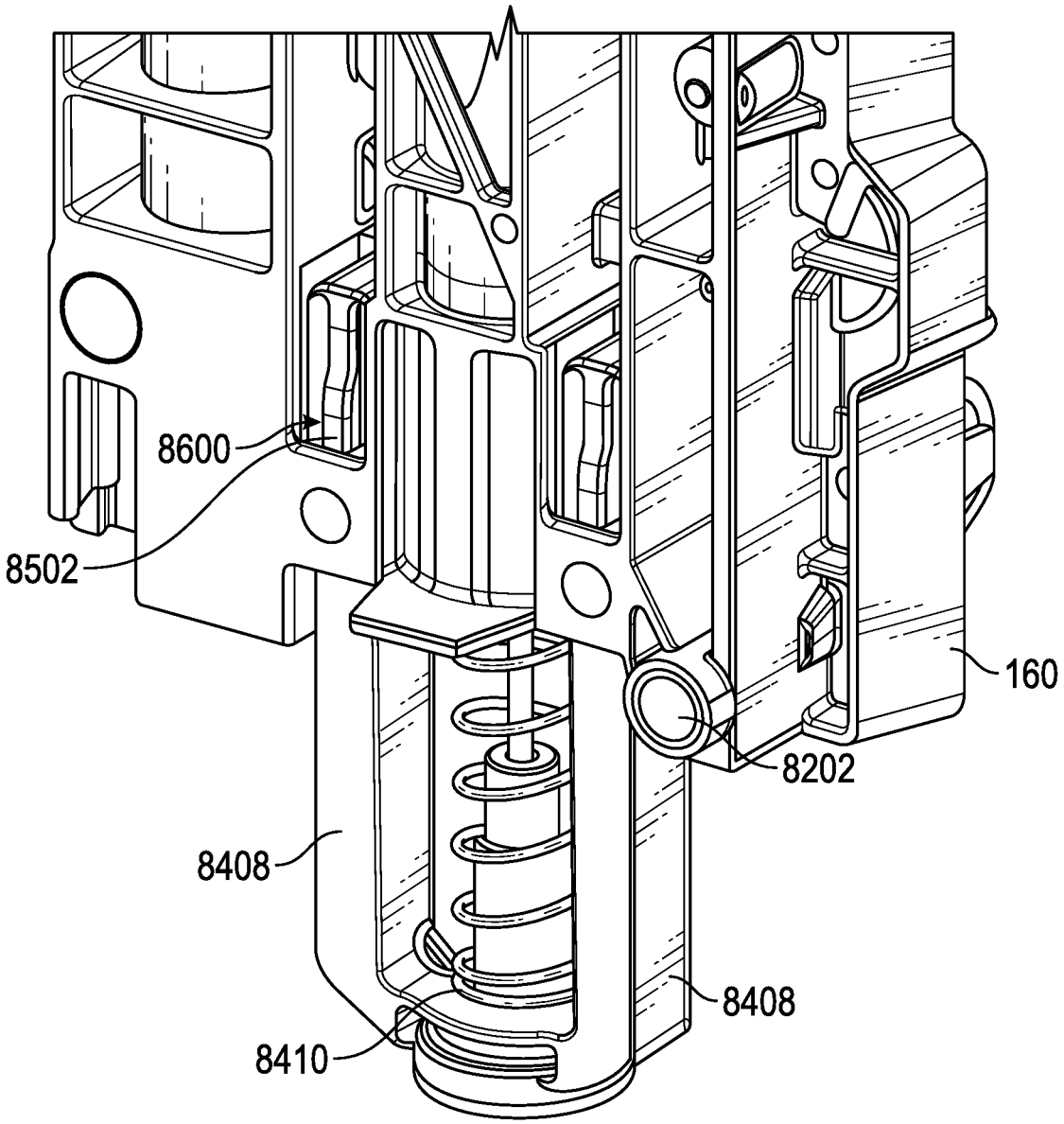
FIG. 86 illustrates a perspective view of a portion of the cartridge of FIG. 67 in the vicinity of the needle housing in accordance with aspects of the present disclosure.

FIG. 86 shows arms 8408 disposed partially within and extending from cartridge frame 160. As shown, snap features 8502 are engaged with a ledge 8600 on cartridge housing 160 with spring 8410 fully extended such that needle assembly 170 is contained completely within the needle housing assembly.

Figure 87:
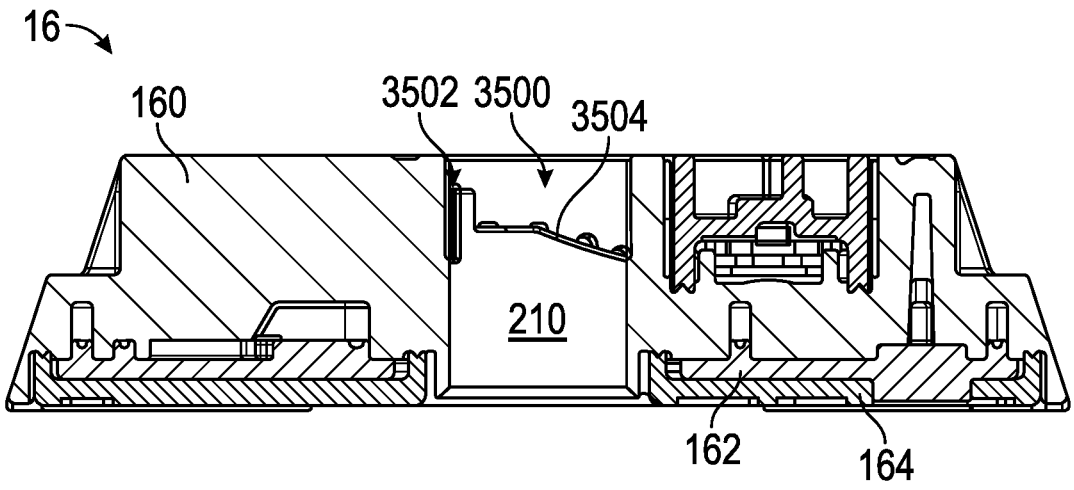
FIG. 87 illustrates a cross-sectional top view of the cartridge of FIG. 67 taken through a bayonet opening in accordance with aspects of the present disclosure.
Figure 88:
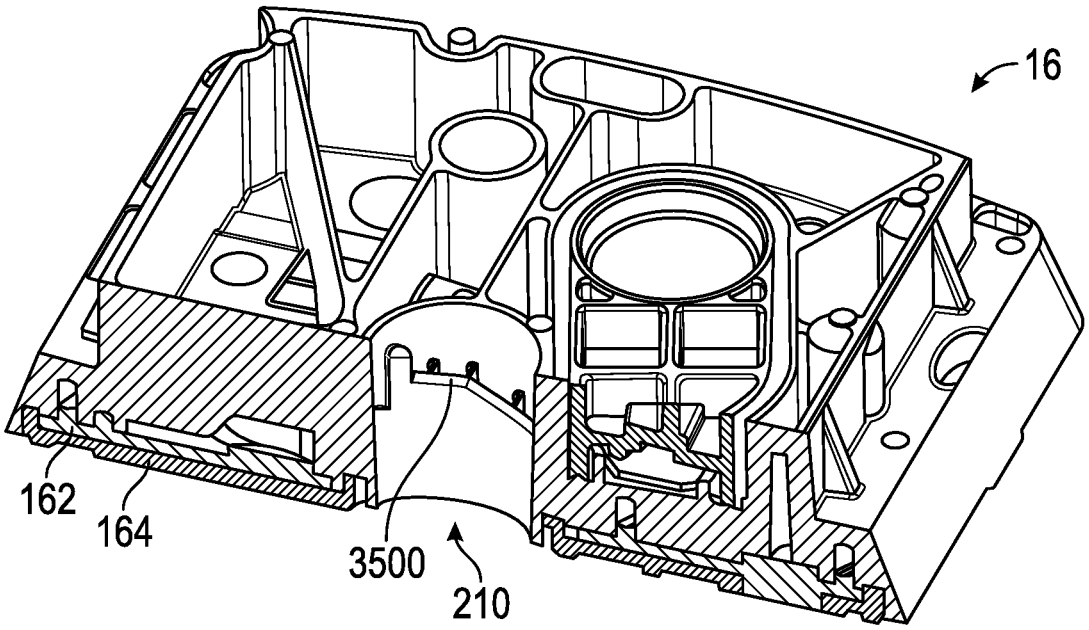
FIG. 88 illustrates a cross-sectional perspective view of the cartridge of FIG. 67 taken through the bayonet opening in accordance with aspects of the present disclosure.

FIG. 87 is a cross sectional top view of cartridge 16 showing how a ramp structure such as bayonet capture ramp 3500 may be provided within opening 210. As shown, bayonet capture ramp may include a hard stop rib 3502 that prevents over travel of the bayonet, and a ramp 3504 that, when the bayonet 128 is rotated, bears against the bayonet so that the bayonet captures the cartridge and pulls the cartridge up to the compounder arm. A portion of the bayonet may extend through opening 210 into an opening in structure 3200 (see, e.g., FIG. 83) such that, when the bayonet is rotated, the bayonet also bears against portions of structure 3200 to move, rotate, and/or deform structure 3200 to release the cartridge and backpack assembly 3203 from the carousel. FIG. 88 shows a cross-sectional perspective view of a portion of cartridge 16 showing ramp structure 3500 formed on a sidewall of opening 210.

Figure 89:
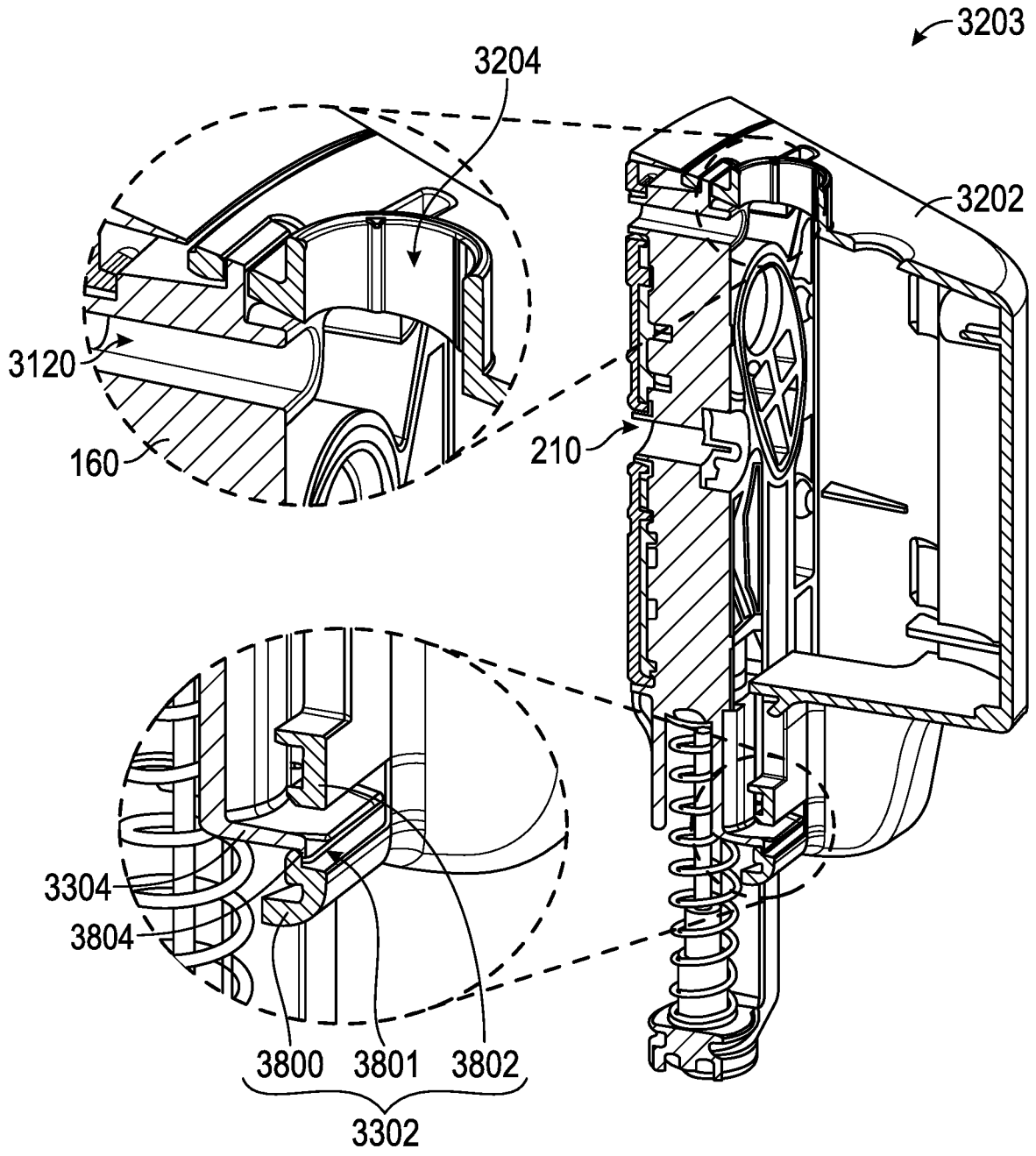
FIG. 89 illustrates a cross-sectional perspective view of a portion of the cartridge of FIG. 67 showing enlarged views of backpack engagement structures in accordance with aspects of the present disclosure.

FIG. 89 shows a cross-sectional perspective view of cartridge and backpack assembly 3203 with further enlarged portions of the cartridge and backpack assembly 3203 showing various aspects of the interface between cartridge 16 and backpack 3202. As shown in FIG. 89, opening 3120 may extend through cartridge frame 160 to a position within backpack 3202 adjacent to and beneath opening 3204. In this way, when a connector is inserted into opening 3204, a sensor in the pump head assembly can view the connector through opening 3120.

FIG. 89 also shows an enlarged view of an exemplary engagement between a latching structure such as as protrusion 3304 of cartridge frame 160 and latching features 3302 of backpack 3202. As shown, latching features 3302 may be formed from an opening 3801 in backpack 3202 that forms an upper protrusion 3800 and lower protrusion 3802. When backpack 3202 is attached to cartridge 16, a portion of bottom protrusion 3802 may bear against an additional latching structure such as ramped surface 3804 of protrusion 3304 to push protrusion 3304 upwards as backpack 3202 is rotated into position. When backpack 3202 has been rotated into a latched position, protrusion 3304 of cartridge frame 160 overlaps with protrusion 3800 of backpack 3202 and extends through opening 3801 to secure backpack 3202 to cartridge 16 at the bottom end.

Figure 90:
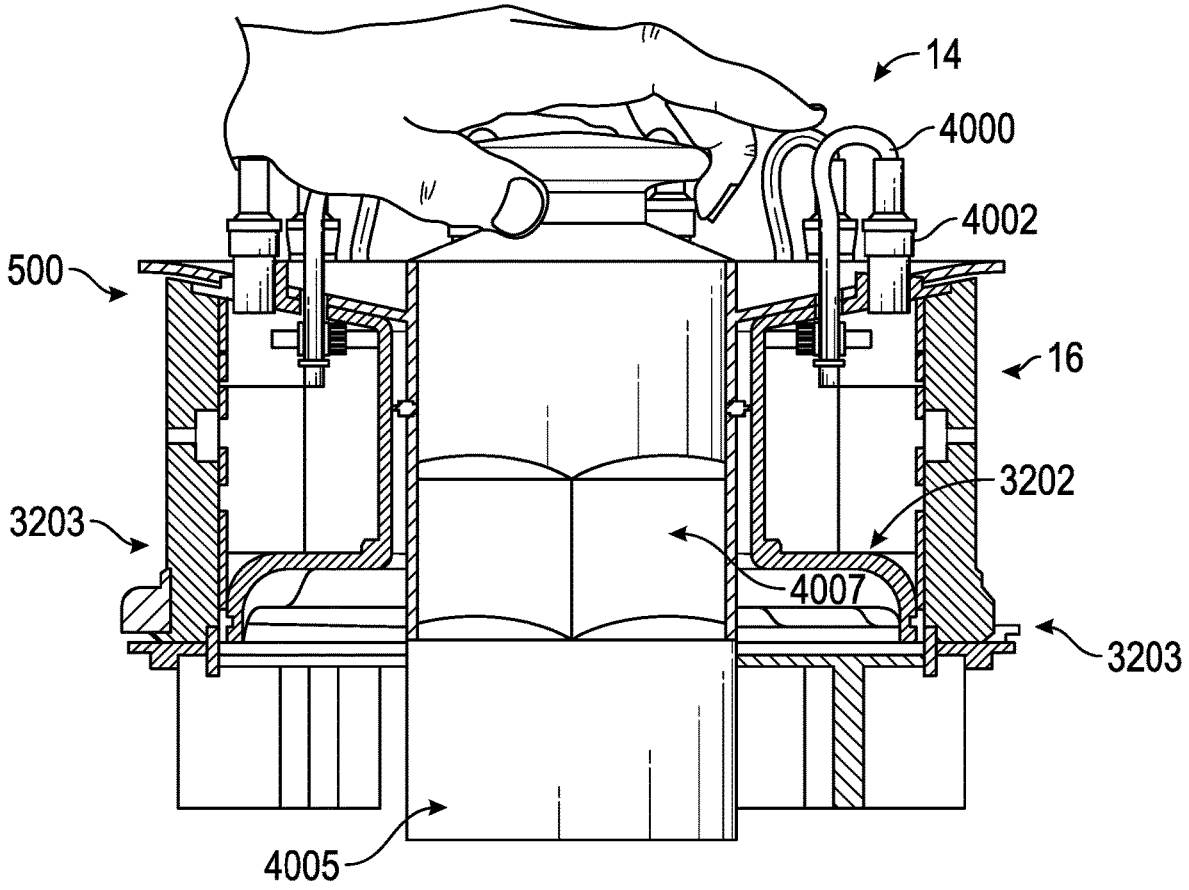
FIG. 90 illustrates a cross-sectional view of an embodiment of a carousel having cartridges disposed thereon in accordance with aspects of the present disclosure.

FIG. 90 shows a cross sectional view of a carousel 14 having a plurality of cartridge and backpack assemblies 3203 mounted in corresponding cartridge pockets 500. As shown in FIG. 90 a connector 4002 such as a Texium® connector may be disposed in an opening in each backpack 3202 of each cartridge and backpack assembly 3203. The connector 4002 may be disposed at an end of tubing 4000 (e.g., an implementation of tubing 38 of FIG. 1 disconnected from receiving container 32) that extends from the connector into the internal cavity of each backpack 3202 and connects to an output port of the cartridge 16 attached to that backpack. A central opening 4005 can also be seen in the cross-sectional view of FIG. 90. As shown, central opening 4005 may be a substantially cylindrical opening with a portion having slatted planar walls that together form a polygonal pattern 4007 that corresponds to the polygonal shape of carousel huh 2814 (FIG. 28). However, other patters for central opening (and carousel hub 2814) such as a "D" shape are contemplated.

Figure 91:
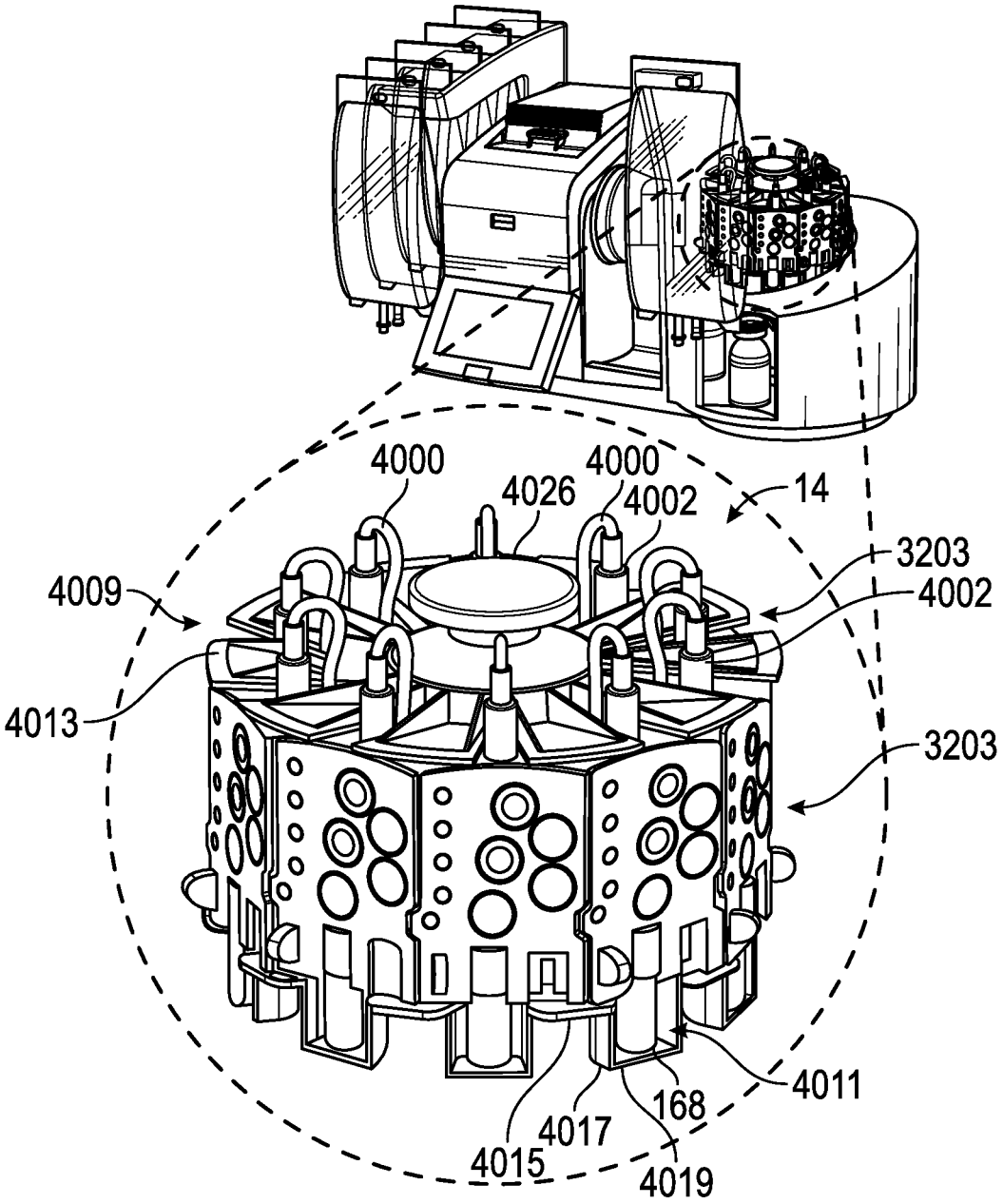
FIG. 91 illustrates a perspective view of the carousel of FIG. 90 in accordance with aspects of the present disclosure.

A perspective view of carousel 14 is shown in FIG. 91. As shown in FIG. 91, cartridge and backpack assemblies 3203 may be disposed around the circumference of carousel 14 and carousel 14 may include recesses 4009 in an upper surface 4013 for accommodating tubing 4000 and connector 4002 of each cartridge and backpack assembly 3203. Carousel 14 may also include a bottom surface 4015 having a plurality of extensions 4017 that extends downward therefrom and each have a recess 4011 that accommodate needle housing 168 of a corresponding cartridge and backpack assembly 3203. Extensions 4017 may have a protective bottom surface 4019 that runs underneath a needle housing 168 of an installed cartridge and prevents actuation of the needle housing that could expose an operator to the needle assembly therein. Protective bottom surface 4019 may also serve as a surface for collecting any small amount of drug that may inadvertently drip from the needle (or needle housing) of the cartridge 16). A handle 4026 may be provided that facilitates user installation of a new carousel of cartridges onto carousel hub 2814 (FIG. 28) and removal of a carousel with used cartridges from the carousel hub.

Figure 92:
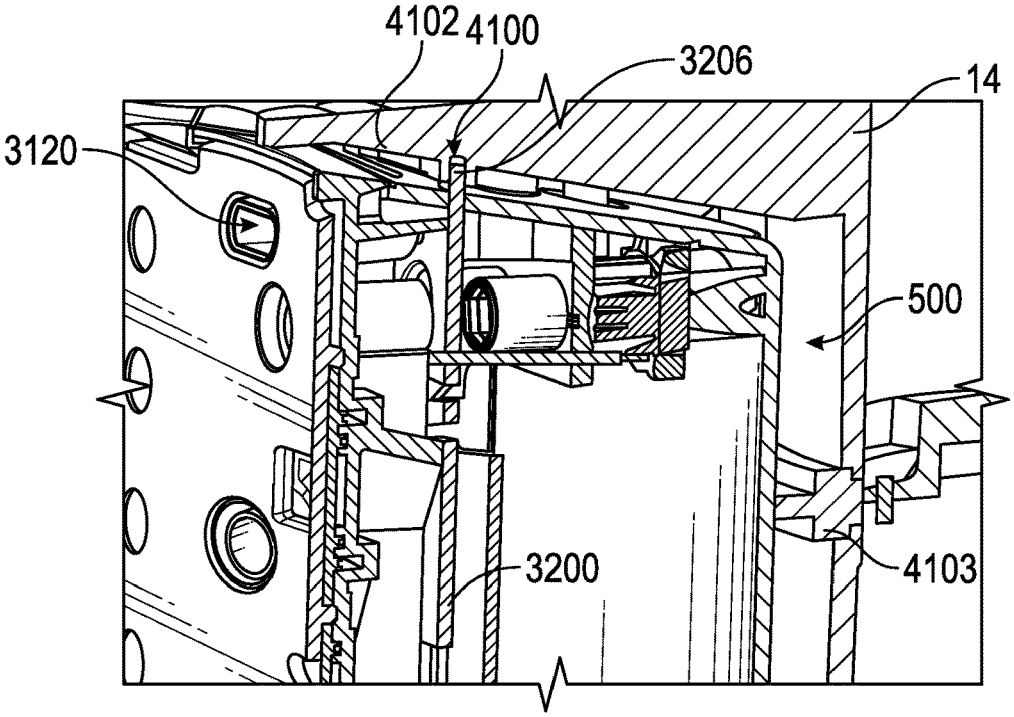
FIG. 92 illustrates a cross-sectional perspective view of a portion of the carousel of FIG. 90 showing backpack engagement features of the carousel in accordance with aspects of the present disclosure.

FIG. 92 is a cross-sectional perspective view of a portion of a cartridge and backpack assembly 3203 that is mounted to carousel 14. As shown in FIG. 92, carousel 14 may include a an extended portion 4102 of top surface 4013 that extends over cartridge and backpack assembly 3203 in cartridge pocket 500 and includes a recess 4100 on an inner surface that is configured to receive protrusion 3206 of structure 3200 of cartridge and backpack assembly 3203 to secure cartridge and backpack assembly 3203 within pocket 500. Carousel 14 may also include structural members in pocket 500 such as a bumper member 4103 configured to help hold cartridge and backpack assembly 3203 in place when cartridge and backpack assembly 3203 is mounted in pocket 500. When it is desired to remove cartridge and backpack assembly 3203 from pocket 500 of carousel 14, protrusions 3206 may be lowered and thereby removed from recesses 4100 to allow cartridge and backpack assembly 3203 to move out of pocket 500. Protrusions 3206 may be lowered by pressing, moving, rotating, and/or deforming structure 3200 using, for example, bayonet 128.

Figure 93:
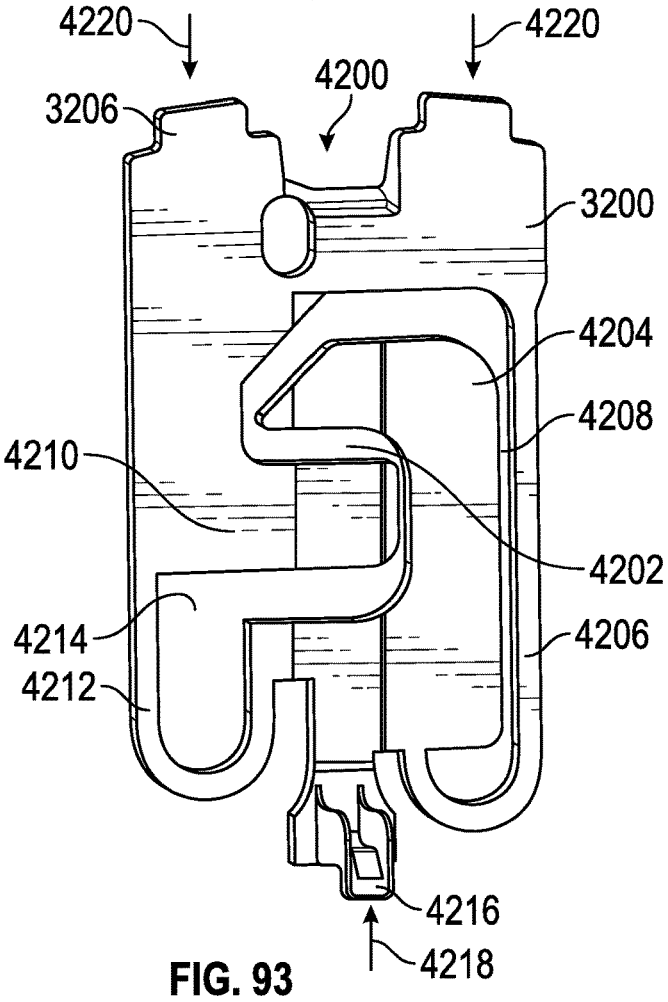
FIG. 93 illustrates a perspective view of a mounting member for a cartridge and backpack assembly in accordance with aspects of the present disclosure.

FIG. 93 shows a perspective view of structure 3200. As shown in FIG. 93, structure 3200 may be a patterned structure (e.g., a molded resiliently deformable plastic structure) having various features for facilitating mounting and removal of cartridge and backpack assembly 3203 to and from carousel 14. For example, structure 3200 may include a central opening 4202 configured to receive a portion of the bayonet that extends from the pump head assembly of the pump drive mechanism through cartridge 16. When the bayonet is turned, portions of the bayonet may simultaneously bear against an upper structure 4204 and a lower structure 4210 of structure 3200. When the bayonet bears downward against lower structure 4210, lower structure 4210 may be moved downward and/or rotated by the bayonet such that lower structure 4210 pulls correspondingly downward on protrusions 3206 in order to lower protrusions 3206 (e.g., in direction 4220 of FIG. 93). When the bayonet simultaneously bears upward on upper structure 4204, upper structure 4204 may pull, via arms 4206 and 4212, correspondingly upward on latch structure 4216 (e.g., to raise the latch structure in direction 4218 of FIG. 93.

In this way, protrusions 3206 and latch structure 4216 may be simultaneously retracted toward the center of structure 3200 (e.g., out of recess 4100 of carousel 14) in order to release cartridge and backpack assembly 3203 from carousel 14. Latch structure 4216 may, for example, extend through an opening in backpack 3202 to engage a corresponding recess in cartridge pocket 500 when the cartridge and backpack assembly 3203 is mounted in the pocket.

Structure 3200 may also include a recess 4200 that forms a portion of opening 3120 to facilitate viewing of a connector stored within backpack 3202 as discussed herein. An opening 4208 may be formed in structure 3200 between arm 4206 and upper structure 4204. An opening 4214 may be formed in structure 3200 that extends from arm 4212 along lower structure 4210. Openings 4208 and 4214 may be a connected single opening that is patterned to form structures 4210, 4204, 4206 and 4212 that actuate protrusions 3206 and latch structure 4216 when structure 3200 is deformed (e.g., to rotate a portion of the structure to pull on protrusions 3206).

Figure 94:
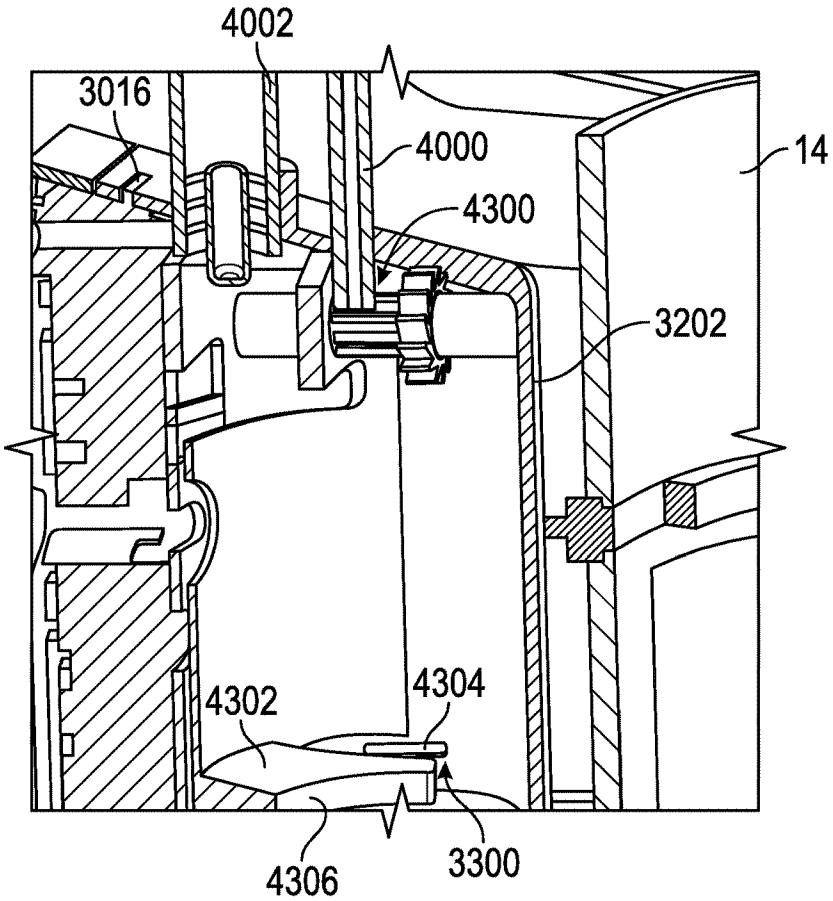
FIG. 94 illustrates a cross-sectional perspective view of the carousel and backpack of FIG. 93 showing tube management features of the backpack in accordance with aspects of the present disclosure.

FIG. 94 is a cross-sectional perspective view of another portion of a cartridge and backpack assembly 3203 that is mounted to carousel 14. As shown in FIG. 94, backpack 3202 may include a roller assembly 4300 that can be turned to actively drive tubing 4000 into or out of backpack 3202. For example, roller assembly 4300 may be turned in a first direction to extend tubing 4000 from within cavity 3300 or turned in an opposite second direction to retract tubing 4000 into cavity 3300. Roller assembly 4300 may be turned by an operator or automatically by a spring drive within backpack 3202 or by a drive mechanism that extends from the pump drive assembly through cartridge 16 to backpack 3202.

As shown in FIG. 94, backpack 3202 may also include internal structures for managing the insertion and removal of tubing 4000. For example, a strain relief structure 4304 may be provided that at least partially covers a bottom portion of tubing 4000 so that a pull against tubing 4000 from outside of backpack 3202 will result in tubing 4000 bearing against strain relief structure 4304 rather than resulting in a pull along the length of the tubing that could undesirably detach the tubing from cartridge 16. Strain relief structure 4304 may, for example, be an integrally formed internal extension that extends from a sidewall of interior compartment 3300 in a direction substantially perpendicular to the direction in which tubing 4000 exits backpack 3202. Backpack 3202 may also include a guide structure 4302 having a curved internal surface 4306 that forms a curved surface against which tubing 4000 can be coiled.

Figure 95:
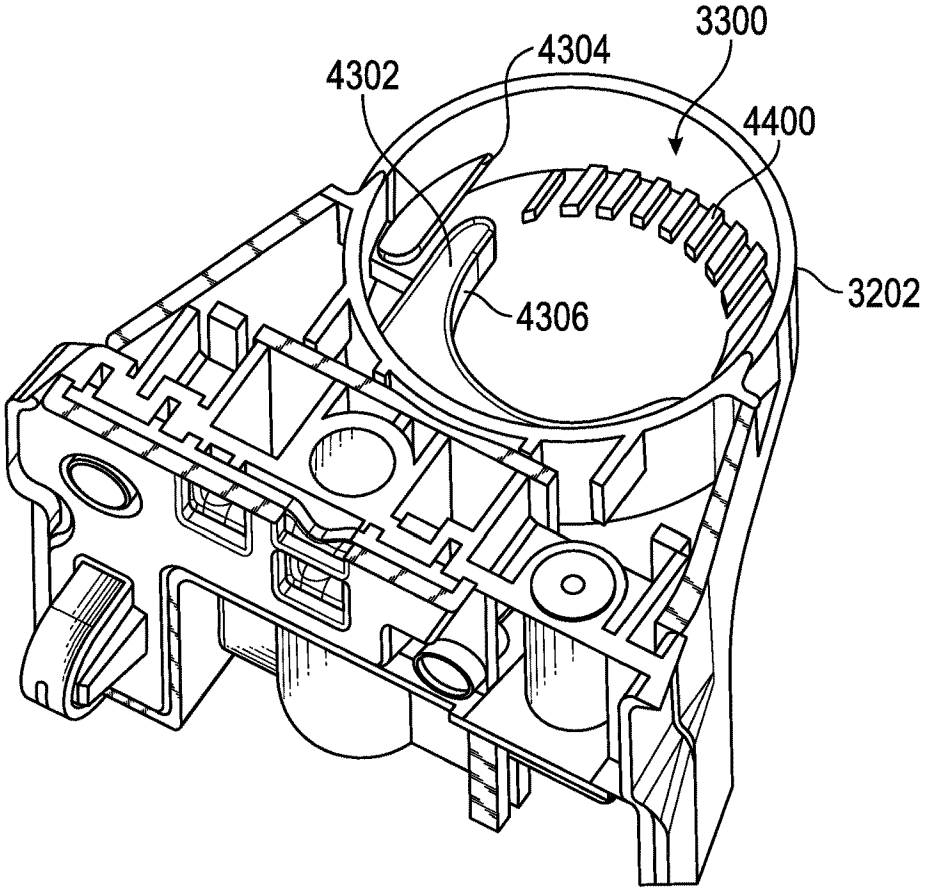
FIG. 95 illustrates a cross-sectional perspective view a cartridge and backpack showing tube management features of the backpack in accordance with aspects of the present disclosure.

FIG. 95 is a cross-sectional top perspective view of cartridge and backpack assembly 3203 showing how a plurality of coil ramp extensions 4400 can be formed on a bottom surface of internal cavity 3300 to form a ramp that encourages coiling of tubing 4000 when tubing 4000 is inserted into cavity 3300. As shown, each ramp extension 4400 may each have a height. The height of each ramp extension may increase with distance from strain relief structure 4304 to form the desired coil ramp.

The subject technology is illustrated, for example, according to various aspects described above. Various examples of these aspects are described as numbered concepts or clauses (1, 2, 3, etc.) for convenience. These concepts or clauses are provided as examples and do not limit the subject technology. It is noted that any of the dependent concepts may be combined in any combination with each other or one or more other independent concepts, to form an independent concept. The following is a non-limiting summary of some concepts presented herein:

Concept 1. A pump cartridge for a compounder system, the pump cartridge comprising:

at least one diluent port configured to receive a diluent in a diluent chamber;

a receiving container port configured to provide a fluid to a receiving container;

a plurality of controllable fluid pathways fluidly coupled to the at least one diluent port and the receiving container port; and a pump configured to pump the fluid within the plurality of controllable fluid pathways.

Concept 2. The pump cartridge of Concept 1 or any other Concept, further comprising a plurality of valves in the fluid pathways, wherein the valves are operable to select a particular fluid pathway from the plurality of fluid pathways.

Concept 3. The pump cartridge of Concept 2, further comprising:

a cartridge frame;

a cartridge bezel; and a sealing membrane disposed between the cartridge frame and the cartridge bezel, wherein the at least one diluent port and the plurality of valves are each formed, in part, from a portion of the sealing membrane that extends into a corresponding opening in the cartridge bezel, and wherein the cartridge frame and the sealing membrane form the plurality of fluid pathways.

Concept 4. The pump cartridge of Concept 3 or any other Concept, further comprising at least one waste port configured to provide vapor waste from a vapor waste chamber, wherein the at least one diluent port comprises three diluent ports aligned in a row with the at least one waste port.

Concept 5. The pump cartridge of Concept 4 or any other Concept, wherein the portion of the sealing membrane of each diluent port that extends into the corresponding opening in the cartridge bezel is radially compressed by the cartridge bezel such that when a diluent needle is extracted from that diluent port, the needle is wiped by the portion of sealing membrane.

Concept 6. The pump cartridge of Concept 3 or any other Concept, wherein the portion of the sealing membrane that extends into the corresponding opening for each valve comprises a pyramid-shaped dome that extends into the opening.

Concept 7. The pump cartridge of Concept 6 or any other Concept, wherein the cartridge frame comprises a rib in spaced opposition to the pyramid-shaped dome of each valve and wherein the pyramid-shaped dome is configured to be compressed against the corresponding rib of the cartridge frame to close the valve.

Concept 8. The pump cartridge of c1 Concept 7 or any other Concept, wherein the plurality of valves comprises a diluent valve group, a reconstitution valve group, and a pump valve group.

Concept 9. The pump cartridge of Concept 8 or any other Concept, wherein the diluent valve group comprises three valves, the reconstitution valve group comprises three valves, and the pump valve group comprises two valves disposed on opposing sides of a pump chamber for a piston pump.

Concept 10. The pump cartridge of Concept 9 or any other Concept, wherein the diluent valve group and the reconstitution valve group are operable to form a diluent to receiving container fluid path, a reconstitution fluid path, a compounding fluid path, and an air removal fluid path from the plurality of fluid pathways.

Concept 11. The pump cartridge of Concept 3 or any other Concept, further comprising a pressure dome formed from an additional portion of the sealing membrane that is located adjacent an additional opening in the cartridge bezel.

Concept 12. The pump cartridge of Concept 3 or any other Concept, further comprising:

a needle housing assembly; and a needle assembly disposed within the needle housing assembly.

Concept 13. The pump cartridge of Concept 12 or any other Concept, wherein the needle assembly comprises a dual lumen needle.

Concept 14. The pump cartridge of Concept 13 or any other Concept, wherein the needle assembly further comprises a spring configured to be compressed by a pressure on the needle housing assembly to expose the needle assembly.

Concept 15. The pump cartridge of Concept 14 or any other Concept, further comprising a sealing member disposed in the needle assembly housing, wherein the needle assembly is configured to extend through the sealing member when the spring is compressed.

Concept 16. The pump cartridge of Concept 3 or any other Concept, wherein the cartridge frame comprises latching structures for mounting a tube management backpack to the cartridge.

Concept 17. The pump cartridge of Concept 16 or any other Concept, further comprising an opening that extends through the cartridge frame and the cartridge bezel, wherein the opening is configured to align with a connector disposed in an opening in the backpack.

Concept 18. The pump cartridge of Concept 3 or any other Concept, further comprising a bayonet opening having a ramp structure configured to engage a bayonet of a pump head assembly of the compounder system for lifting and pulling of the cartridge from a carousel of cartridges.

Concept 19. The pump cartridge of Concept 3 or any other Concept, further comprising:

an air filter; and a pair of check valves configured to allow filtered air from the air filter to pass into the pump cartridge and to prevent unwanted vapors from flowing out of the pump cartridge.

Concept 20. A compounder system, comprising:

a pump head assembly having a plurality of operational mechanisms; and a pump cartridge comprising, a diluent port, an output port, a waste port, a plurality of valves, a needle assembly, and a piston, wherein the piston and the plurality of valves of the pump cartridge are configured to be operated by the plurality of operational mechanisms of the pump head assembly to (a) pump a fluid from a container through the diluent port and the needle assembly to a vial, (b) pump vapor waste through the needle assembly through the waste port to a waste container, and (c) pump a reconstituted drug from the vial through the needle assembly and the output port to a receiving container.

Concept 21. The compounder system of Concept 20 or any other Concept, wherein the diluent port comprises:

an opening in a bezel of the pump cartridge; and a portion of a sealing membrane of the cartridge that extends into the opening.

Concept 22. The compounder system of Concept 20 or any other Concept, wherein the diluent port comprises:

an opening in a bezel of the pump cartridge;

an outer sealing member that extends into the opening;

a portion of a sealing membrane of the cartridge; and an inner sealing member, wherein the portion of the sealing membrane is disposed between the outer sealing member and the inner sealing member.

Concept 24. The compounder system of Concept 22 or any other Concept, further comprising a recess in the outer sealing member adjacent to the portion of the sealing membrane.

Concept 25. The compounder system of Concept 24 or any other Concept, further comprising an additional recess in the sealing membrane adjacent to the inner sealing member.

Concept 26. The compounder system of Concept 20 or any other Concept, wherein the pump cartridge further comprises an opening configured to allow communication with an optical sensor of the pump head assembly, wherein the optical sensor is configure to cause automatic retraction of a receiving container tube coupled to the output port in response to detection of a connector attached to the receiving container tube.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

One or more aspects or features of the subject matter described herein may be realized in digital electronic circuitry, integrated circuitry, specially designed ASICs (application specific integrated circuits), computer hardware, firmware, software, and/or combinations thereof. For example, infusion pump systems disclosed herein may include an electronic system with one or more processors embedded therein or coupled thereto. Such an electronic system may include various types of computer readable media and interfaces for various other types of computer readable media. Electronic system may include a bus, processing unit(s), a system memory, a read-only memory (ROM), a permanent storage device, an input device interface, an output device interface, and a network interface, for example.

Bus may collectively represent all system, peripheral, and chipset buses that communicatively connect the numerous internal devices of electronic system of an infusion pump system. For instance, bus may communicatively connect processing unit(s) with ROM, system memory, and permanent storage device. From these various memory units, processing unit(s) may retrieve instructions to execute and data to process in order to execute various processes. The processing unit(s) can be a single processor or a multi-core processor in different implementations.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

The word "exemplary" is used herein to mean "serving as an example or illustration." Any aspect or design described herein as "exemplary" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, or operations in the processes or methods disclosed are illustrations of exemplary approaches. Based upon implementation preferences or scenarios, it is understood that the specific order or hierarchy of steps, operations or processes may be rearranged. Some of the steps, operations or processes may be performed simultaneously. In some implementation preferences or scenarios, certain operations may or may not be performed. Some or all of the steps, operations, or processes may be performed automatically, without the intervention of a user. The accompanying method claims present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

What is claimed is:

1. A pump cartridge for a compounder system, the pump cartridge comprising:

at least one diluent port configured to receive a diluent in a diluent chamber;

a receiving container port configured to provide a fluid to a receiving container;

a plurality of controllable fluid pathways fluidly coupled to the at least one diluent port and the receiving container port;

a pump configured to pump the fluid within the plurality of controllable fluid pathways; and at least one waste port configured to provide vapor waste from a vapor waste chamber, wherein the at least one diluent port comprises three diluent ports aligned in a row with the at least one waste port.

2. The pump cartridge of claim 1, further comprising a plurality of valves in the fluid pathways, wherein the valves are operable to select a particular fluid pathway from the plurality of fluid pathways.

3. The pump cartridge of claim 2, further comprising:

a cartridge frame;

a cartridge bezel; and a sealing membrane disposed between the cartridge frame and the cartridge bezel, wherein the at least one diluent port and the plurality of valves are each formed, in part, from a portion of the sealing membrane that extends into a corresponding opening in the cartridge bezel, and wherein the cartridge frame and the sealing membrane form the plurality of fluid pathways.

4. The pump cartridge of claim 3, wherein the portion of the sealing membrane of each diluent port that extends into the corresponding opening in the cartridge bezel is radially compressed by the cartridge bezel such that when a diluent needle is extracted from that diluent port, the needle is wiped by the portion of sealing membrane.

5. The pump cartridge of claim 3, wherein the portion of the sealing membrane that extends into the corresponding opening for each valve comprises a raised portion that extends into the opening.

6. The pump cartridge of claim 3, further comprising a pressure dome formed from an additional portion of the sealing membrane that is located adjacent an additional opening in the cartridge bezel.

7. A pump cartridge for a compounder system, the pump cartridge comprising:

at least one diluent port configured to receive a diluent in a diluent chamber;

a receiving container port configured to provide a fluid to a receiving container;

a plurality of controllable fluid pathways fluidly coupled to the at least one diluent port and the receiving container port;

a pump configured to pump the fluid within the plurality of controllable fluid pathways;

a cartridge frame;

a cartridge bezel;

a plurality of valves in the fluid pathways, wherein the valves are operable to select a particular fluid pathway from the plurality of fluid pathways; and a sealing membrane disposed between the cartridge frame and the cartridge bezel, wherein the at least one diluent port and the plurality of valves are each formed, in part, from a portion of the sealing membrane that extends into a corresponding opening in the cartridge bezel, and wherein the cartridge frame and the sealing membrane form the plurality of fluid pathways, wherein the portion of the sealing membrane that extends into the corresponding opening for each valve comprises a raised portion that extends into the opening, wherein the cartridge frame comprises a rib in spaced opposition to the raised portion of each valve and wherein the raised portion is configured to be compressed against the corresponding rib of the cartridge frame to close the valve.

8. The pump cartridge of claim 7, wherein the plurality of valves comprises a diluent valve group, a reconstitution valve group, and a pump valve group.

9. The pump cartridge of claim 8, wherein the diluent valve group comprises three valves, the reconstitution valve group comprises three valves, and the pump valve group comprises two valves disposed on opposing sides of a pump chamber for a piston pump.

10. The pump cartridge of claim 9, wherein the diluent valve group and the reconstitution valve group are operable to form a diluent to receiving container fluid path, a reconstitution fluid path, a compounding fluid path, and an air removal fluid path from the plurality of fluid pathways.

11. A pump cartridge for a compounder system, the pump cartridge comprising:

at least one diluent port configured to receive a diluent in a diluent chamber;

a receiving container port configured to provide a fluid to a receiving container;

a plurality of controllable fluid pathways fluidly coupled to the at least one diluent port and the receiving container port;

a pump configured to pump the fluid within the plurality of controllable fluid pathways;

a needle housing assembly; and a needle assembly disposed within the needle housing assembly.

12. The pump cartridge of claim 11, wherein the needle assembly comprises a dual lumen needle.

13. The pump cartridge of claim 12, wherein the needle assembly further comprises a spring configured to be compressed by a pressure on the needle housing assembly to expose the needle assembly.

14. The pump cartridge of claim 13, further comprising a sealing member disposed in the needle assembly housing, wherein the needle assembly is configured to extend through the sealing member when the spring is compressed.

15. A pump cartridge for a compounder system, the pump cartridge comprising:

at least one diluent port configured to receive a diluent in a diluent chamber;

a receiving container port configured to provide a fluid to a receiving container;

a plurality of controllable fluid pathways fluidly coupled to the at least one diluent port and the receiving container port;

a pump configured to pump the fluid within the plurality of controllable fluid pathways;

a cartridge frame, wherein the cartridge frame comprises latching structures for mounting a tube management backpack to the cartridge; and a cartridge bezel.

16. The pump cartridge of claim 15, further comprising an opening that extends through the cartridge frame and the cartridge bezel, wherein the opening is configured to align with a connector disposed in an opening in the backpack.

17. A pump cartridge for a compounder system, the pump cartridge comprising:

at least one diluent port configured to receive a diluent in a diluent chamber;

a receiving container port configured to provide a fluid to a receiving container;

a plurality of controllable fluid pathways fluidly coupled to the at least one diluent port and the receiving container port;

a pump configured to pump the fluid within the plurality of controllable fluid pathways; and a bayonet opening having a ramp structure configured to engage a bayonet of a pump head assembly of the compounder system for lifting and pulling of the cartridge from a carousel of cartridges.

18. A pump cartridge for a compounder system, the pump cartridge comprising:

at least one diluent port configured to receive a diluent in a diluent chamber;

a receiving container port configured to provide a fluid to a receiving container;

a plurality of controllable fluid pathways fluidly coupled to the at least one diluent port and the receiving container port;

a pump configured to pump the fluid within the plurality of controllable fluid pathways;

an air filter; and a pair of check valves configured to allow filtered air from the air filter to pass into the pump cartridge and to prevent unwanted vapors from flowing out of the pump cartridge.

* * * * *